US006225018B1

(12) United States Patent
Haraga

(10) Patent No.: US 6,225,018 B1
(45) Date of Patent: May 1, 2001

(54) SILVER HALIDE LIGHT SENSITIVE COLOR PHOTOGRAPHIC MATERIAL

(75) Inventor: Hideaki Haraga, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/558,684

(22) Filed: Apr. 24, 2000

(30) Foreign Application Priority Data

Apr. 27, 1999 (JP) ..... 11-119701

(51) Int. Cl.[7] ..... G03C 1/72
(52) U.S. Cl. ..... 430/139; 430/394; 430/570
(58) Field of Search ..... 430/139, 570

(56) References Cited

U.S. PATENT DOCUMENTS 5,391,443 * 2/1995 Simons et al. ..... 430/506

* cited by examiner

*Primary Examiner*—Hoa Van Le
(74) *Attorney, Agent, or Firm*—Frishauf, Holtz, Goodman, Langer & Chick, P.C.

(57) ABSTRACT

A silver halide light sensitive color photographic material is disclosed, comprising a support and at least a light sensitive silver halide emulsion layer which comprises a silver halide emulsion and a coupler, the photographic material further comprising a luminance component information recording layer.

12 Claims, 1 Drawing Sheet

SILVER HALIDE LIGHT SENSITIVE COLOR PHOTOGRAPHIC MATERIAL

FIELD OF THE INVENTION

The present invention relates to a silver halide light sensitive color photographic material and a method for forming a high image quality digital image using image information formed by the photographic material.

BACKGROUND OF THE INVENTION

In methods known as conventional color photography, a photographic camera material (a so-called color negative film) in general comprises a blue light-recording, yellow dye-forming layer, a green light-recording, magenta dye-forming layer, and a red light-recording, cyan dye-forming layer. Accordingly, the function of conventional color negative films is defined as conversion of lightness (or darkness) information for each color component of a photographic object to yellow, magenta or cyan image density information, followed by transfer of the information, via a printing process, to a blue-sensitive layer, green-sensitive layer or a red-sensitive layer of photographic color paper. A performance element of this color film for camera use is represented by sensitivity and image quality, and the image quality element is further classified into graininess, sharpness and color reproduction. To enhance photographic performance of the color film for camera use, the design is made to be such that the spectral sensitivity distribution is adjusted to achieve desired color reproduction and a compound capable of releasing a development inhibitor upon development (a so-called DIR compound) is incorporated to enhance an interlayer development inhibiting effect (so-called interimage effect), while enhancing sensitivity, graininess and sharpness respectively in each layer. However, there is a trade-off relationship such that when sensitivity is enhanced, image tends to deteriorate. It is therefore not too much to say that the history of development or improvements in color film for camera use is to be that of compatibility of sensitivity and image quality with each other.

There is also known a method in which images formed in a color negative film are read by an optical means such as a scanner, converted to electric signals and then subjected to image processing to prepare digital image data, and based thereon, image information is transferred onto another image recording material. In this case, finished prints can be obtained using a digital printer in which a finished print is obtained by subjecting color paper to scanning exposure, or using non-silver printers such as an ink-jet printer, a sublimation-type thermal transfer printer and an electrophotographic printer. Further, when assuming that information recorded on color negative film is not to be directly projected through an optical system onto color paper to prepare a finished print, a condition in which blue information, green information and red information of a photographic object respectively correspond to yellow, magenta and cyan image information, is not necessarily required in film design. Accordingly, there is still room for enhancements of performance by designing constitutions different from those of conventional photographic materials.

As a photosensitive element for converting images to digitized image data on the premise of no optical printing being required is known a method in which a fluorescent material is contained in an interlayer without incorporating different dye-forming couplers respectively into blue-sensitive, green-sensitive and red-sensitive layers and blue-green- and red-separated images are extracted by scanning, in both a reflection and a transmission means, developed images in different photosensitive layers, which have the same hue and further subjecting the image data to image processing, as disclosed in U.S. Pat. Nos. 5,418,119 and 5,420,003. This method is advantageous in terms of simplification of photosensitive materials and processing thereof, and rapid access but can not unfortunately be employed as a means for enhancing the image quality of conventional color photographic materials.

JP-A 61-34541 (hereinafter, the term, JP-A means an unexamined and published Japanese Patent Application) describes a method of providing a so-called donor layer giving an inhibiting effect to the red-sensitive layer as a means for bringing a gravity center wavelength of an interimage effect distribution in the green region of the red-sensitive layer close to the gravity center wavelength in spectral sensitivity of the green-sensitive layer. This method is effective to achieve faithful color reproduction. However, color formation of developed film, which is basically integrated to yellow, magenta and cyan information provides no specific information when reading the film by a scanner. Therefore, it is not assured that the method described above is a positive means for obtaining color digitized images of high sensitivity as well as high image quality.

JP-A 11-72870 discloses a means for providing a non-visible light-sensitive layer to enhance color reproduction. In this case, however, color formation of a developed film is basically integrated into yellow, magenta and cyan information, providing no specific information when the film is read by a scanner. JP-A 11-143031 discloses a means for enhancing color reproduction in which information in the non-visible light-sensitive layer is extracted as separate information at the time of scanning the developed film and combined with RGB signals. This method was intended to solve partially unwanted color reproduction by providing the non-visible light-sensitive layer but was not a sufficient technical means for solving the trade-off relationship between sensitivity and color reproduction.

SUMMARY OF THE INVENTION

To solve problems regarding the trade-off relationship between sensitivity and image quality in design of color photographic material for camera use, an object of the present invention is to provide a silver halide color photographic material, a developed film of which is subjected to scanning to extract digitized images, thereby leading to markedly enhanced sensitivity and image quality, and a method of digital color image formation by use thereof.

The above object of the invention can be accomplished by the following constitution:

1. A silver halide light sensitive color photographic material comprising on a support at least a light sensitive silver halide emulsion layer which comprises a silver halide emulsion and a coupler, the photographic material further comprising a luminance component information recording layer;
2. A silver halide light sensitive color photographic material comprising on a support a red-sensitive layer, a green-sensitive layer and a blue-sensitive layer, wherein the photographic material further comprises a luminance component information recording layer;
3. A silver halide light sensitive color photographic material comprising on a support a color information recording unit and a luminance component information recording layer, wherein the color information recording unit comprises a red-sensitive layer, a green-sensitive layer and a blue-sensitive layer, and the luminance component information recording layer has a sensitivity to light in a predetermined wavelength region;

4. The silver halide color photographic material described in 2., wherein each of the red-sensitive layer, the green-sensitive layer, the blue-sensitive layer and the luminance component information recording layer comprises a coupler capable of forming a dye upon reaction with an oxidized product of a color developing agent;

5. A silver halide light sensitive color photographic material comprising a support, a color information recording unit and a luminance component information recording layer coated on the support, wherein the color information recording unit comprises a color filter and a panchromatic silver halide emulsion layer which is blue-, green- and red-sensitive;

6. The silver halide color photographic material described in 5., wherein the panchromatic silver halide emulsion layer is capable of forming a visible black image upon exposure to visible light and processing, the luminance component information recording layer is capable of forming an invisible image upon exposure to light and processing;

7. The silver halide color photographic material described in 2., wherein the luminance component information recording layer has a sensitivity in a visible light region;

8. The silver halide color photographic material described in 2., wherein the luminance component information recording layer has a sensitivity in a invisible light region;

9. The silver halide color photographic material described in 2., wherein the luminance component information recording layer has a spectral sensitivity maximum, and having a first sensitivity of 20% of the spectral sensitivity maximum at a wavelength of 360 to 520 nm and a second sensitivity of 20% of the spectral sensitivity maximum at a wavelength of 600 to 900 nm;

10. The silver halide color photographic material described in 9., wherein the luminance component information recording layer has a spectral sensitivity maximum at a wavelength of 510 to 600 nm, and having a first sensitivity of 20% of the spectral sensitivity maximum at a wavelength of 460 to 520 nm and a second sensitivity of 20% of the sensitivity maximum at a wavelength of 620 to 660 nm;

11. The silver halide color photographic material described in 10., wherein the luminance component information recording layer has a sensitivity in an infrared light region;

12. The silver halide color photographic material described in 10., wherein the luminance component information recording layer comprises an infrared dye forming coupler;

13. An image forming method comprising the steps of:

(a) imagewise exposing a silver halide photographic material to light, the photographic material comprising on a support a color information recording unit and a luminance component information recording layer, the color information recording unit comprising a blue-sensitive layer containing a first coupler, a green-sensitive layer containing a second coupler and a red-sensitive layer containing a third coupler, the luminance component information recording layer having a sensitivity to light in a predetermined wavelength region and containing a fourth coupler, (b) processing the exposed photographic material to make a color information recorded on the color information recording unit and a luminance component information recorded on the luminance component information recording layer readable, (c) reading the luminance component information to obtain a first luminance component Lo, (d) reading the color information to obtain a blue component B, a green component G and a red component R, (e) converting the blue component B, the green component G and the red component R to a second luminance component L, a hue component a and a chroma component b, and (f) generating a digital image information by use of the first luminance component $L_0$, the hue component a and the chroma component b;

14. The method described in 13., wherein in step (a), the luminance component information recording layer is placed closer to an object than the color information recording unit;

15. The method described in 13., wherein in step (b), the processing comprises thermally developing the exposed photographic material;

16. An image forming method comprising the steps of:

(a) imagewise exposing a silver halide photographic material to light, the photographic material comprising on a support a color information recording unit and a luminance component information recording layer, the color information recording unit comprising a color filter and a panchromatic sensitive layer containing a fifth coupler, the luminance component information recording layer having a sensitivity to light of a predetermined wavelength region and containing a fourth coupler, (b) processing the exposed photographic material to make a color information recorded on the color information recording unit and a luminance component information recorded on the luminance component information recording layer readable, (c) reading the luminance component information to obtain a first luminance component $L_0$, (d) reading the color information to obtain a blue component B, a green component G and a red component R, (e) converting the blue component B, the green component G and the red component R to a second luminance component L, hue component a and a chroma component b, and (f) generating a digital image information by use of the first luminance component $L_0$, the hue component a and the chroma component b.

DETAILED DESCRIPTION OF THE INVENTION

Figure 1:
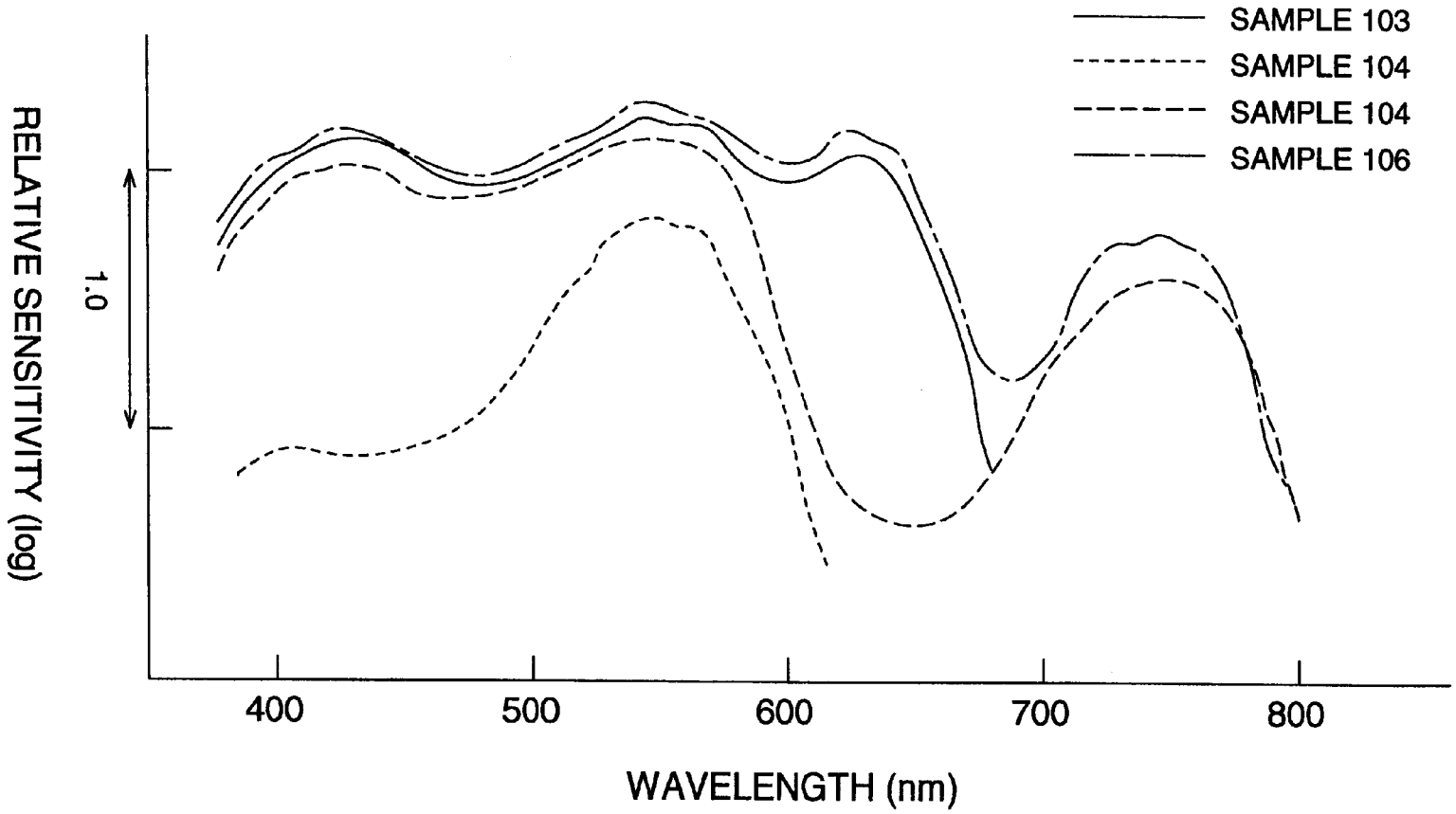
FIG. 1 shows spectral sensitivity distribution of a luminance component information recording layer.

One aspect of a silver halide light sensitive color photographic material according to the invention is that the photographic material has a light sensitive, luminance information recording layer (hereinafter, also denoted as a luminance information recording layer) to extract a luminance information and a color information of digital color images, and the photographic material independently preferably further has a light sensitive, color information recording layer (hereinafter, also denoted as a color information recording layer).

The luminance information recording layer used in the invention will now be described. The light sensitive, luminance information recording layer has a function of controlling lightness (or darkness) information of an object image and texture of the image. Such characteristic can be controlled mainly by adjusting the spectral sensitivity distribution, so as to meet an objective or usage thereof. In conventional color photographic materials, varying the spectral sensitivity distribution to a large extent results in considerable influences on reproduction of hue, making it impossible to obtain color images acceptable in practical use. In the silver halide color photographic material according to the invention, on the contrary, hue information is extracted from the color information recording layer, so that the spectral sensitivity distribution of the luminance information recording layer can be selected not only from the visible region but also from the invisible light wavelength region.

Spectral sensitivity of the luminance information recording layer can be optimally set according to an object or usage of a silver halide color photographic material. It is preferred to have a spectral sensitivity distribution in the visible region for the purpose of obtaining a naturalistic picture. Specifically, to achieve a high-sensitive luminance information recording layer, it is preferred to have a spectral sensitivity distribution over the whole visible region of 400 to 700 nm, so-called panchromatic sensitivity. To achieve faithful reproduction of sensation in lightness (or darkness) of the object, it is preferred that the luminance information recording layer exhibits a spectral sensitivity maximum at a wavelength of 510 to 600 m, the shortest wavelength at which the sensitivity is 20% of the spectral sensitivity maximum being 460 to 520 nm and the longest wavelength at which the sensitivity is 20% of the spectral sensitivity maximum being 620 to 660 nm.

Extending spectral sensitivity of the luminance information recording layer to the invisible light wavelength region enables to provide unique image representation or texture without varying hue of the object. To enhance representation of a distant view of mountains or cloud, it is effective to allow the luminance information recording layer to have a sensitivity in an infrared wavelength region. In ecology photographs or specimen photographing of insects or plants, specifically for the purpose of determination of the sex of such a butterfly, which can not be distinguished with visible light, or photographing for identification or inspection, it is effective to allow the luminance information recording layer to have a sensitivity in a ultraviolet wavelength region. The preferred invisible light wavelength region used in the luminance information recording layer is preferably 200 to 400 nm for the ultraviolet region, and 700 to 1300 nm (and more preferably 700 to 1,000 nm) for the infrared region. The luminance information recording layer preferably has sensitivity in both visible and invisible wavelength regions, thereby enabling to provide an object information non-recognizable to the naked eye to the naturalistic picture representation. In this case, the shortest wavelength at which the sensitivity is 20% of the spectral sensitivity maximum is preferably 360 to 520 nm and the longest wavelength at which the spectral sensitivity is 20% of the sensitivity maximum being 650 to 900 nm.

Examples of methods for providing a spectral sensitivity within the ultraviolet region to the luminance information recording layer include a method of employing intrinsic sensitivity of silver halide grains. Adjustment of the spectral sensitivity distribution in the ultraviolet region can be achieved by varying halide composition of silver halide grains. Exemplarily, silver halide grains are preferably silver bromochloride or silver iodobromochloride having a chloride content of at least 30 mol %, and more preferably at least 60 mol %.

Spectral sensitivity in the infrared region can be provide by allowing an infrared sensitizing dye to be adsorbed onto silver halide grains.

Infrared sensitizing dyes usable in the invention are preferably compounds represented by the following formula (I-a) or (I-b):

Formula (I-a)

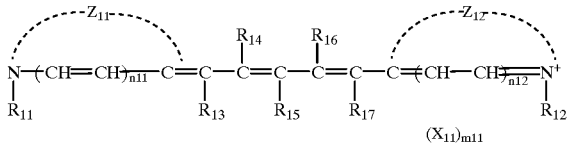

Formula (I-b)

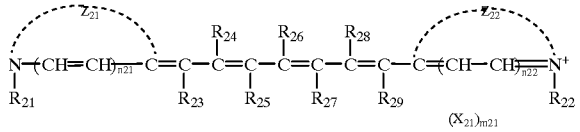

wherein $Z_{11}$, $Z_{12}$, $Z_{21}$ and $Z_{22}$ are each a non-metallic atom group necessary to form a nitrogen containing 5- or 6-membered ring and its condensed ring; $R_{11}$, $R_{12}$, $R_{21}$ and $R_{22}$ are each an aliphatic group; $R_{13}$, $R_{14}$, $R_{15}$, $R_{16}$, $R_{17}$, $R_{23}$, $R_{24}$, $R_{25}$, $R_{26}$, $R_{27}$, $R_{28}$ and $R_{29}$ are each a hydrogen atom, an alkyl group, an alkoxy group, an aryloxy group, an aryl group, —$N(W_1)W_2$, —SR or a heterocyclic group, in which R is an alkyl group, an aryl group or a heterocyclic group, and $W_1$ and $W_2$ are each an alkyl group, an aryl group or a heterocyclic group and W1 and W2 may combine with each other to form a 5- or 6-membered nitrogen containing ring, provided that $R_{11}$ and $R_{13}$, $R_{14}$ and $R_{16}$, $R_{17}$ and $R_{12}$, $R_{15}$ and $R_{17}$, $R_{21}$ and $R_{23}$, $R_{24}$ and $R_{26}$, $R_{25}$ and $R_{27}$, $R_{26}$ and $R_{28}$, or $R_{22}$ and $R_{29}$, each pair may combine with each other to form a 5- or 6-membered ring or its condensed ring; $X_{11}$ and $X_{21}$ are each an ion necessary to compensate an intramolecular charge; $m_{11}$ and $m_{21}$ are each an ion necessary to compensate an intramolecular charge; and $n_{11}$, $n_{12}$, $n_{21}$ and $n_{22}$ are each 0 or 1.

Examples of the 5- or 6-membered ring and its condensed ring formed by $Z_{11}$, $Z_{12}$, $Z_{21}$ and $Z_{22}$ include benzothiazole, naphthothiazole, benzoselenazole, naphthoselenazole, quinoline, benzoxazole, naphthooxazole, penanthrothiazole, thiadiazole, and naphthopyridine. Examples of the aliphatic group represented by $R_{11}$, $R_{12}$, $R_{21}$ and $R_{22}$ include an alkyl group such as methyl, ethyl, propyl, pentyl, sulfopropyl, hydroxyethyl, phenethyl, sulfobutyl, diethylaminosulfopropyl, methoxyethyl, naphthoxyethyl, carboxymethyl, and carboxyethyl, and an akenyl group such as propenyl. Examples of an alkyl group, an alkoxy group, an aryloxy group, an aryl group, —$N(W_1)W_2$, —SR or a heterocyclic group represented by $R_{13}$, $R_{14}$, $R_{15}$, $R_{16}$, $R_{17}$, $R_{23}$, $R_{24}$, $R_{25}$, $R_{26}$, $R_{27}$, $R_{28}$ and $R_{29}$ include an alkyl group such as methyl, ethyl, propyl, butyl, and benzyl; an alkoxy group such as methoxy and ethoxy; an aryloxy group such as phenoxy or p-methylphenoxy; a —$N(W_1)W_2$ group such as diethylamino, anilino, piperidino or furylamino; a-SR group such as methylthio, phenylthio or thienylthio; and a heterocyclic group thienyl or furyl. Examples of the 5- or 6-membered ring or its condensed ring formed by combination of $R_{11}$ and $R_{13}$, $R_{14}$ and $R_{16}$, $R_{17}$ and $R_{12}$, $R_{15}$ and $R_{17}$, $R_{21}$ and $R_{23}$, $R_{24}$ and $R_{26}$, $R_{25}$ and $R_{27}$, $R_{26}$ and $R_{28}$, or $R_{22}$ and $R_{29}$ include cyclohexane, cyclopentene, cyclohexene, pyrroline, 1,2,3,4-tetrahydropyridine and piperidine. Ions represented by $X_{11}$ and $X_{21}$ include $F^-$, $Cl^-$, $Br^-$, $I^-$, $BF_4^-$, $ClO_4^-$, $PF_6^-$, trifluoromethanesufonate ion, and p-toluenesulfonate ion.

Of compounds (sensitizing dyes) represented by formula (I-a) or (I-b) are more preferred compounds (sensitizing dyes) represented by the following formula (I-e) or (I-f):

Formula (I-e)

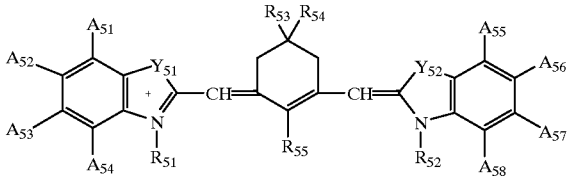

$(M_{51})_{m51}$

Formula (I-f)

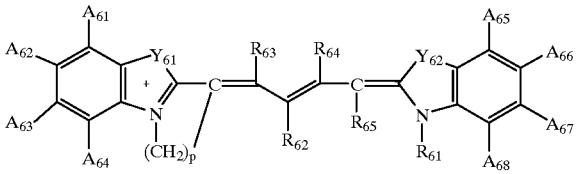

$(M_{61})_{m61}$ wherein $Y_{51}$, $Y_{52}$, $Y_{61}$ and $Y_{62}$ are each an oxygen atom, a sulfur atom, a selenium atom or >N—R, in which R is an alkyl group, an aryl group or a heterocyclic group; $R_{51}$ and $R_{52}$ are each an aliphatic group, $R_{61}$ is an aliphatic group or a non-metallic atom group necessary to form a 5- or 6-membered ring by combining with $R_{65}$; $R_{53}$ and $R_{54}$ are each a hydrogen atom, an alkyl group, an aryl group, a heterocyclic group, a halogen atom, an alkoxy group, an alkylthio group or an amino group; $R_{63}$ and $R_{64}$ are each a hydrogen atom, an alky group or a non-metallic atom group necessary to form a 5- or 6-membered ring by combination of $R_{63}$ and $R_{64}$; $R_{65}$ is a hydrogen atom or a bond with $R_{61}$; $A_{51}$ to $A_{58}$, and $A_{61}$ to $A_{68}$ are each a hydrogen atom or a substituent, provided that a ring may be formed by combination between A51 to $A_{54}$, $A_{55}$ to $A_{58}$, $A_{61}$ to $A_{64}$, or $A_{65}$ to $A_{68}$; $M_{51}$ and $M_{61}$ are each an ion necessary to compensate an intramolecular charge; $m_{51}$ and $m_{61}$ each represent the number of an ion necessary to compensate an intramolecular charge; and p is 2 or 3.

In formulas (I-e) and (I-f), examples of the alkyl group, aryl group or heterocyclic group represented by R include alkyl group, aryl group and heterocyclic groups exemplified in formula (I-a) and (I-b). Examples of the aliphatic group represented by $R_{51}$, $R_{52}$ and $R_{61}$ include aliphatic groups exemplified in $R_1$ of formula (I-a). Examples of 5- or 6-membered rings completed by combination of $R_{61}$ and $R_{65}$ include the same as rings completed by combination of $R_{11}$ and $R_{13}$ of formula (I-a). Examples of the hydrogen atom, alkyl group, aryl group or heterocyclic group represented by $R_{53}$ and $R_{54}$ include the same as those exemplified in $R_{13}$ of formula (I-a). Of a hydrogen atom, alkyl group, aryl group, heterocyclic group, halogen atom, alkoxy group, alkylthio group and amino group represented by $R_{55}$ and $R_{62}$, examples of the alkyl group, aryl group, heterocyclic group, alkoxy group, alkylthio group and amino group include the same as those exemplified in $R_{13}$ of formula (I-a). Examples of the halogen atom include fluorine, chlorine, bromine and iodine atoms. Examples if an alkyl group represented by $R_{63}$ or $R_{64}$ include the same as that exemplified in $R_{13}$ of formula (I-a). Examples of a 5- or 6-membered ring formed by combination of $R_{63}$ and $R_{64}$ include the same as exemplified in the ring formed by combination of $R_{14}$ and $R_{16}$ of formula (I-a). Examples of the substituent represented by A51 to A58 and A61 to A68 include a halogen atom such as a chlorine atom, bromine atom, or iodine atom; an alkyl group such as methyl, ethyl, butyl, trifluoromethyl. isopropyl; an alkoxy group such as methoxy; an aryl group such as phenyl or tolyl; and a carboxy group. Examples of the ring formed by combination between $A_{51}$ to $A_{54}$, $A_{55}$ to $A_{58}$, $A_{61}$ to $A_{64}$ or $A_{65}$ to $A_{68}$ include benzene and 2H-1,3-dioxonol. Examples of the ion represented by $M_{51}$ and $M_{61}$ include the same as exemplified in $X_{11}$ of formula (I-a).

In the compounds (sensitizing dyes) represented by formula (I-e) or (I-f) is preferred a compound characterized in that at least one of $A_{51}$ to $A_{58}$ and $A_{61}$ to $A_{68}$ is a chlorine atom, or at least one pair of $A_{51}$ and $A_{52}$, $A_{52}$ and $A_{53}$, $A_{53}$ and $A_{54}$, $A_{55}$ and $A_{56}$, $A_{56}$ and $A_{57}$, $A_{57}$ and $A_{58}$, and $A_{61}$ and $A_{62}$, $A_{62}$ and $A_{63}$, $A_{63}$ and $A_{64}$, $A_{65}$ and $A_{66}$, $A_{66}$ and $A_{67}$, and $A_{67}$ and $A_{68}$ combines to form a condensed naphthol ring.

Exemplary examples of the compounds represented by formulas (I-a), (I-b), (I-e), and (I-f) are shown below, but not limited to these. Further, examples of the compound represented by formula (I-a) or (I-b) include compounds A-1 through A-14, B1 through B25 described in JP-A 7-13289.

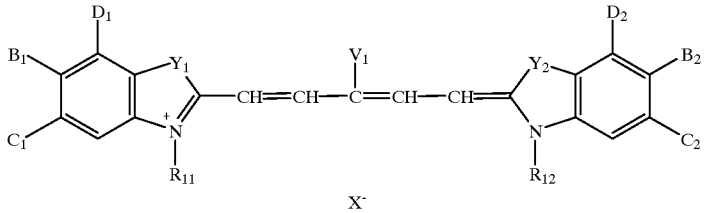

| Ex. No. No. | $Y_1$ | $Y_2$ | $B_1$ | $C_1$ | $B_2$ | $C_2$ | $R_{11}$ | $R_{12}$ | $V_1$ | X | $D_1$ | $D_2$ |
|---|---|---|---|---|---|---|---|---|---|---|---|---|
| I-a-1 | Se | Se | H | Cl | H | Cl | $C_2H_5$ | $C_2H_5$ | H | I | H | H |
| I-a-2 | S | S | H | Cl | H | Cl | $C_2H_5$ | $C_2H_5$ | H | I | H | H |

-continued

| | | | | | | | | | | | | |
|---|---|---|---|---|---|---|---|---|---|---|---|---|
| I-a-3 | Se | Se | Cl | Cl | Cl | Cl | $C_2H_5$ | $C_2H_5$ | H | Br | H | H |
| I-a-4 | Se | S | Cl | Cl | Cl | Cl | $C_2H_5$ | $C_2H_5$ | H | Br | H | H |
| I-a-5 | S | S | H | Cl | H | Cl | $C_2H_5$ | $(CH_2)_3SO_3^-$ | $C_2H_5$ | I | H | H |
| I-a-6 | S | S | $C_2H_5$ | $OCH_3$ | $C_2H_5$ | $OCH_3$ | $C_5H_{11}$ | $C_5H_{11}$ | $C_2H_5$ | Br | Cl | Cl |
| I-a-7 | S | S | $C_2H_5$ | | $C_2H_5$ | | $C_5H_{11}$ | $C_5H_{11}$ | $C_4H_9$ | Br | Cl | Cl |
| I-a-8 | S | S | $OCH_3$ | $OCH_3$ | $OCH_3$ | $OCH_3$ | $C_2H_5$ | $C_2H_5$ | $CH_3$ | I | H | H |
| I-a-9 | S | S | $OCH_3$ | H | $OCH_3$ | H | $C_2H_5$ | $C_2H_5$ | H | I | $OCH_3$ | $OCH_3$ |
| I-a-10 | S | S | $OCH_3$ | H | $OCH_3$ | H | $CH_2CH{=}CH_2$ | $CH_2CH{=}CH_2$ | H | I | $OCH_3$ | $OCH_3$ |
| I-a-11 | S | S | $OCH_3$ | H | $OCH_3$ | H | $CH_2CH{=}CH_2$ | $CH_2CH{=}CH_2$ | $C_2H_5$ | Br | $OCH_3$ | $OCH_3$ |
| I-a-12 | S | S | $OCH_3$ | $OCH_3$ | $OCH_3$ | $OCH_3$ | $CH_2CH{=}CH_2$ | $CH_2CH{=}CH_2$ | H | Br | H | H |

I-a-13

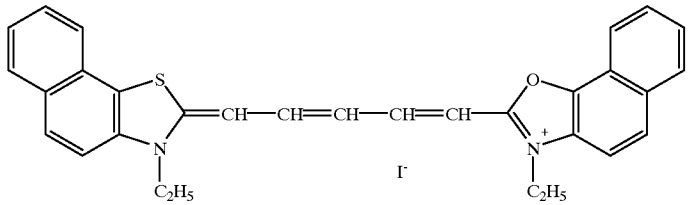

I-a-14

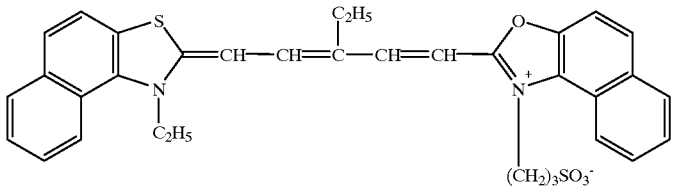

I-a-15

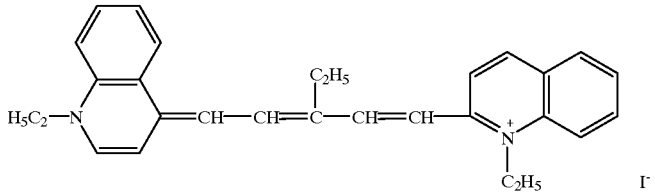

I-a-16

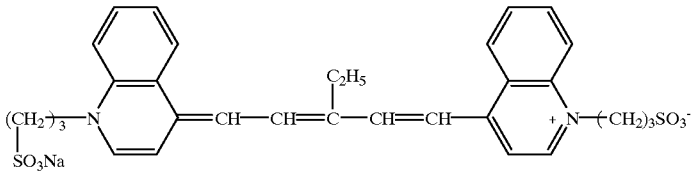

I-a-17

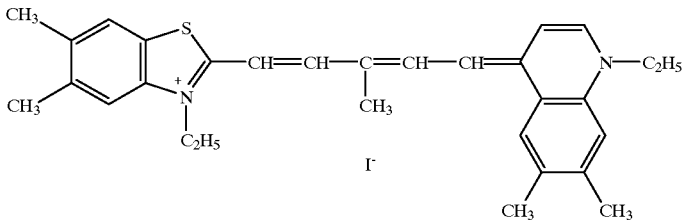

I-a-18

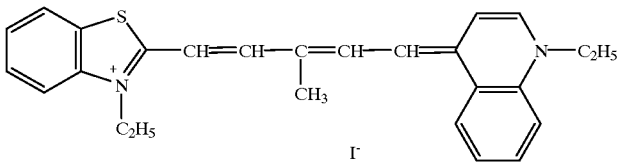

-continued
I-a-19
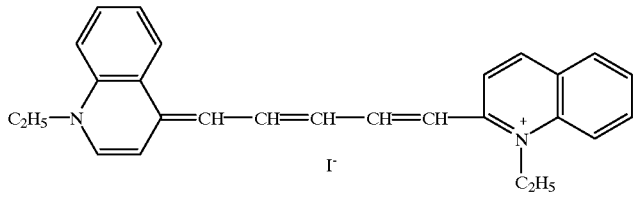
I-a-20
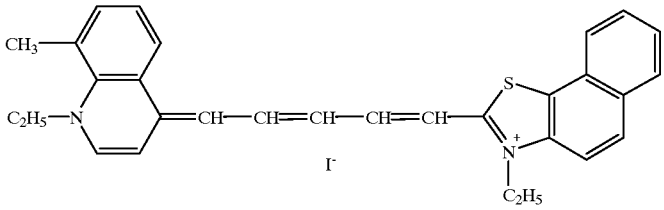
I-a-21
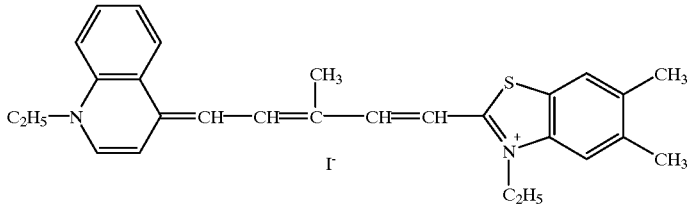
I-a-22
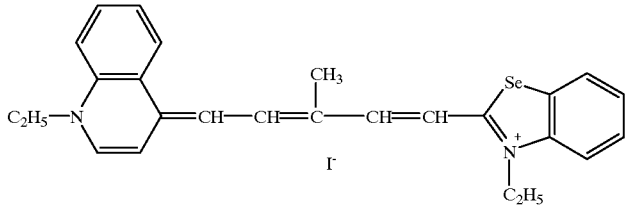
I-a-23
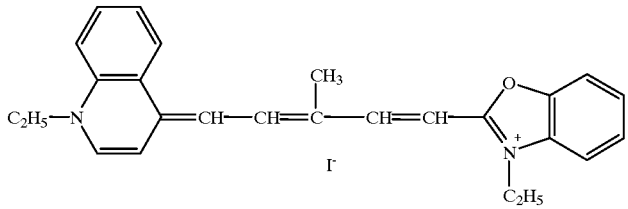
I-a-24
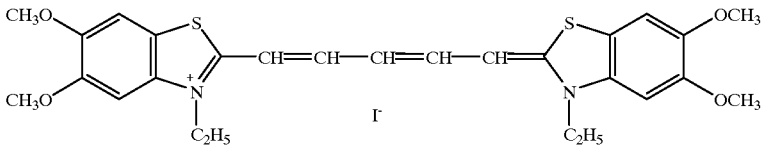
I-a-25
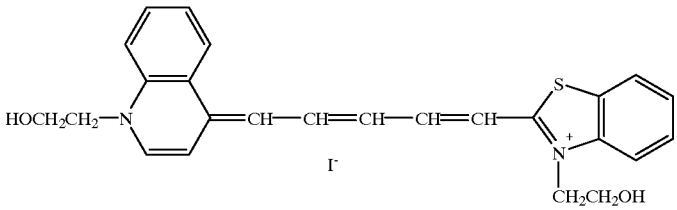

-continued

I-a-26

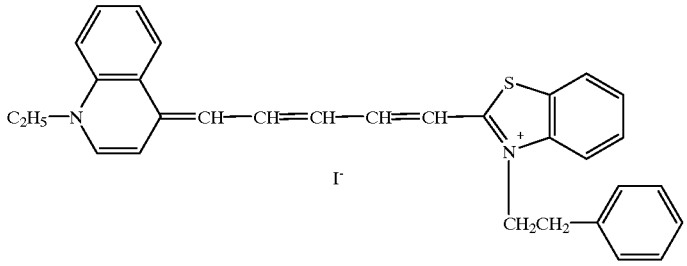

I-a-27

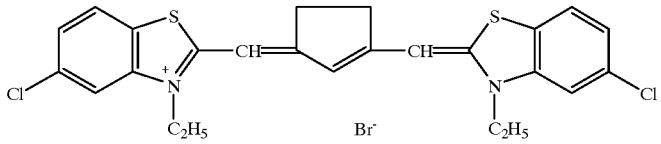

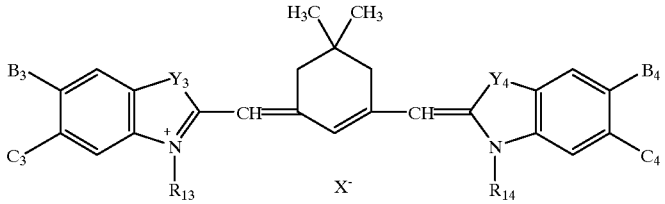

| Ex. No. No. | $Y_3$ | $Y_4$ | $B_3$ | $C_3$ | $B_4$ | $C_4$ | $R_{13}$ | $R_{14}$ | X |
|---|---|---|---|---|---|---|---|---|---|
| I-a-e-1 | S | S | H | Cl | H | Cl | $C_2H_5$ | $C_2H_5$ | Br |
| I-a-e-2 | S | S | $CH_3$ | Cl | H | Cl | $C_2H_5$ | $C_2H_5$ | Br |
| I-a-e-3 | S | S | $CH_3$ | H | $CH_3$ | H | $C_2H_5$ | $C_2H_5$ | I |
| I-a-e-4 | S | S | | H | | H | $C_2H_5$ | $(CH_2)_3SO_3^-$ | I |
| I-a-e-5 | S | S | $CH_3O$ | Cl | $CH_3O$ | Cl | $C_2H_5$ | $C_2H_5$ | I |
| I-a-e-6 | S | S | H | Cl | | H | $C_2H_5$ | $C_2H_4OH$ | Br |
| I-a-e-7 | S | S | H | COOH | H | COOH | $C_2H_5$ | $C_2H_5$ | Br |
| I-a-e-8 | S | S | H | Cl | H | Cl | $C_2H_5$ | $(CH_2)_3SO_3^-$ | — |
| I-a-e-9 | S | S | Cl | Cl | Cl | Cl | $C_2H_5$ | $C_2H_5$ | Br |
| I-a-e-10 | S | S | H | $CH_3O$ | H | $CH_3O$ | $C_2H_5$ | $C_2H_5$ | PTS* |
| I-a-e-11 | S | S | $CH_3O$ | $CH_3O$ | $CH_3O$ | $CH_3O$ | $C_2H_5$ | $C_2H_5$ | Br |
| I-a-e-12 | S | S | H | Br | H | Br | $C_2H_5$ | $C_2H_5$ | Br |
| I-a-e-13 | S | S | H | $CF_3$ | H | $CF_3$ | $C_2H_5$ | $C_2H_5$ | Br |
| I-a-e-14 | S | S | $CH_3$ | H | $CH_3$ | H | $C_2H_5$ | $C_5H_{11}$ | Br |
| I-a-e-15 | S | S | $OCH_3$ | H | H | H | $C_2H_5$ | $C_2H_5$ | Br |
| I-a-e-16 | S | S | $OCH_3$ | H | H | H | $C_2H_5$ | $C_5H_{11}$ | Br |
| I-a-e-17 | S | S | $CH_3$ | $CH_3$ | $CH_3$ | $CH_3$ | $C_2H_5$ | $C_2H_5$ | Br |
| I-a-e-18 | S | S | $C_3H_7$(i) | H | $C_3H_7$(i) | H | $C_2H_5$ | $C_2H_5$ | Br |
| I-a-e-19 | S | S | H | Cl | H | | $C_2H_5$ | $C_2H_5$ | Br |
| I-a-e-20 | S | S | $CH_3$ | H | $CH_3$ | H | $C_2H_5$ | $(CH_2)_3SO_3^-$ | — |
| I-a-e-21 | S | S | $CH_3$ | H | $CH_3$ | H | $(CH_2)_3SO_3H.N(C_2H_5)_3$ | $(CH_2)_3SO_3^-$ | — |
| I-a-e-22 | S | S | $CH_3O$ | H | $CH_3O$ | H | $C_2H_5$ | $(CH_2)_4SO_3^-$ | — |
| I-a-e-23 | S | S | $CH_3$ | H | $CH_3$ | H | $C_2H_5$ | $C_5H_{11}$ | Br |
| I-a-e-24 | Se | Se | H | Cl | H | Cl | $C_2H_5$ | $C_2H_5$ | Br |
| I-a-e-25 | Se | Se | $CH_3$ | H | $CH_3$ | H | $C_2H_5$ | $C_2H_5$ | Br |

-continued
| | | | | | | | | | |
|---|---|---|---|---|---|---|---|---|---|
| I-a-e-26 | S | S | H | | H | | $C_2H_5$ | $C_2H_5$ | I |
| I-a-e-27 | S | S | H | H | H | H | $C_2H_5$ | $C_2H_5$ | Br |
I-a-e-28
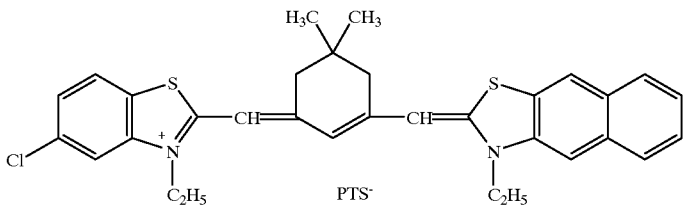
I-a-e-29
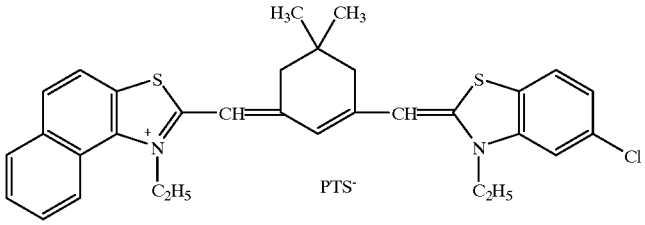
I-a-e-30
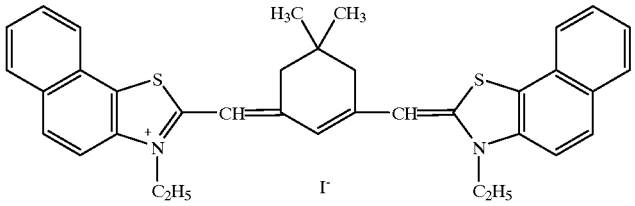
I-a-e-31
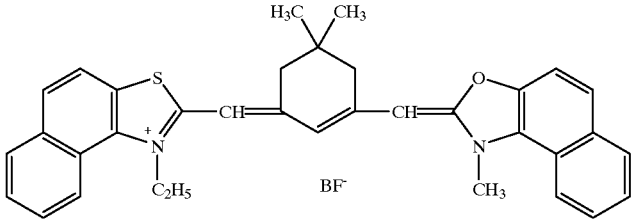
I-a-e-32
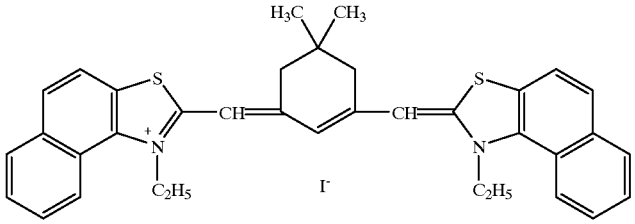
I-a-e-33
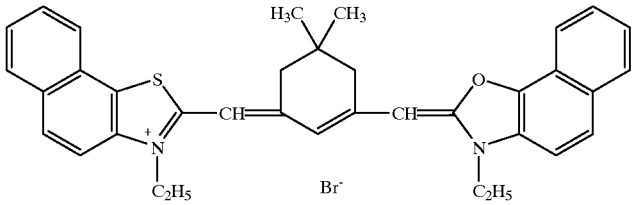

-continued
I-a-e-34
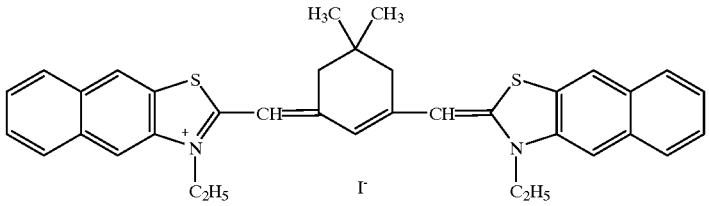
I-a-e-35
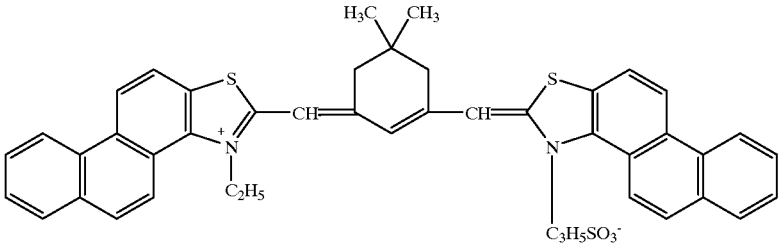
I-a-e-36
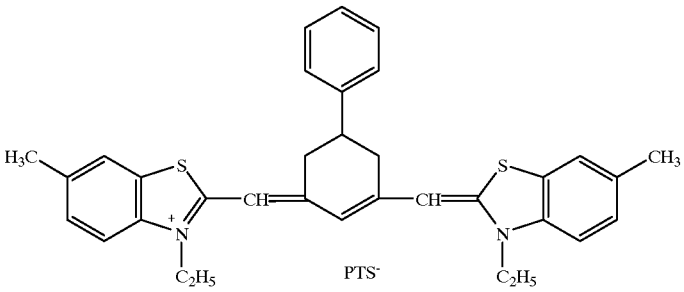
I-a-e-37
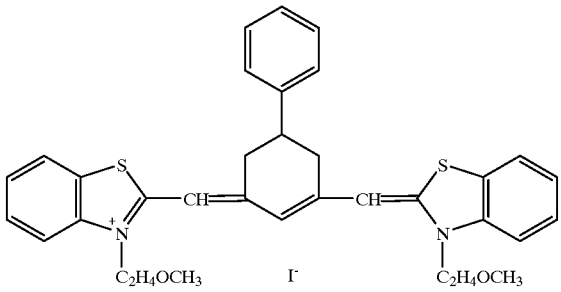
I-a-e-38
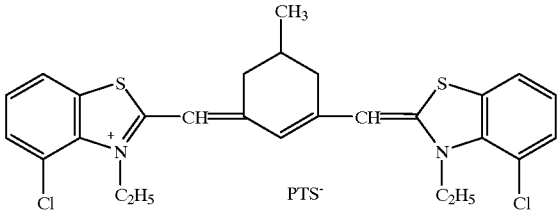

-continued
I-a-e-39
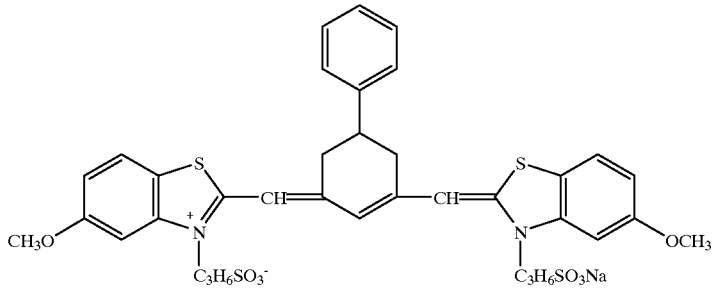
I-a-e-40
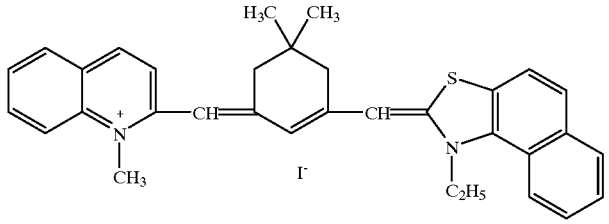
I-a-e-41
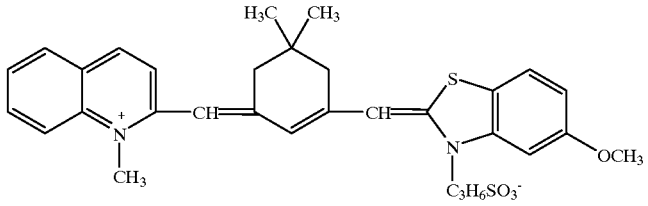
I-a-e-42
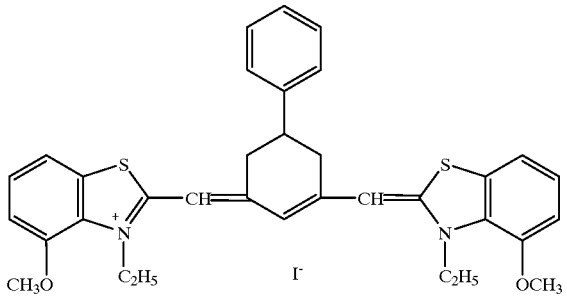
I-a-e-43
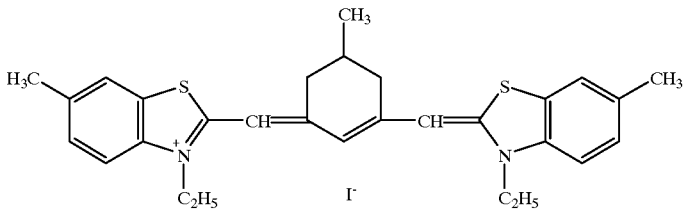

-continued
I-a-e-44
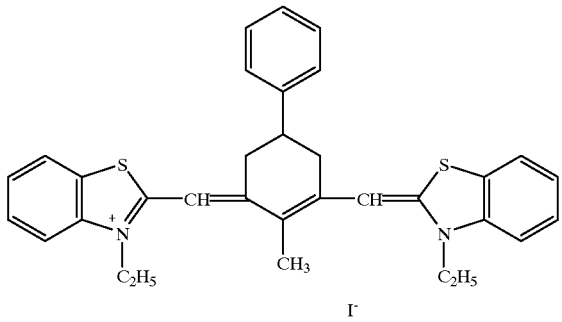
I-a-e-45
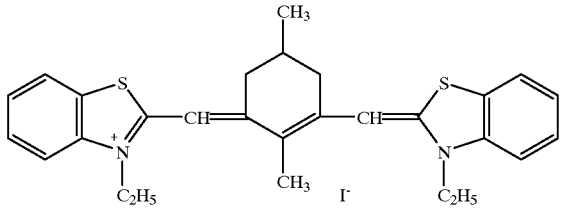
I-a-e-46
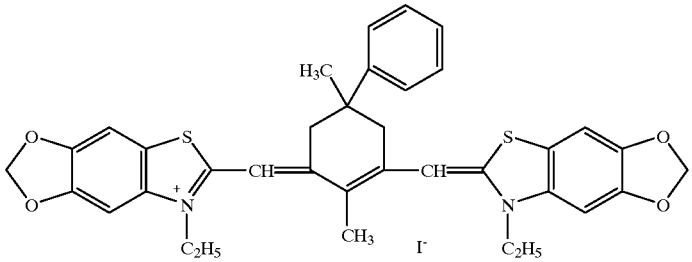
I-a-e-47
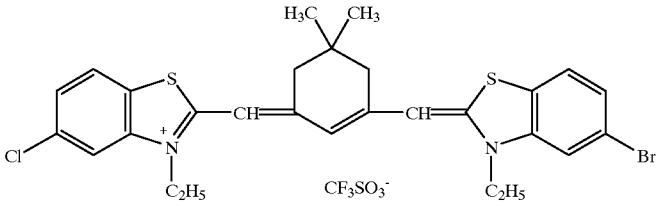
I-a-e-48
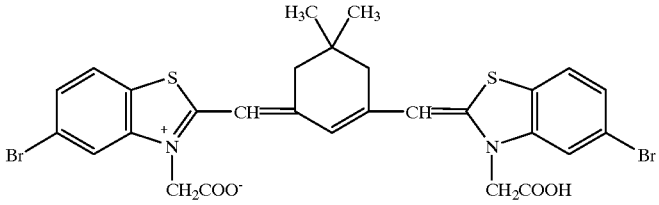
I-a-e-49
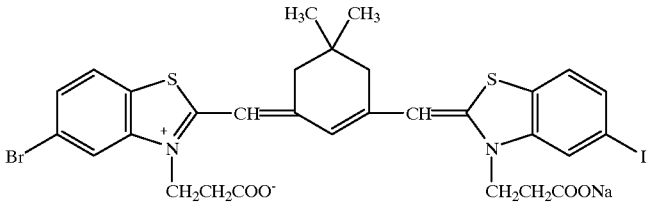

-continued
I-a-e-50
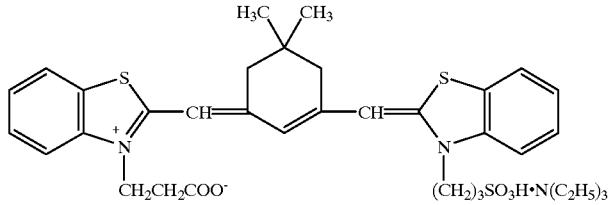
I-a-e-51
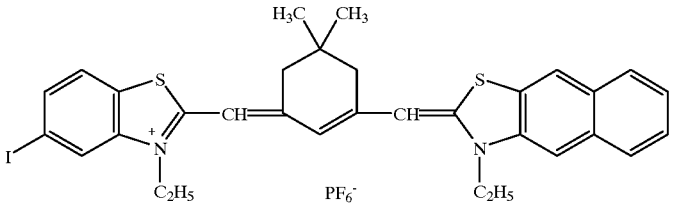
I-a-e-52
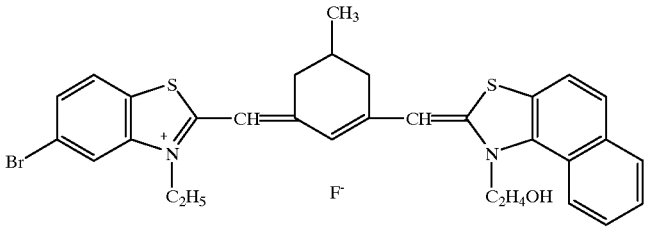
I-a-e-53
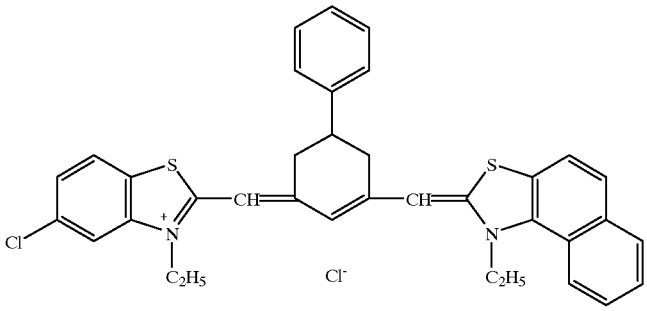
I-a-e-54
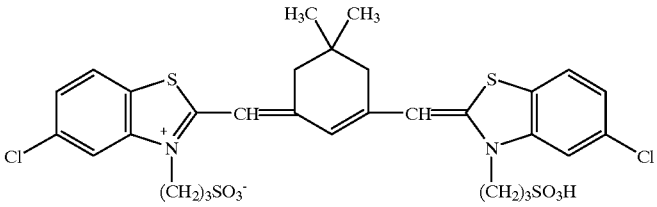
I-a-e-55
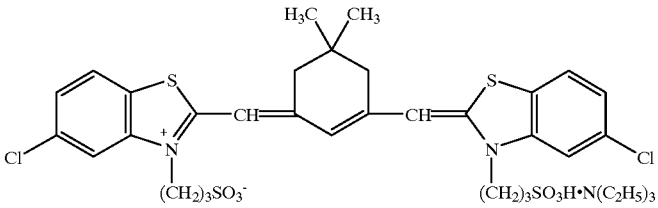

-continued
I-a-e-56
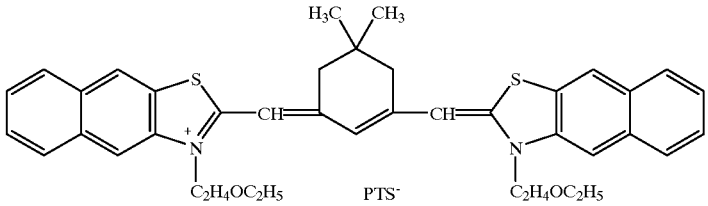
I-a-f-1
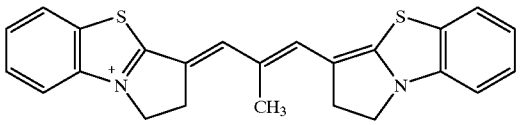
I-a-f-2
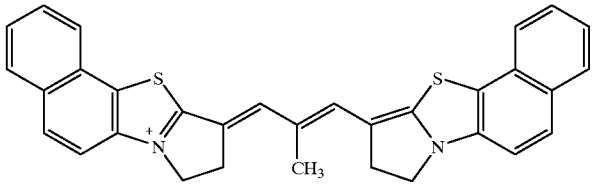
I-a-f-3
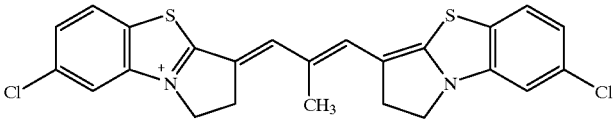
I-a-f-4
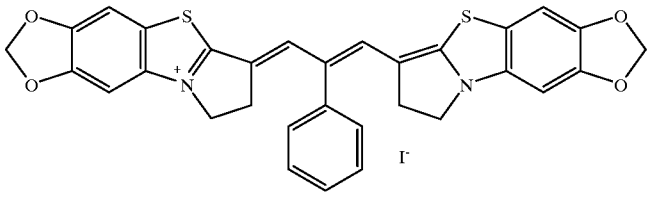
I-a-f-5
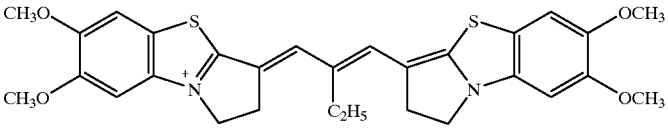
I-a-f-6
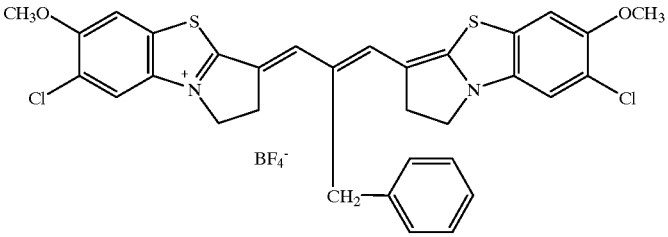

-continued
I-a-f-7
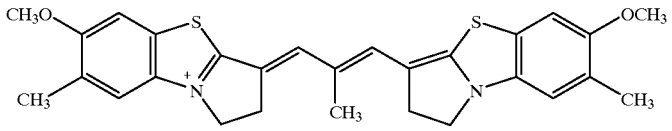
$Br^-$
I-a-f-8
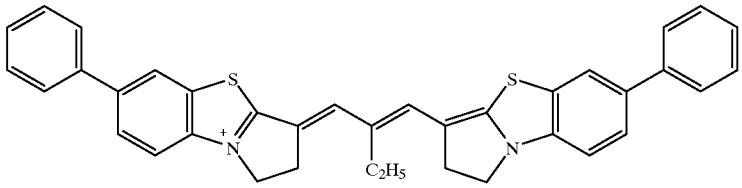
$Br^-$
I-a-f-9
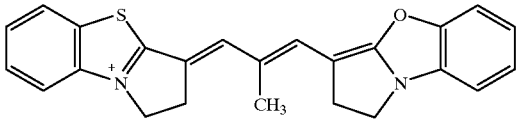
$Br^-$
I-a-f-10
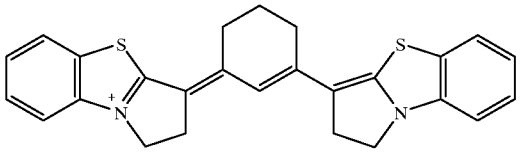
$I^-$
I-a-f-11
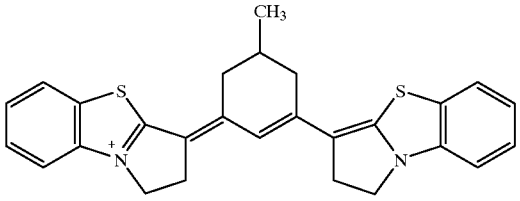
$Br^-$
I-a-f-12
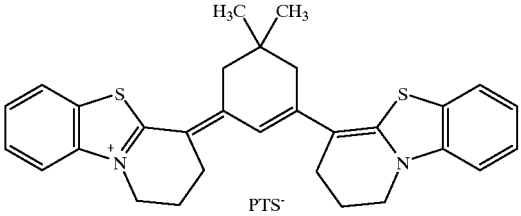
$PTS^-$
I-a-f-13
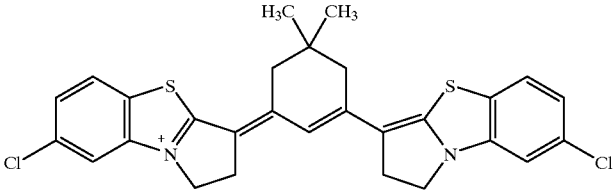
$Br^-$ -continued
I-a-f-14
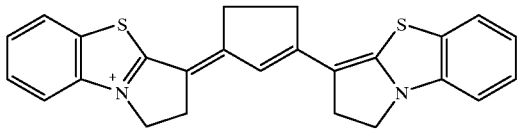
I-a-f-15
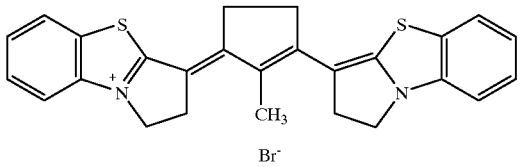
I-a-f-16
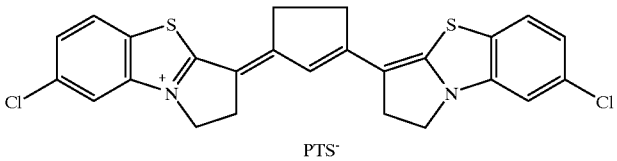
I-a-f-17
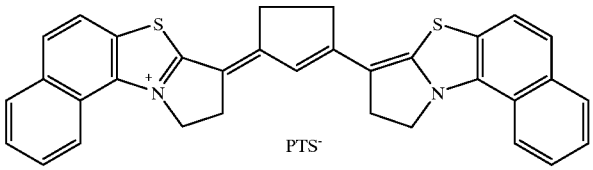
I-a-f-18
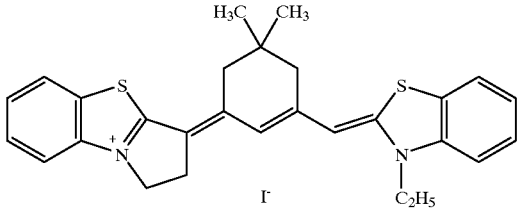
I-a-f-19
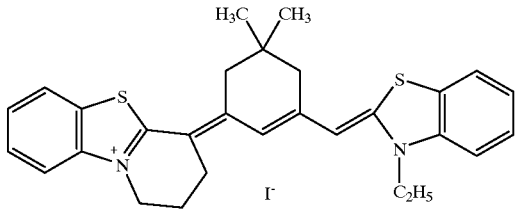
I-a-f-20
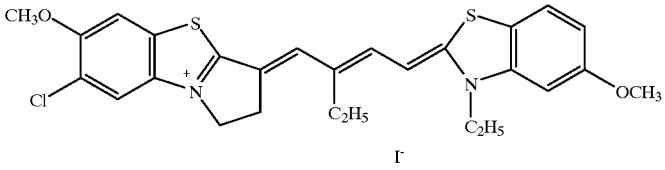
I-a-f-21
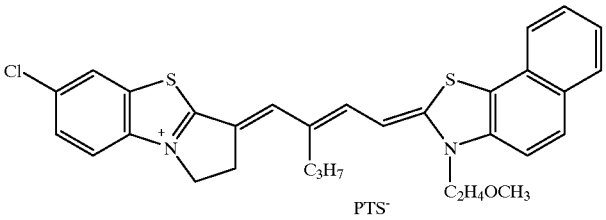

-continued
I-b-1
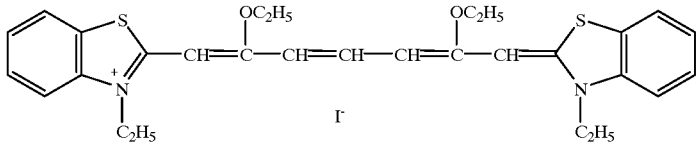
I-b-2
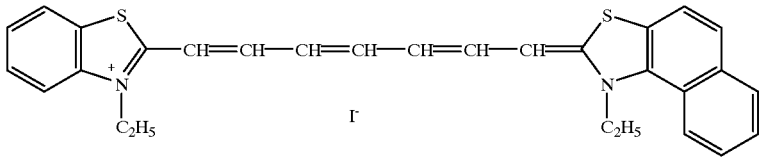
I-b-3
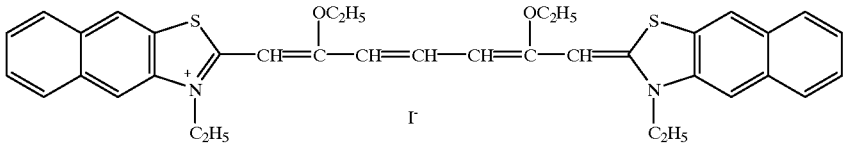
I-b-4
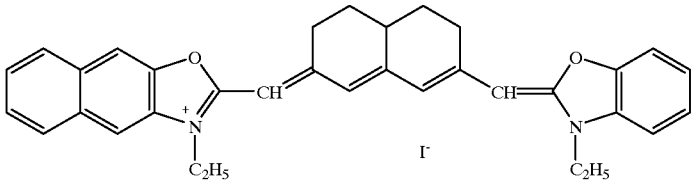
I-b-5
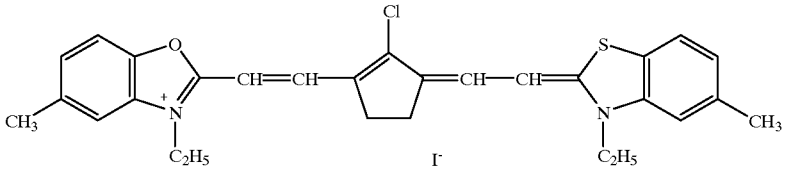
I-b-6
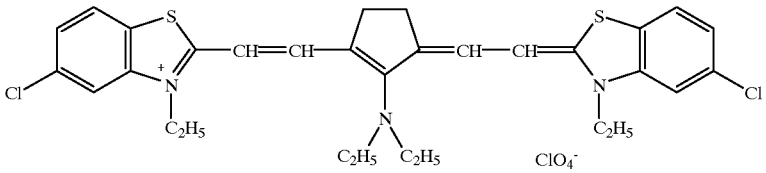
I-b-7
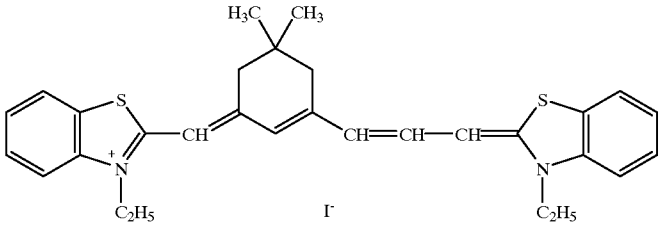
I-b-8
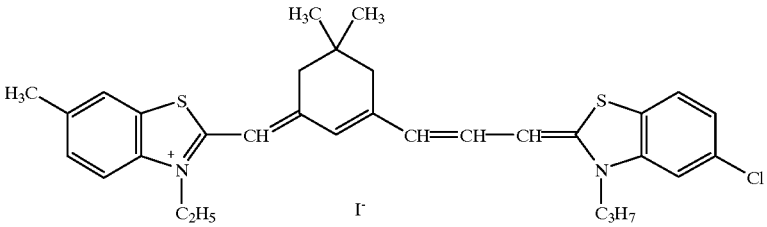

-continued
I-b-9
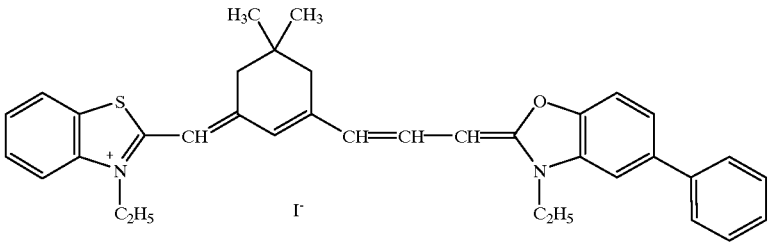
I-b-10
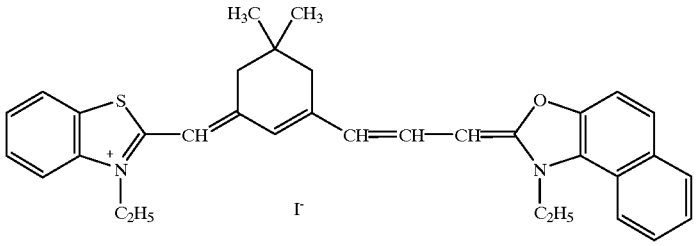
I-b-11
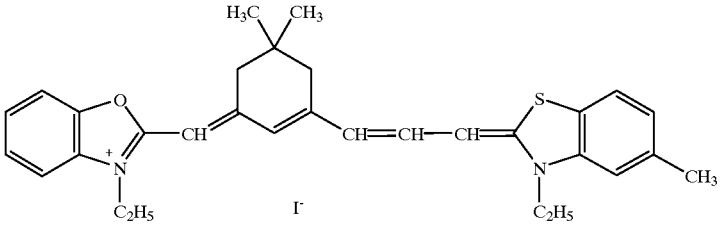
I-b-12
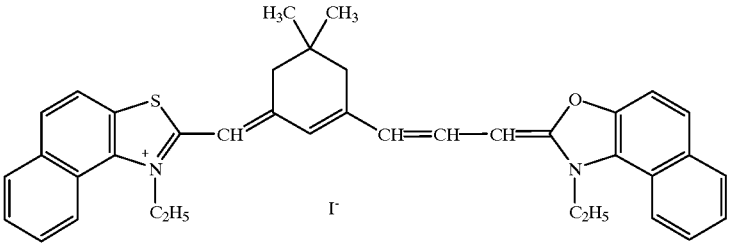
I-b-13
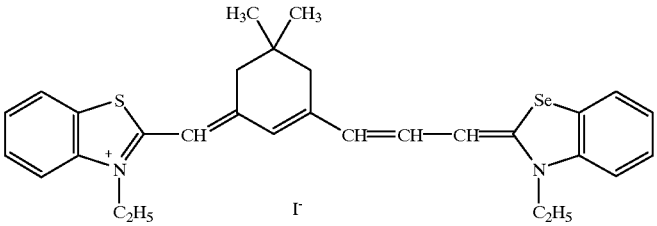
I-b-14
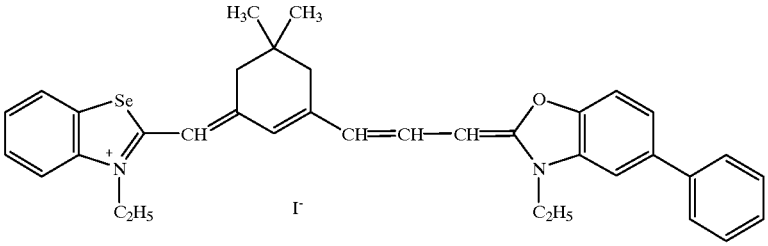

-continued
I-b-15
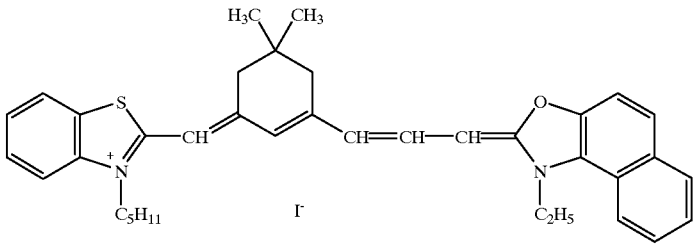
I-b-16
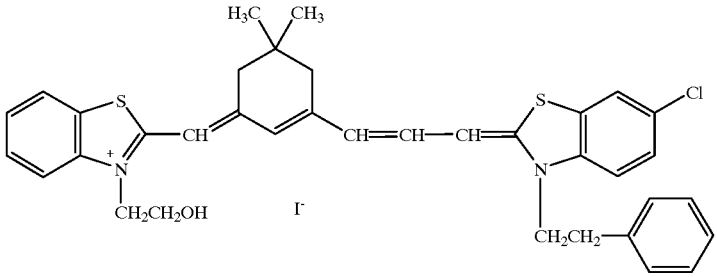
I-b-17
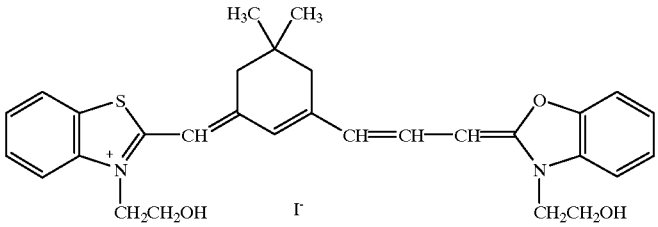
I-b-18
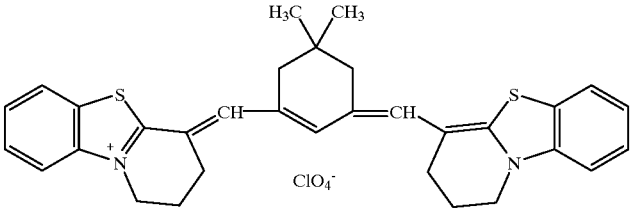
I-b-19
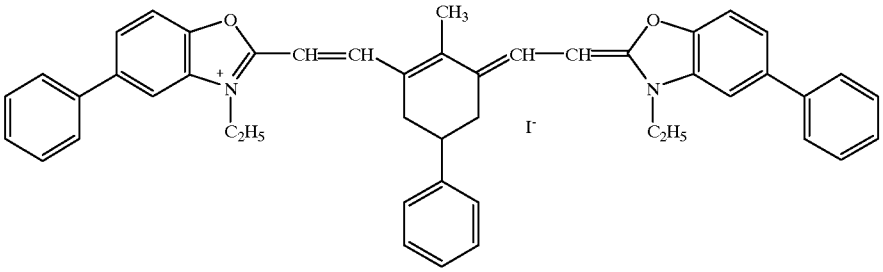
I-b-20
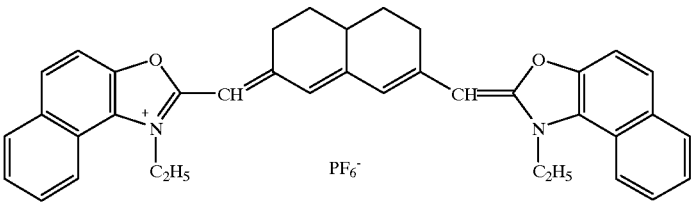

-continued

I-b-21

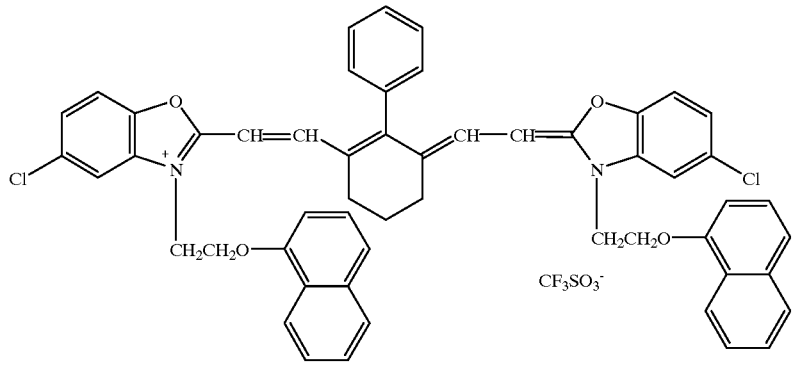

(*PTS: p-toluenesulfonic acid)

The color information recording, light sensitive layer (hereinafter, also denoted simply as a color image information recording layer) will now be described. A first embodiment of the color information recording layer is, similarly to the layer arrangement of conventional color photographic materials, the use of a group of light sensitive layers comprised of a blue-sensitive layer, a green-sensitive layer and a red-sensitive layer each containing a coupler capable of forming a dye different in hue with each other upon reaction with an oxidation product of a developing agent.

The color information recording layer used in the invention may be provided with a filter layer or an interlayer, as described in RD308119, sect. VII-K. The color information recording layer may have a layer arrangement such as conventional layer order, reverse order and unit constitution, as described in RD308119, sect. VII-K.

A preferred second embodiment of the color information recording layer is a constitution of stripe or mosaic color separation filter-arranging layer and a light sensitive layer having a sensitivity over the whole visible region, which are provided in this order from the side close to the photographic object. In this case, the color separation filter-arranging layer can have various constitutions to undergo color separation of information of the photographic object into primary colors of RGB. Examples thereof include a method in which yellow, green, magenta and cyan filters, yellow, green and cyan filters, or yellow, magenta and cyan filters are arranged in a mosaic pattern or a stripe form, and a method in which red, green and blue filters are arranged in a mosaic form or stripe form. The method of arranging filters in the mosaic form include, for example, a lattice-form arrangement, such as Bayer arrangement or coverage with triangles, hexagons or circles. Each color may be regularly arranged or arranged at random.

Color filters can be prepared according to various methods known in the art. Examples thereof include a pigment dispersion method in which a pigment-dispersing photosensitive resin layer is formed on the substrate and subjected to burning to obtain a mono-color pattern; a dying method in which an aqueous soluble polymer material is coated on the substrate, followed by patterning in a photolithography process to obtain an intended form and the obtained pattern is dipped in a dying bath to obtain a colored pattern; a printing method in which a pigment is dispersed in a thermosetting resin and printing is repeated three time to separately coat R, G and B, followed by thermally setting to form colored layers; and an ink-jet method in which coloring solutions containing a dye are respectively ejected on a transparent substrate by an ink-jet system and the coloring solutions are dried to form colored image portions. Color filter preparation by a random arrangement can be conducted according to the manner described in Japanese Patent Application No. 10-326017. Preparation of stripe-form color filters can be conducted according to the method described in Photo. Sci. & Eng., 21, 225 (1977).

The coated position of the luminance information recording layer will now be described. The luminance information recording layer is provide preferably at the position closer to the photographic object than the color information recording layer. Preferred examples thereof include an embodiment in which the color information recording layer and the luminance information recording layer are coated on a transparent support in this order and exposure is made from the side of the luminance information recording layer, an embodiment in which the luminance information recording layer and the color information recording layer are coated-on a transparent support in this order and exposure is made in a manner that the transparent support is opposed to the photographic object, an embodiment, in which the luminance information recording layer is coated on one side of a transparent support, the color information recording layer is coated on the other side of the support, and exposure is made from the side of the luminance information recording layer. Specifically, in cases where the color information recording layer is comprised of a stripe- or mosaic-formed color separation filter-arranging layer and a light sensitive layer having a sensitivity in the whole visible region in this order, it is preferred that the luminance information recording layer, a transparent support, the color filter-arranging layer and the light sensitive layer having a sensitivity in the whole visible region are arranged in this order from the side of a photographic object.

To read luminance information separately from images formed in the color information recording layer, images formed in the luminance information recording layer preferably have a different hue from the images formed in the color information recording layer. It is therefore preferred that the silver halide photographic material according to the invention has a luminance information recording layer and a color information recording layer which contain couplers forming dyes different in absorption pattern upon reaction with an oxidation product of a developing agent. In cases where the silver halide photographic material has a luminance information recording layer and a color information recording layer comprising a blue-sensitive layer, a green-sensitive layer and a red-sensitive layer, for example, it is preferred to contain four kinds of couplers forming dyes exhibiting different absorption patterns upon reaction with an oxidation product of a developing agent. Absorption patterns of the four kinds of couplers overlap with each other preferably to an extent as less as possible. To achieve this, a coupler forming a dye exhibiting an absorption in the infrared region (hereinafter, also referred to as an infrared coupler) can be employed in addition to yellow, magenta and cyan couplers commonly used in conventional silver halide color photographic materials.

As a coupler forming a dye exhibiting an infrared absorption upon reaction with an oxidation product of a developing agent are preferably employed compounds represented by the following formula (II) or (III):

Formula (II)

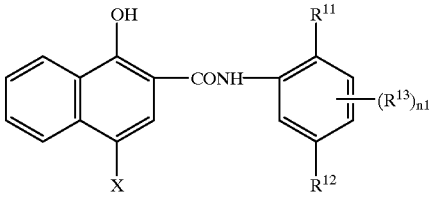

wherein R11 is an alkyl group, an alkoxy group, a phenoxy group or a halogen atom; R12 is an alkyl group, a phenyl group, an alkoxy group, an alkoxycarbonyl group, an aryloxycarbonyl group, carbamoyl group or a sulfamoyl group; R13 is a hydrogen atom or a substituent; N1 is an integer of 1, 2 or 3; and X is a group capable of being released upon reaction with an oxidation product of a color developing agent;

Formula (III)

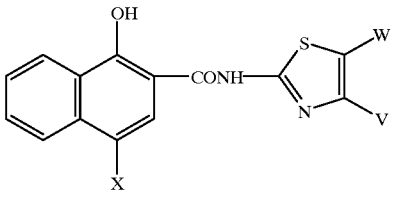

wherein V is an aryl group; W is an alkyl group, and X is a group capable of being released upon reaction with an oxidation product of a color developing agent.

In formulas (II) and (III), the alkyl group represented by R11, R12 and W include, for example, methyl, ethyl, propyl, isopropyl, n-butyl, tert-butyl, n-pentyl, cyclopentyl, n-hexyl, cyclohexyl, and n-dodecyl. The alkyl group may be substituted by a substituent. Examples of such a substituent include a halogen atom (e.g., chlorine atom, bromine atom, iodine atom, etc.), alkoxy group (e.g., methoxy, ethoxy, 1,1-dimethylethoxy, n-hexyloxy, n-dodecyloxy), aryloxy group (e.g., phenoxy, naphthyloxy, etc.), aryl group (e.g., phenyl, naphthyl, etc.), alkoxycarbonyl group (e.g., methoxycarbonyl, ethoxycarbonyl, n-butoxycarbonyl, 2-ethylhexylcarbonyl, etc.), aryloxycarbonyl group (e.g., phenoxycarbonyl, naphthyloxycarbonyl, etc.), alkenyl group (e.g., vinyl, allyl, etc.), heterocyclic group(e.g., 2-pyridyl, 3-pyridyl, 4-pyridyl, morphoryl, piperidyl, piperadyl, pyrimidyl, pyrazolyl, furyl, etc.), alkynyl group (e.g., propargyl, etc.), hydroxy, cyano, sulfo group, carboxy group, and sulfonamido group (e.g., methylsulfonylamino, ethylsulfonylamino, n-butylsulfonylamino, n-octylsulfonylamino, phenysulfonylamino, etc.).

Examples of an alkoxy group represented by $R^{11}$ and $R^{12}$ include methoxy, ethoxy, butoxy, octyloxy, dodecyloxy, isopropyloxy, butyloxy, and 2-ethylhexyloxy. The alkoxy group may be substituted by an alkyl group represented by $R^{11}$ and $R^{12}$ or such substituents as exemplified as those of the alkyl group.

Examples of an aryloxy group represented by $R^{11}$ include phenyloxy and naphthyloxy. The aryloxy group may be substituted by a substituent represented by $R^{13}$ described below. Examples of a halogen atom represented by R11 include chlorine atom, bromine atom and iodine atom. Examples of an alkoxycarbonyl group represented by $R^{12}$ include metoxycarbonyl, ethoxycarbonyl, isopropyloxycarbonyltbutyloxycarbonyl, 2-ethylhexyloxycarbonyl, and dodecyoxycarbonyl. The alkoxycarbonyl group may be substituted by an alkyl group represented by $R^{11}$ and $R^{12}$ or such substituents as exemplified as those of the alkyl group. Examples of an aryloxycarbonyl group represented by $R^{12}$ include phenyloxycarbonyl and naphthyloxycarbonyl. The aryloxycarbonyl group may be substituted by a substituent represented by $R^{13}$. Examples of a carbamoyl group include methylcarbamoyl, propylcarbamoyl, t-butylcarbamoyl, 2-ethylhexylcarbamoyl, pentadecylcarbamoyl, dibutylaminocarbonyl, and N-methyl-N-(2-ethylhexyl) aminocarbonyl. The carbamoyl group may be substituted by an alkyl group represented by $R^{11}$ and $R^{12}$ or such substituents as exemplified as those of the alkyl group. Examples of a sulphamoyl group include methylsulphamoyl, propylsulphamoyl, t-butylsulphamoyl, 2-ethylhexylsulphamoyl, pentadecylsulphamoyl, dibutylaminosulfonyl, and N-methyl-N-(2-ethylhexyl) aminosulfonyl. The sulphamoyl group may be substituted by an alkyl group represented by $R^{11}$ and $R^{12}$ or such substituents as exemplified as those of the alkyl group.

Examples of an aryl group represented by V and R12 include phenyl and naphthyl. The aryl group may be substituted by a substituent represented by $R^{13}$.

The substituent represented by $R^{13}$ include, for example, an alkyl group (e.g., methyl, ethyl, propyl, isopropyl, tert-butyl, n-pentyl, cyclopentyl, hexyl, cyclohexyl, n-octyl, n-dodecyl, etc.), alkenyl group (e.g., vinyl, allyl, etc.), alkynyl group (e.g., propargyl, etc.), aryl group (e.g., phenyl, naphthyl, etc.), heterocyclic group (e.g., pyridyl, thiazolyl, oxazolyl, imidazolyl, furyl, pyrrolyl, pyrazinyl, pyrimidinyl, pyrydanyl, selenazolyl, sulforanyl, piperidynyl, pyrazolyl, tetrazolyl, etc.), halogen atom (e.g., chlorine atom, bromine atom, iodine atom, etc.), alkoxy group (e.g., methoxy, ethoxy, propyloxy, n-pentyloxy, cyclopentyloxy, n-hexyloxy, cyclohexyloxy, n-octyloxy, n-dodecyoxy, etc.), aryloxy group (e.g., phenoxy, naphthyloxy, etc.), alkoxycarbonyl group (e.g.,methyloxycarbonyl, ethyloxycarbonyl, n-butyloxycarbonyl, n-octyloxycarbonyl, n-dodecyloxycarbonyl, etc.), aryloxycarbonyl (e.g., phenyloxycarbonyl, naphthyloxycarbonyl, etc.), sulfonamido group (e.g., methylsulfonylamino, ethylsulfonylamino, n-butylsulfonylamino, n-hexylsulfonylamino, cyclohexylsulfonylamino, n-octylsulfonylamino, n-dodecylsulfonylamino, phenylsulfonylamino, etc.), sulfamoyl group (e.g., aminosulfonyl, methylaminosulfonyl, dimethylaminosulfonyl, n-butylaminosulfonyl, n-hexylaminosulfonyl,cyclohexylaminosulfonyl, n-octylaminosulfonyl, n-dodecyaminosufonyl, phenylaminosulfonyl, phenylaminosulfonyl, naphthylaminosulfonyl, 2-pyridylaminosulfonyl, etc.), ureido group (e.g., methylureido, ethylureido, pentylureido, cyclohexylureido, n-octylureido, n-dodecylureido, phenylureido, naphthylureido, 2-pyridylaminoureido, etc.), acyl group (e.g., acetyl, ethylcarbonyl, propylcarbonyl, n-pentylcarbonyl, cyclohexylcarbonyl, n-octylcarbonyl, 2-ethylhexylcarbonyl, n-dodecylcarbonyl, phenylcarbonyl, naphthylcarbonyl, pyridylcarbonyl, etc.), carbamoyl group (e.g., aminocarbonyl, methylaminocarbonyl, dimethylaminocarbonyl, propylaminocarbonyl, n-pentylaminocarbonyl, cyclohexylaminocarbonyl, n-octylaminocarbonyl, 2-ethylhexylaminocarbonyl, n-dodecylaminocarbonyl, phenylaminocarbonyl, naphthylaminocarbonyl, 2-pyridylaminocarbonyl, etc.), amido group (e.g., acetoamido, ethylcarbonylamino, propylaminocarbonyl, n-pentylcarbonylamino, cyclohexylcarbonylamino, 2-ethylhexylcarbonylamino, n-octylcarbonylamino, dodecylcarbonylamino, benzoylamino, naphthylcarbonylamino, etc.), sulfonyl group (e.g., methlsulfonyl, ethylsufonyl, n-butylsulfonyl, cyclohexysulfonyl, 2-ethylhexylsulfonyl, dodecysulfonyl, phenylsulfonyl, naphthylsulfonyl, 2-pyridylsulfonyl, etc.), amino group (e.g., amino, ethylamino, dimethylamino, n-butylamino, cyclopentylamino, 2-ethylhexylamino, n-dodecyamino, anilino, naphthylamino, 2-pyridylamino, etc.), cyano, nitro, carboxy group and hydroxy. These groups may be substituted by an alkyl group represented by $R^{11}$ and $R^{12}$ or such substituents as exemplified as those of the alkyl group.

X is a a hydrogen atom or a group capable of being released upon reaction with an oxidation product of a color developing agent. Examples thereof include a halogen atom, a univalent group such as an alkoxy group, an aryloxy group, a heterocyclic-oxy group, an acylthio group, alkylthio group, arylthio group, a heterocyclic-thio group, or

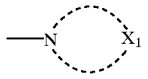

in which $X_1$ is an atom group necessary to form a 5- or 6-membered ring together with a nitrogen atom and at least one selected from the group of a carbon atom, oxygen atom, nitrogen atom and sulfur atom, acylamino group and sulfonamido group, and a bivalent group such as an alkylene group. In the case of a bivalent group, a dimmer is formed with X.

Exemplary examples of X are shown below, but are not limited to these.

Halogen atom: chlorine, bromine, iodine

Alkoxy group:

$—OC_2H_5$, $—OCH_2CONHCH_2CH_2OCH_3$, $—OCH_2COOCH_3$

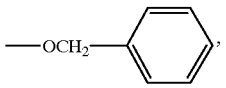

$—OCH_2CH_2SO_2CH_3$,

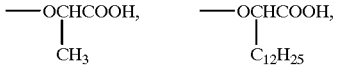

$—OCH_2CH_2OH$, $—OCH_2CH_2SCH_2COOH$,

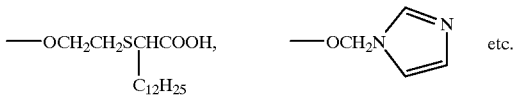

Aryloxy group:

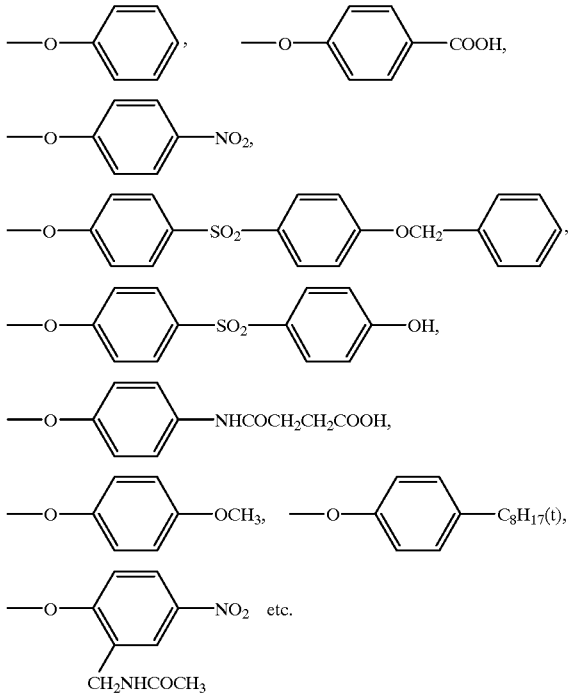

Heterocyclic-oxy group:

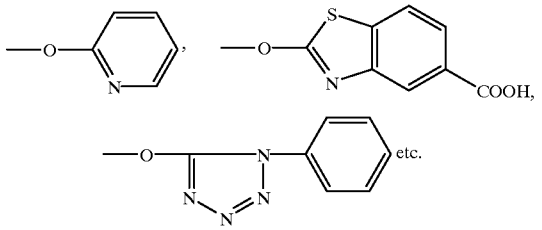

Acyloxy group:

$—OCOCH_3$,

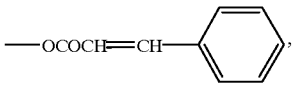

$—OCOC_4H_9$,

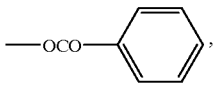

$—OCOCH_2CH_2COOH$ etc.

Alkylthio group:
—$SCH_3$, —$SC_2H_5$, —$SC_8H_{17}$, —$SC_{12}H_{25}$,
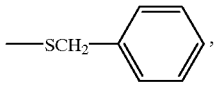
—$SCH_2CH_2N(C_2H_5)_2$, —$SCH_2CH_2COOH$, —$SCH_2COOC_2H_5$, —$SCH_2CH_2OC_2H_5$,
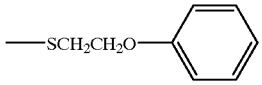
etc.
Arylthio group:
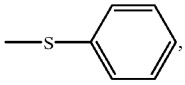
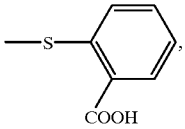
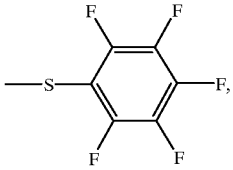
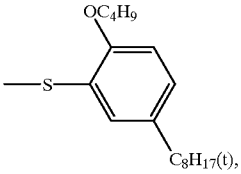
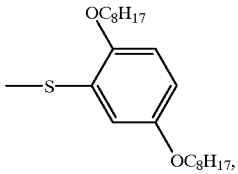
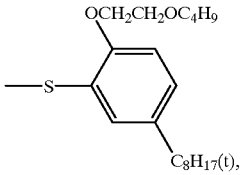
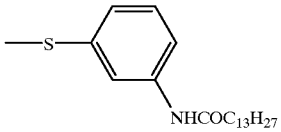
etc.
Heterocyclic-thio group:
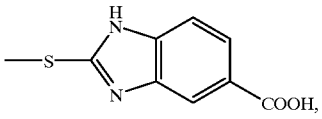
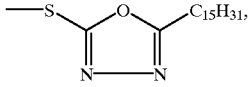
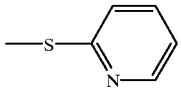
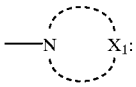
etc.
pyrazolyl, imidazolyl, triazolyl, or tetrazolyl group
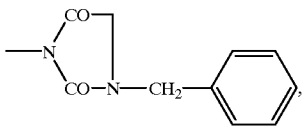
-continued
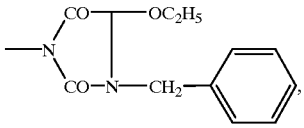
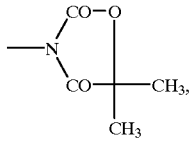
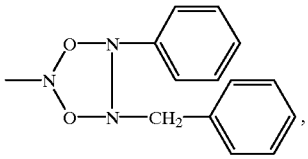
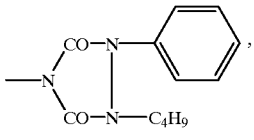
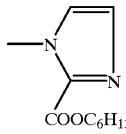
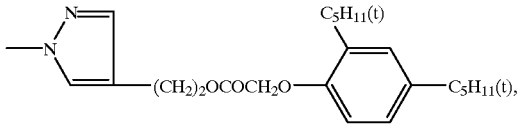
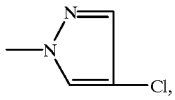
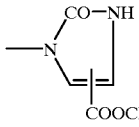
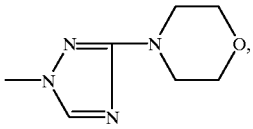
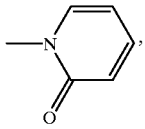
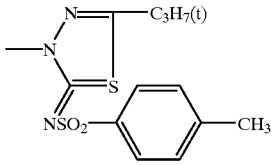
etc.
Acylamino group:
—$NHCOCF_3$,
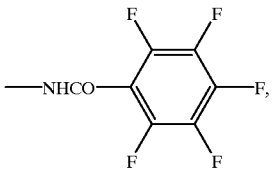
—$NHCO(CF_2CF_2)_2H$,
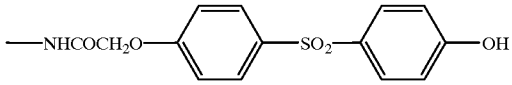
etc.

Sulfonamido group:
—$NHSO_2CH_3$,
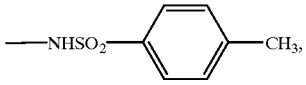
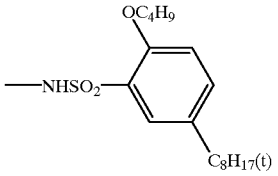
etc.
Alkylene group:
—$CH_2$—,
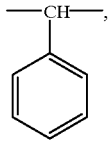
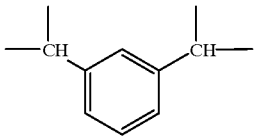
etc.
Exemplary examples od infrared couplers represented by formula (II) or (III), usable in the invention are shown below, but ate mot limited ti these.
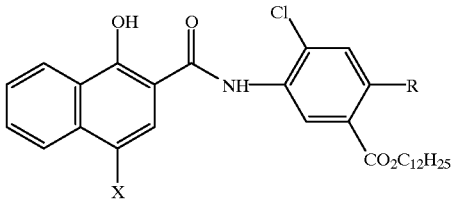
| No. | R | X |
|---|---|---|
| II-1 | H | H |
| II-2 | Br | H |
| II-3 | Br | Cl |
| II-4 | Br | —$OCH_2COOCH_3$ |
| II-5 | Br | —$OCH_2CH_2SCH_2COOH$ |
| II-6 | Br | 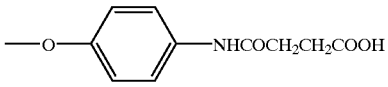 |
| II-7 | Cl | H |
| II-8 | Cl | Cl |
| II-9 | Cl | 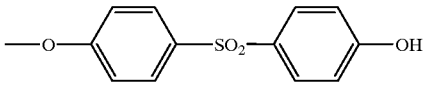 |
| II-10 | Cl | —$SCH_2CH_2OC_2H_5$ |
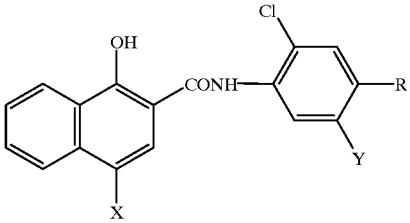
| No. | Y | R | X |
|---|---|---|---|
| II-11 | $CO_2$—$CH(CH_3)CO_2C_{12}H_{25}$ | H | Cl |

-continued
| | | | |
|---|---|---|---|
| II-12 | $CO_2-CH(CH_3)CO_2C_{12}H_{25}$ | Br | Br |
| II-13 | $CO_2-CH(CH_3)CO_2C_{12}H_{25}$ | Br | Cl |
| II-14 | $CO_2-CH(CH_3)CO_2C_{12}H_{25}$ | Br | Br |
| II-15 | $CO_2-CH(CH_3)CO_2C_{12}H_{25}$ | Br | $-OCH(CH_3)COOH$ |
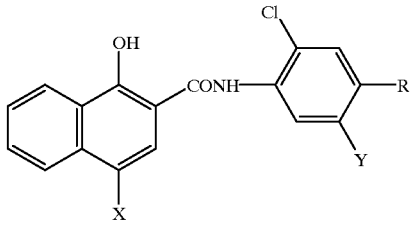
| No. | Y | R | X |
|---|---|---|---|
| II-16 | $CO_2-CH(CH_3)CO_2C_{12}H_{25}$ | Br | $-O-C_6H_4-NHCOCH_2CH_2COOH$ |
| II-17 | $CONHC_8H_{17}(t)$ | Br | $-O-C_6H_4-NHCOCH_2CH_2COOH$ |
| II-18 | $CONH(CH_2)_4O-C_6H_3(C_5H_{11}(t))-C_5H_{11}(t)$ | Br | $-O-C_6H_4-NHCOCH_2CH_2COOH$ |
| II-19 | $SO_2NHC_{16}H_{33}$ | Br | $-O-C_6H_4-NHCOCH_2CH_2COOH$ |
| II-20 | $CO_2-C_6H_4-OC_{12}H_{25}$ | Br | $-O-C_6H_4-NHCOCH_2CH_2COOH$ |
| II-21 | | | |
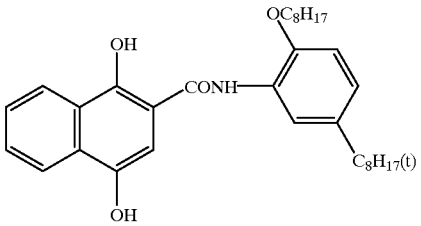

-continued
II-22
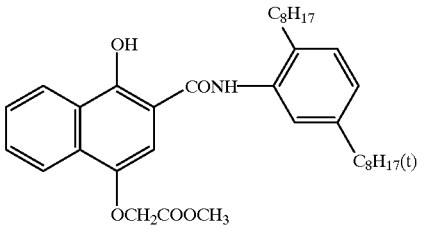
II-23
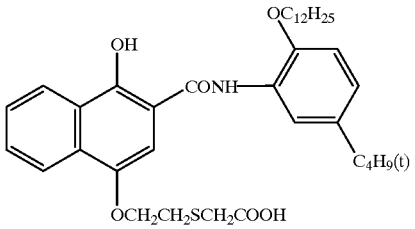
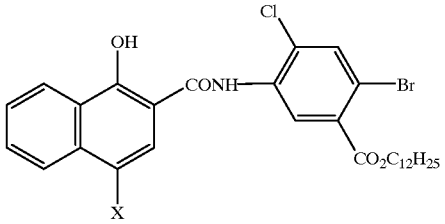
| No. | X |
|---|---|
| II-24 | —Cl |
| II-25 | —O— 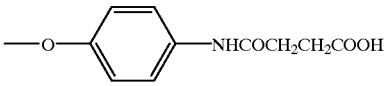 |
| II-26 | —OCH(CH$_3$)COOH |
| II-27 | —OCH($C_{12}H_{25}$)COOH |
| II-28 | —O— 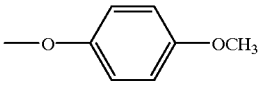 |
| II-29 | —$SCH_2CH_2COOH$ |
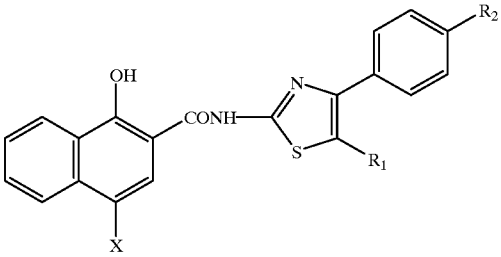
| No. | $R_1$ | $R_2$ | X |
|---|---|---|---|
| III-1 | $CH_3$ | $OCH_3$ | H |
| III-2 | $CH_3$ | $OCH_3$ | —$OCH_2COOCH_3$ |

-continued

| | | | |
|---|---|---|---|
| III-3 | $C_{14}H_{29}$ | H | —OCHCOOH<br>\|<br>$CH_3$ |
| III-4 | $C_{14}H_{29}$ | $OCH_3$ | —OCHCOOH<br>\|<br>$C_{12}H_{25}$ |
| III-5 | $C_{14}H_{29}$ | $OCH_3$ | —O—$C_6H_4$—$NHCOCH_2CH_2COOH$ |
| III-6 | $C_{14}H_{29}$ | $OCH_3$ | $—OCH_2CH_2SCH_2COOH$ |
| III-7 | $C_{12}H_{25}$ | H | —O—$C_6H_4$—$OCH_3$ |

In cases where the color information recording layer comprises a stripe or mosaic color separation filter-arranging layer and a light sensitive layer having a sensitivity in the overall visible region, one preferred embodiment of the invention is that a luminance information recording layer forms an infrared absorbing image by use of the infrared couplers described above and the light sensitive layer having sensitivity in the overall visible region of the color information recording layer forms an image shielding the overall visible region. The image shielding the overall visible region is not specifically limited with respect to its means, so long as it essentially has a function of forming a black image. For example, there may be employed black silver images formed on development, or a substantially black image may be formed using plural couplers forming a dye upon reaction with an oxidized developing agent. Specifically, a method of forming a substantially black image by use of a mixture of yellow, magenta and cyan couplers enable to obtain a black image exhibiting no absorption in the infrared region, preferably lessening interference with luminance information, caused by the infrared coupler.

In the red-sensitive, green-sensitive and blue-sensitive silver halide emulsion layers which each contain a coupler, a dye formed from any one of the couplers contained preferably exhibits an absorption maximum of at least 20 nm apart from the absorption maxima of couplers contained in the other emulsion layers. The use of a yellow coupler, a magenta coupler and a cyan coupler id preferred. The combination of a coupler and an emulsion layer is not necessarily limited to combinations of a yellow coupler and a blue-sensitive layer, a magenta coupler and a green-sensitive layer, and a cyan coupler and a red-sensitive layer, but other combinations may be feasible.

Exemplary examples of DIR compounds usable in the invention include compounds D-1 through D-34 described in JP-A 4-114153 and these compounds are preferably employed in the invention. Further, examples of diffusible DIR compounds include those described in U.S. Pat. Nos. 4,234,678, 3,227,554, 3,647,291, 3,958,993, 4,419,886 and 3,933,500; JP-A 57-56837, 51-13239; U.S. Pat. Nos. 2,072, 363 and 2,070,266; Research Disclosure, December, 1981, item 21228.

Silver halide emulsions usable in the invention include those described in Research Disclosure No.308119 (hereinafter, simply denoted as RD308119).

| Item | RD 308119 |
|---|---|
| Iodide | 993, I-A |
| Preparing method | 993, I-A; 994, I-E |
| Crystal habit (regular crystal) | 993, I-A |
| Crystal habit (twinned crystal) | 993, I-A |
| Epitaxial | 993, I-A |
| Halide composition (uniform) | 993, I-B |
| Halide composition (non-uniform) | 993, I-B |
| Halide conversion | 994, I-C |
| Halide substitution | 994, I-C |
| Metal occlusion | 994, I-D |
| Grain size distribution | 995, I-F |
| Solvent addition | 995, I-F |
| Latent image forming site (surface) | 995, I-G |
| Latent image forming site (internal) | 995, I-G |
| Photographic material (negative) | 995, I-H |
| Photographic material (positive) | 995, I-H |
| Emulsion blending | 995, I-J |
| Desalting | 995, II-A |

The silver halide emulsion according to the invention is subjected to physical ripening, chemical ripening and spectral sensitization. As additives used in these processes are shown compounds described in Research Disclosure No. 17643, No. 18716 and No. 308119 (hereinafter, denoted as RD 17643, RD 18716 and RD 308119), as below.

| Item | RD 308119 | RD 17643 | RD 18716 |
|---|---|---|---|
| Chemical Sensitizer | 996, III-A | 23 | 648 |
| Spectral Sensitizer | 996, IV-A-A,B,C, D,H,I,J | 23–24 | 648–9 |
| Super Sensitizer | 996, IV-A-E,J | 23–24 | 648–9 |
| Antifoggant | 998, VI | 24–25 | 649 |
| Stabilizer | 998, VI | 24–25 | 649 |

Photographic additives usable in the invention are also described, as below.

| Item | RD 308119 | RD 17643 | RD 18716 |
|---|---|---|---|
| Anti-staining agent | 1002, VII-I | 25 | 650 |
| Dye Image-Stabilizer | 1001, VII-J | 25 | |
| Whitening Agent | 998, V | 24 | |
| U.V. Absorbent | 1003, VIII-I, XIII-C | 25–26 | |
| Light Absorbent | 1003, VIII | 25–26 | |
| Light-Scattering Agent | 1003 ,VIII | | |
| Filter Dye | 1003, VIII | 25–26 | |
| Binder | 1003, IX | 26 | 651 |
| Antistatic Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant, Coating aid | 1005, XI | 26–27 | 650 |
| Matting Agent | 1007, XVI | | |
| Developing Agent (included in photographic material) | 1001, XXB | | |

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | 25, VII-C~G |
| Magenta coupler | 1001, VII-D | 25, VII-C~G |
| Cyan coupler | 1001, VII-D | 25, VII-C~G |
| Colored coupler | 1002, VII-G | 25, VII-G |
| DIR coupler | 1001, VII-F | 25, VII-F |
| BAR coupler | 1002, VII-F | |
| PUG releasing coupler | 1001, VII-F | |
| Alkali-soluble coupler | 1001, VII-E | |

Additives used in the invention can be added by dispersing methods described in RD 308119 XIV. In the invention are employed supports described in RD 17643, page 28; RD 18716, page 647–648; and RD 308119 XIX. In the photographic material according to the invention, there can be provided auxiliary layers such as a filter layer and interlayer, as described in RD 308119 VII-K, and arranged a variety of layer orders such as normal layer order, reverse layer order and unit layer arrangement.

Silver halide photographic light sensitive materials used in the invention can be processed by use of commonly known developing agents described in T. H. James, The Theory of the Photographic Process, Fourth edition, page 291 to 334; and Journal of American Chemical Society, 73, 3100 (1951), and according the conventional method described in RD17643, pages 28–29, RD18716, page 615 and RD308119, XIX.

Silver halide color photographic materials used in the invention may include a developing agent in advance, thereby leading to simplification of processing. In the invention, an image forming method is preferably employed such that after being exposed, the photographic material including a developing agent is laminated to a processing material containing a complex-forming compound capable of generating a base upon formation of a complex with a sparing soluble metal salt compound and then heated to form images.

Silver halide color photographic materials used in the invention preferably include a developing agent represented by the following formulas (1) through (5), thereby leading to simplification of processing.

Formula (1)

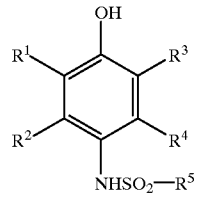

Formula (2)

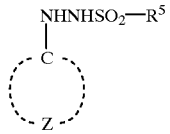

Formula (3)

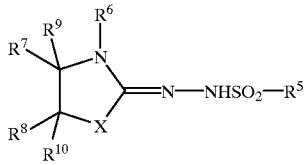

Formula (4)

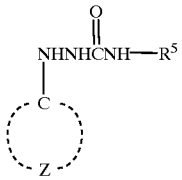

Formula (5)

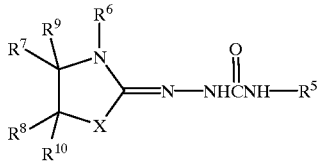

where $R^1$ to R4 each represent a hydrogen atom; alkyl group, aryl group, alkylcarbonamido group, arylcarbonamido group, alkylsulfonamido group, arylsulfonamido group, alkoxy group, aryloxy group, alkylthio group, arylthio group, alkylcarbamoyl group, arylcarbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group, and acyloxy group; $R^5$ represents a substituted or unsubstituted alkyl group, aryl group, or heterocyclic group; $R^6$ represents a substituted or unsubstituted alkyl group; X represents an oxygen atom, sulfur atom, selenium atom, or tertiary nitrogen atom substituted by an alkyl or aryl group; $R^7$, $R^8$, $R^9$ and $R^{10}$ each represent a hydrogen atom or a substituent, provided that $R^7$, $R^8$, $R^9$ and $R^{10}$ may combine with each other to form a double bond or a ring; Z represents an atomic group necessary to form an aromatic ring.

The compounds represented by formulas (1), (2), (3), (4) and (5) will be further described.

In formula (1), $R^1$ to R4 each represent a hydrogen atom, alkyl group, aryl group, alkylcarbonamido group, arylcarbonamido group, alkylsulfonamido group, arylsulfonamido group, alkoxy group, aryloxy group, alkylthio group, arylthio group, alkylcarbamoyl group, arylcarbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group, and acyloxy group. Of $R^1$ to $R^4$, $R^2$ and $R^4$ each are preferably a hydrogen atom. $R^5$ is an alkyl group, an aryl group or a heterocyclic group.

In formula (2), Z is an atomic group necessary to form an aromatic ring. $R^5$ is an alkyl group, an aryl group or a heterocyclic group.

In formula (3), $R^5$ is an alkyl group, an aryl group or a heterocyclic group. $R^6$ is an alkyl group. X is an oxygen atom, a sulfur atom, selenium atom, or an alkyl- or aryl-substituted tertiary nitrogen atom. $R^7$, $R^8$, $R^9$ and $R^{10}$ are each a hydrogen atom or a substituent, or $R^7$, $R^8$, $R^9$ and $R^{10}$ may combine together with each other to form a double bond or a ring.

In formula (4), Z is an atomic group necessary to form an aromatic ring and $R^5$ is an alkyl group, an aryl group or a heterocyclic group.

In formula (5), $R^5$ is an alkyl group, an aryl group or a heterocyclic group. R6 is an alkyl group. X is an oxygen atom, a sulfur atom, selenium atom, or an alkyl- or aryl-substituted tertiary nitrogen atom. $R^7$ , $R^8$, $R^9$ and $R^{10}$ are each a hydrogen atom or a substituent, or $R^7$, $R^8$, $R^9$ and $R^{10}$ may combine together with each other to form a double bond or a ring.

The compounds represented by formulas (1), (2), (3), (4) and (5) are color developing agents, which are included in the photographic material. This compound itself is oxidized by developing a silver salt, an oxidation product of which couples with a coupler to form a dye. Of these scompounds, the compound represented by formula (1) or (4) is preferred.

The compound represented by formula (1) is generally called a sulfonamidophenol compound, in which $R^1$ to $R^4$ each represent a hydrogen atom, halogen atom (e.g., chlorine, bromine), alkyl group (e.g., methyl, ethyl, isopropyl, n-butyl, t-butyl), aryl group (e.g., phenyl, tolyl, xylyl), alkylcarbonamido group (e.g., acetylamino, propionylamino, butyloylamino), arylcarbonamido group (e.g., benzoylamino), alkylsulfonamido group (e.g., methanesulfonylamino, ethanesulfonylamino), arylsulfonamido group (e.g., benzenesulfonylamino, toluenesulfonylamino), alkoxy group (e.g., methoxy, ethyl, butoxy), aryloxy group (e.g., pheoxy), alkylthio group (e.g., methylthio, ethylthio, butykthio), arylthio group (e.g., phenylthio, tolylthio), alkylcarbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl (e.g., phenylcarbamoyl), methylphenylcarbamoyl, ethylphenylcarbamoyl, benzylphenylcarbamoyl), carbamoyl group, alkylsulfamoyl group (e.g.,methylsulfamoyl, dimethylsulfamoyl, ethylsulfamoyl, diethylsulfamoyl, dibutylsulfamoyl, piperidylsulfamoyl, morphorylsulfamoyl), arylsulfamoyl group (e.g., phenylsulfamoyl, methylphenylsulfamoyl, ethylphenylsulfamoyl, benzylphenylsulfamoyl), sulfamoyl group, cyano group, alkylsulfonyl group (e.g., methanesulfonyl, ethanesulfonyl), arylsulfonyl group (e.g., phenylsulfonyl, 4-chlorophenylsulfonyl, p-toluenesulfonyl), alkoxycarbonyl group (e.g.,methoxycarbonyl, ethoxycarbonyl, butoxycarbonyl), aryloxycarbonyl (e.g., phenoxycarbonyl), alkylcarbonyl (e.g., acetyl, propionyl, butyloyl), arylcarbonyl (e.g.,benzoyl, alkylbenzoyl), or acyloxy group (e.g., acetyloxy, propionyloxy, butyloyloxy). Of $R^1$ to $R^4$, $R^2$ and $R^4$ preferably are each a hydrogen atom. The sum of Harnmett's constant (σp) of $R^1$ to $R^4$ is preferably 0 or more. $R^5$ represents an alkyl group (e.g., methyl, ethyl, butyl, octyl, lauryl, cetyl, stearyl), aryl group [e.g.,phenyl; tolyl, xylyl, 4-methoxyphenyl, dodecyphenyl, chlorophenyl,trichlorophenyl, nitrochlorophenyl, triisopropylphenyl, 4-dodecyoxyphenyl, 3,5-di-(methoxycarbonyl)] or heterocyclic group (e.g., pyridyl).

The compounds represented by formula (2) are generally called sulfonylhydrazines. The compounds represented by formula (4) are generally called carbamoylhydrazines, in which Z represents an atomic group necessary to form an aromatic ring. The aromatic ring formed by Z needs to be electron-attractive enough to provide silver-developing activity to the compound. Accordingly, a nitrogen-containing aromatic heterocyclic ring or an aromatic ring having a benzene ring substituted by an electron-attractive group is preferably employed. Preferred examples such aromatic ring include a pyridine ring, pyrazine ring, pirimidine ring, quinoline ring, and quinoquoxaline ring. In cases of the benzene ring, examples of the substituent include an alkylsulfonyl group (e.g., methansulfonyl, ethanesulfonyl), halogen atom (e.g., chlorine, bromine), alkylcarbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl (e.g., phenylcarbamoyl, methylphenylcarbamoyl, ethylphenylcarbamoyl, benzylphenylcarbamoyl), carbamoyl group, alkylsulfamoyl group (e.g., methylsulfamoyl, dimethylsulfamoyl, ethylsulfamoyl, diethylsulfamoyl, dibutylsulfamoyl, piperidylsulfamoyl, morphorylsulfamoyl), arylsulfamoyl group (e.g., phenylsulfamoyl, methylphenylsulfamoyl, ethylphenylsulfamoyl, benzylphenylsulfamoyl), sulfamoyl group, cyano group, alkylsulfonyl group (e.g., methanesulfonyl, ethanesulfonyl), arylsulfonyl group (e.g., phenylsulfonyl, 4-chlorophenylsulfonyl, p-toluenesulfonyl), alkoxycarbonyl group (e.g.,methoxycarbonyl, ethoxycarbonyl, butoxycarbonyl), aryloxycarbonyl (e.g., phenoxycarbonyl), alkylcarbonyl (e.g., acetyl, propionyl, butyloyl), and arylcarbonyl (e.g., benzoyl, alkylbenzoyl). The sum of the Hammett's constant of the substituent is 1 or more. These substituents may be further substituted.

The compounds represented by formula III are generally called sulfonylhydrazones. The compounds represented by formula V are generally called carbamoylhydrazones, in which $R_6$ represents a substituted or unsubstituted alkyl group (e.g., methyl, ethyl); X represents an oxygen atom, sulfur atom selenium atom or a tertiary nitrogen atom substituted by an alkyl or aryl group, and an alkyl-substituted tertiary nitrogen atom is preferred. $R_7$, $R^8$, $R^9$ and $R^{10}$ each represent a hydrogen atom or a substituent, provided that $R_7$, $R^8$, $R^9$ and $R^{10}$ may combine with-each other to form a ring.

Exemplary examples of the compounds represented by formulas (1) to (4) are shown below, but the compounds are not limited to these examples.

D-1
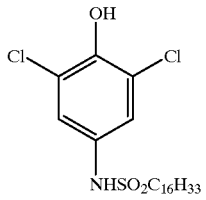
D-2
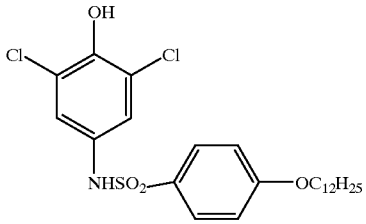
D-3
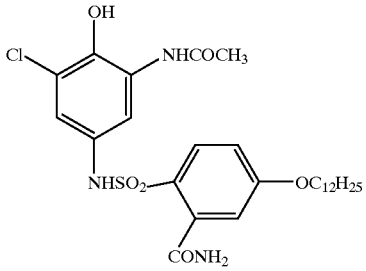
D-4
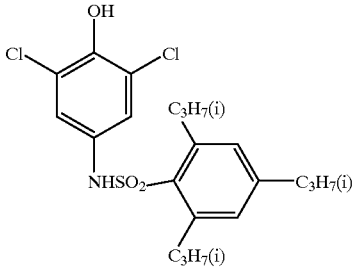
D-5
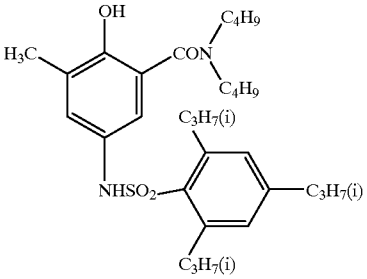
D-6
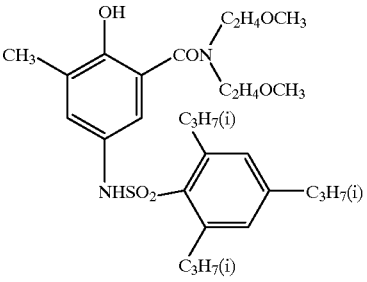
-continued
D-7
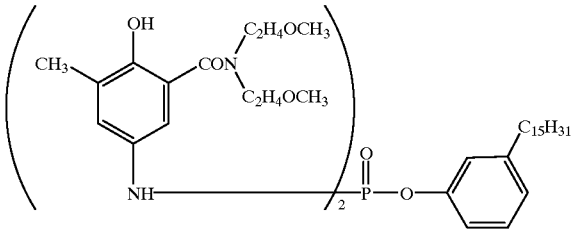
D-8
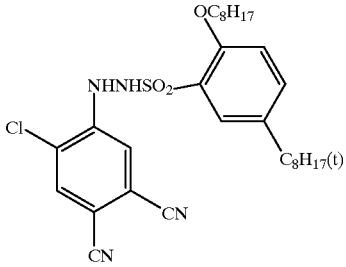
D-9
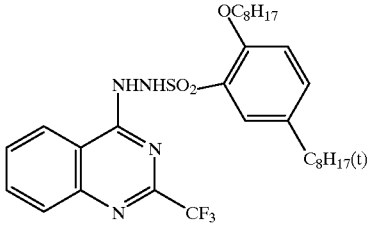
D-10
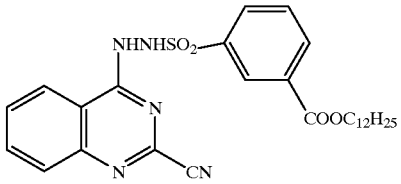
D-11
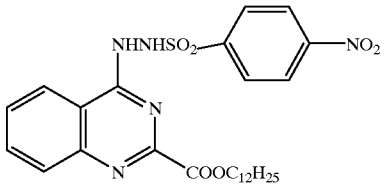
D-12
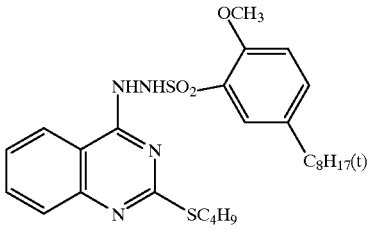
D-13
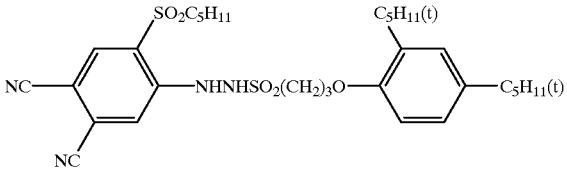

-continued
D-14
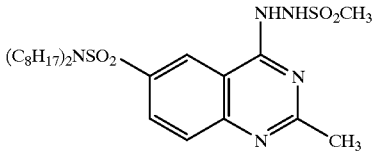
D-15
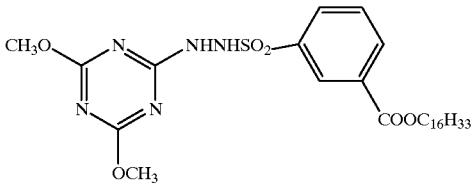
D-16
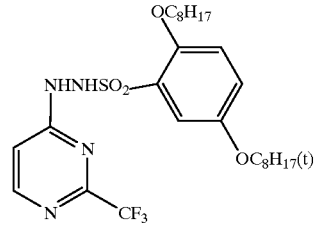
D-17
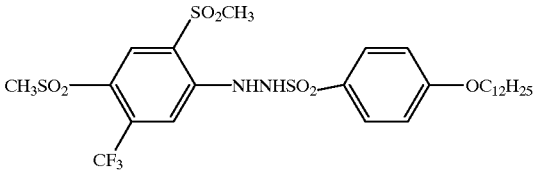
D-18
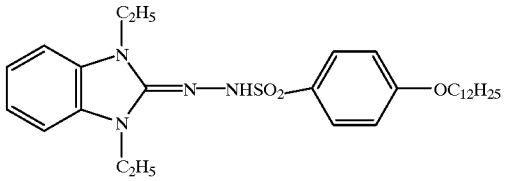
D-19
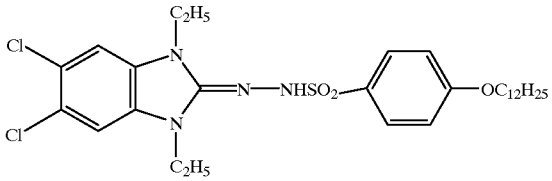
D-20
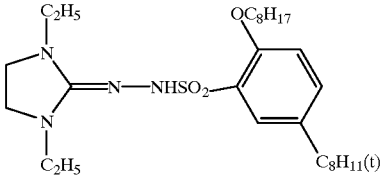
-continued
D-21
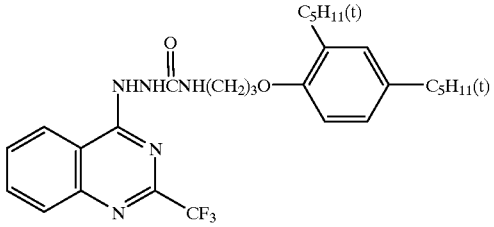
D-22
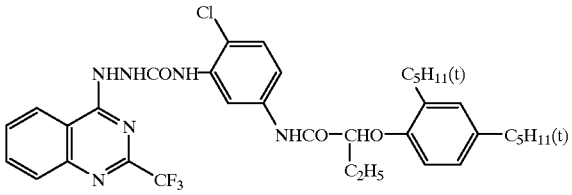
D-23
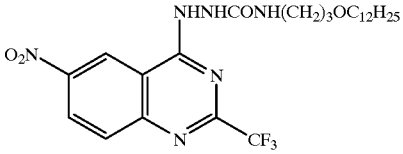
D-24
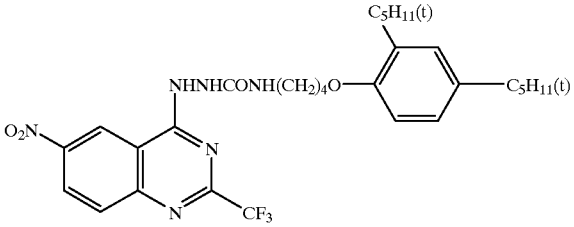
D-25
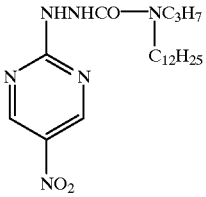
D-26
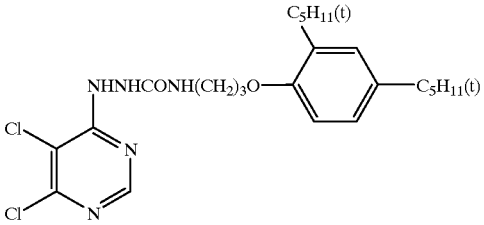
D-27
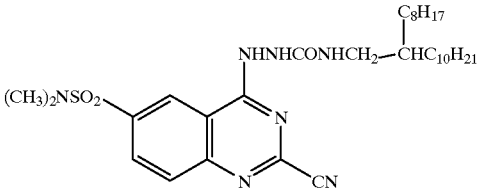

-continued
D-28
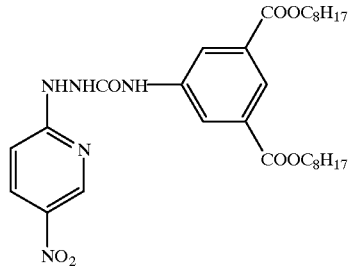
D-29
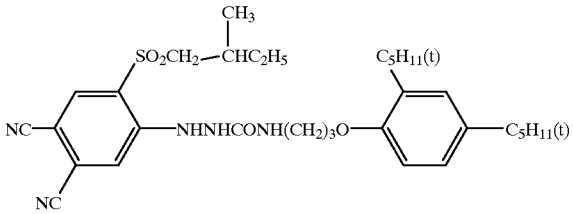
D-30
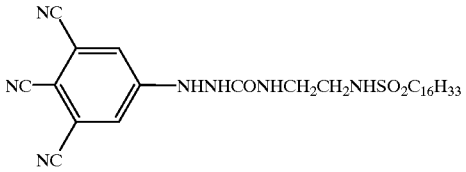
D-31
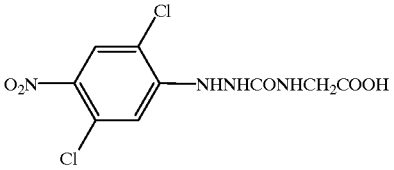
D-32
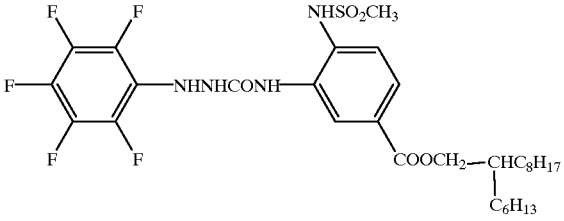
D-33
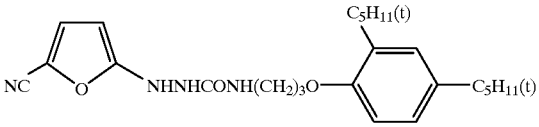
D-34
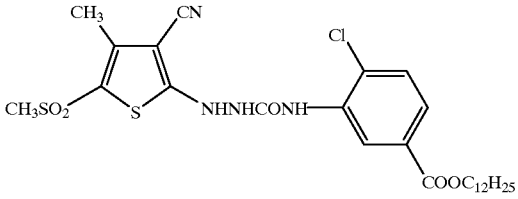
-continued
D-35
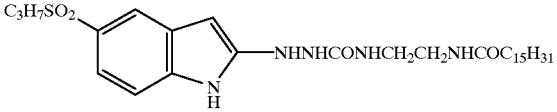
D-36
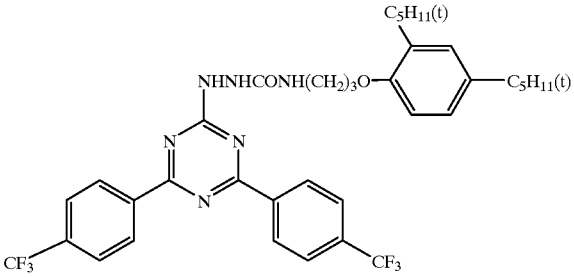
D-37
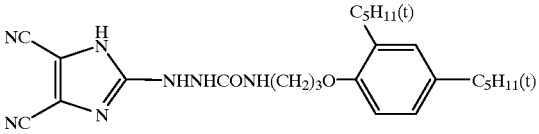
D-38
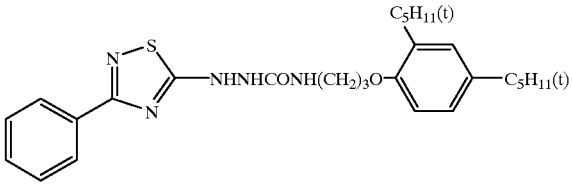
D-39
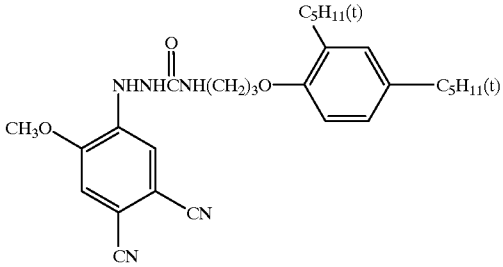
D-40
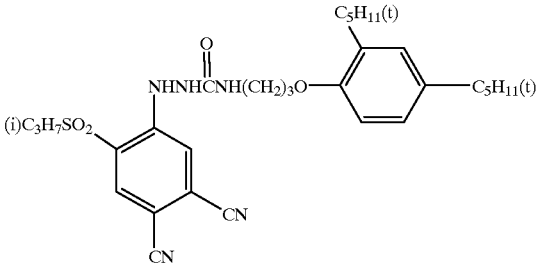

-continued

D-41

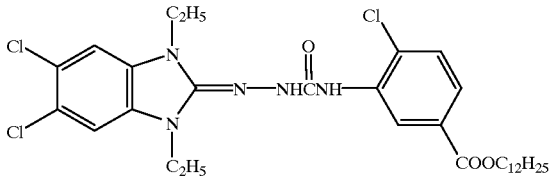

D-42

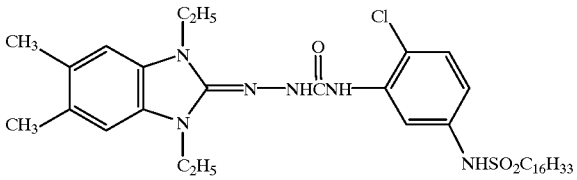

D-43

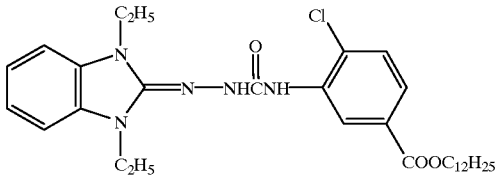

D-44

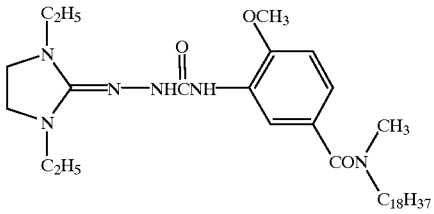

D-45

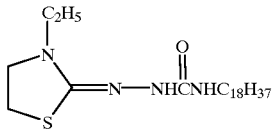

D-46

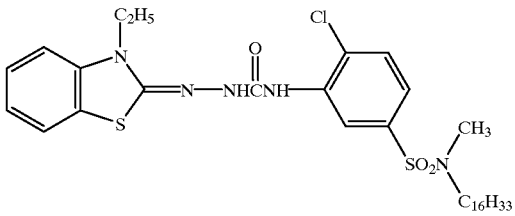

The developing agent is contained preferably in an amount of 0.05 to 10 mmol/$m^2$ (more preferably 0.1 to 5 mmol/$m^2$, and still more preferably 0.2 to 2.5 mmol/$m^2$) per layer.

Next, a compound capable of forming a dye upon reaction with an oxidation product of a developing agent, and employed in embodiments of the invention, in which a photographic material includes the developing agent, will be described. Such a compound is referred to as a coupler and preferred couplers used in the invention are those represented by the following formulas (Cp-1) to (Cp-12). These are generally called an active methylene, pyrazolone, pyrazoloazole or phenol naphthol coupler; and employed as a yellow coupler, magenta coupler and cyan coupler in color development system using p-phenylenediamines.

Formula Cp-1

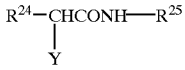

Formula Cp-2

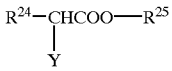

Formula Cp-3

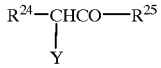

Formula Cp-4

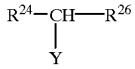

Formula Cp-5

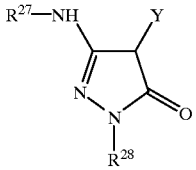

Formula Cp-6

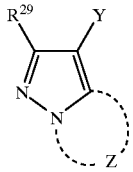

Formula Cp-7

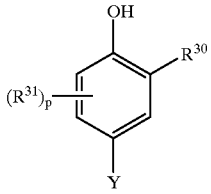

Formula Cp-8

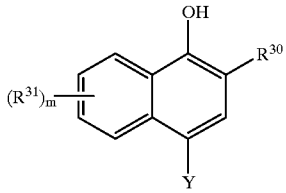

-continued

Formula Cp-9

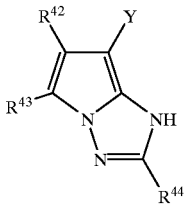

Formula Cp-10

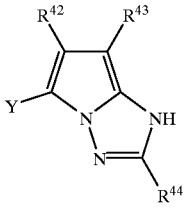

Formula Cp-11

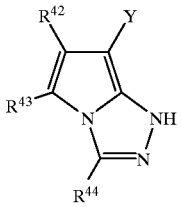

Formula Cp-12

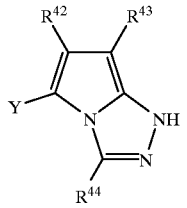

The compounds represented by formulas (Cp-1) to (Cp-4) are generally called active methylene type couplers, in which $R^{24}$ represents an acyl group, cyano, nitro, an aryl group, heterocyclic group, alkoxycarbinyl group, aryloxycarbonyl group, carbamoyl group, sulfamoyl group, alkylsulfonyl group, and arylsulfonyl group, each of which may be substututed.

$R^{25}$ represents an alkyl group, aryl group or heterocyclic group, each of which may be substituted. $R^{26}$ an aryl group or heterocyclic group, which may be substituted. Exemplary substituents for $R^{24}$, $R^{25}$ and $R^{26}$ include an alkyl group, cycloalkyl group, alkenyl group, alkynyl group, aryl group, aryl group, heterocyclic group, alkoxy group, aryloxy group, cyano, halogen atom, acylamino group, sulfonamido group, carbamoyl group, sulfamoyl group, alkoxycarbonyl group, aryoxycarbonyl group, alkylamino group, arylamino group, hydroxy, and sulfo group. Preferred examples of $R^{24}$ include an acyl group, cyano, carbamoyl group and alkoxycarbonyl group.

In formulas (Cp-1) to (Cp-4), Y represents a hydrogen atom or a group capable of being released upon coupling reaction. Examples of Y, as an anionic releasing group of two-equivalent coupler, include a halogen atom (e.g., chlorine, bromine), alkoxy group (e.g., methoxy, ethyl, butoxy), aryloxy group (e.g., pheoxy), alkylthio group (e.g., methylthio, ethylthio, butykthio), arylthio group (e.g., phenylthio, tolylthio), alkylcarbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl (e.g., phenylcarbamoyl), methylphenylcarbamoyl, ethylphenylcarbamoyl, benzylphenylcarbamoyl), carbamoyl group, alkylsulfamoyl group (e.g.,methylsulfamoyl, dimethylsulfamoyl, ethylsulfamoyl, diethylsulfamoyl, dibutylsulfamoyl, piperidylsulfamoyl, morphorylsulfamoyl), arylsulfamoyl group (e.g., phenylsulfamoyl, methylphenylsulfamoyl, ethylphenylsulfamoyl, benzylphenylsulfamoyl), sulfamoyl group, cyano group, alkylsulfonyl group (e.g., methanesulfonyl, ethanesulfonyl), arylsulfonyl group (e.g., phenylsulfonyl, 4-chlorophenylsulfonyl, p-toluenesulfonyl), alkylcarbonyloxy group (e.g., acetyloxy, ptopionyloxy, butyloyloxy), arylcarbonyloxy group (e.g., benzoyloxy, toluyloxy, anusyloxy), and nitrogen-containing heterocyclic group (e.g., imidazolyl, benzotriazolyl). Examples of Y,as a cationic releasing group of four-equivalent coupler include a hydrogen atom, formyl group, carbamoyl group, substituted methylene group (in which examples of substituents include an aryl group, sulfamoyl group, carbamoyl group, alkoxy group, amino v and hydroxy), acyl group and sulfonyl group. In formulas (Cp-1) to (Cp-4), $R^{24}$ and $R^{25}$, or $R^{24}$ and $R^{26}$ may be combined with each other to form a ring.

Formula (Cp-5) represents a coupler generally called a 5-pyrazolone type magenta coupler, in which $R^{27}$ represents an alkyl group, aryl group, acyl group or carbamoyl group; $R^{28}$ represents a phenyl group or a phenyl group substituted by at least a halogen atom, alkyl group, cyano, alkoxy group, alkoxycarbonyl group or acylamino group; and Y is the same as defined in (Cp-1) to (Cp-4). Of the 5-pyrazolone type magenta couplers represented by formula (Cp-5) are preferably those, in which $R^{27}$ is an aryl or acy group and $R^{28}$ is a phenyl group substituted by at least a halogen atom. Exemplary preferred $R^{27}$ include an aryl group such as phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl or 2-chloro-5-[2-(4-hydroxy-3-t-butylphenoxy)tetradecaneamido]pheny; and an acyl group such as acetyl, pivaloyl, tetradecanoyl, 2-(2,4-di-t-pentylpheoxy)acetyl, 2-(2,4-di-t-pentylphenoxy)butanoyl, benzoyl or 3-(2,4-di-t-amylphenoxyacetoamido)benzoyl, each of which may be substituted by a substituent, which is an organic substituent having a bonding attached to a carbon atom, oxygen atom, nitrogen atom or sulfur atom, or a halogen atom. $R^{28}$ is preferably a substituted phenyl group, such as 2,4,6-trichlorophenyl, 2,5-dichlorophenyl or 2-chlorophenyl.

Formula (Cp-6) represents a pyrazoloazole type coupler, in which $R^{29}$ represents a hydrogen atom or a substituent; Z represents an atomic group necessary to form a 5-membered azole ring (including condensed azole ring) containing 2 to 4 nitrogen atoms; and Y is the same as defined in (Cp-1) to (Cp-4). Of the pyrazoloazole type couplers represented by formula (Cp-6), imidazo[1,2-b]pyrazoles described in U.S. Pat. No. 4.500,630, pyrazolo[1,5-b][1,2,4]triazoles described in U.S. Pat. No. 4,540,654, and pyrazolo[5,1-c][1,2,4]triazoles described in U.S. Pat. No. 3,725,067 are preferred in terms of absorption characteristics of the dye; and of these is preferred pyrazolo[1,5-b][1,2,4]triazole in terms of light fastness. Substituent R29 and substituent for the azole ring, which is represented by Y and Z, are detailed, for example, in U.S. Pat. No. 4,540,654, col.2, line 41- to col.8 line 27. Specifically, a pyrazoloazole coupler described in JP-A 61-65245, in which branched an alkyl group is directly attached to the 2-, 3- or 6-position of the pyrazoloazole group; a pyrazoloazole coupler described in JP-A 61-65245, in which a sulfonamido group is contained in the molecule; a pyrazoloazole coupler containing an alkoxyphenylsulfonamido ballast group, described in JP-A 61-147245; a pyrazoloazole coupler containing an alkoxy or aryloxy group at the 6-position, described in JP-A 62-209457 and 63-307453;a pyrazoloazole coupler containing a carboamido group, described in JP-A 2-201443 are preferred. Couplers represented by formulas (Cp-7) and (Cp-8) are those which are generally called phenol type coupler and naphthol type coupler, respectively. In the formulas, $R^{30}$ represents a hydrogen atom or a group selected from —$NHCOR^{32}$, —$SO_2NR^{32}R^{33}$, —$NHSO_2R^{32}$, —$NHCOR^{32}$, —$NHCONR^{32}R^{33}$ and —$NHSO_2NR^{32}R^{33}$, in which $R^{32}$ and $R^{33}$ each represent a hydrogen atom or a substituent; $R^{31}$ represents a substituent; 1 is 0, 1 or 2; m is 0, 1,2,3 or 4; Y is the same as defined in (Cp-1) to (Cp-4); and $R^{31}$ to $R^{33}$ is the same as defined in $R^{24}$ to $R^{26}$.

Preferred examples of the phenol type coupler represented by formula (Cp-7) include 2-alkylamino-5-alkylphenol type described in U.S. Pat. Nos. 2,369,929, 2,801,171, 2,772,162, 2,895,826 and 3,772,002; 2,5-diacylaminopheno; type, described in U.S. Pat. Nos. 2,772,162, 3,758,308, 4,126,396, 4,334,011 and 4,327,173, West German Patent 3,329,729, and JP-A 59-166956; and 2-phenylureidi-5-acylaminophenol type, described in U.S. Pat. Nos. 3,446,622, 4,333,999, 4,451,559 and 4,427,767. Preferred examples of the naphthol type coupler represented by formula (Cp-8) include 2-carbamoyl-1-naphthol type, described in U.S. Pat. Nos. 2,474,293, 4,052,212, 4,146396, 4,2228,233 and 4,296,200; and 2-carbamoyl-5-amido-1-naphthol type described in U.S. Pat. No. 4,690,889.

Couplers represented by formulas (Cp-9) to (Cp-12) are those which are generally called a pyrrolotriazole coupler, in which $R^{42}$, $R^{43}$ and $R^{44}$ eacg represent a hydrogen atom or a substituent; Y is the same as defined in (Cp-1) to (Cp-4). Substituents for $R^{42}$, $R^{43}$ and $R^{44}$ are the same as those for $R^{24}$ to $R^{26}$. Preferred examples of the pyrrolotriazole type coupler include those described in European Patent 488,248A1, 491,197A1, and 545,300, in which at least one of $R^{42}$ and $R^{43}$ is an electron-attractive group.

Further, couplers having a structure such as a condensed phenol, imidazole, pyrrole, 3-hydroxypyridine, active methylene, 5,5-condensed heterocyclic ring and 5,6-condensed heterocyclic ring are also employed. Examples of the condensed phenol type coupler include those described in U.S. Pat. Nos. 4,327,173, 4,564,586 and 4,904,575. The imidazole type couplers include those described in U.S. Pat. Nos. 4,818,672 and 5,051,347. The pyrrole type couplers include those described in JP-A 4-188137 and 4-190347. the 3-hydroxypyridine type couplers include those described in JP-A 1-315736. The active methylene type couplers include those described in U.S. Pat. Nos. 5,104,783 and 5,162,196. The 5,5-condensed heterocyclic ring type couplers include pyrrolopyrazole type couplers described in U.S. Pat. No. 5,164,289 and pyrroloimidazole type couplers described in JP-A 4-174429. The 5,6-condensed heterocyclic type couplers includepyrazolopyrimidine type couplers described in U.S. Pat. No. 4,950,585, pyrrolotrazine type couplers described in JP-A 4-204730, and couplers described in European Patent 556,700.

Besides couplers described above, there may also be employed West German Patent 3,819,051A and 3,823,049; U.S. Pat. Nos. 4,840,883, 5,024,930, 5,051,347 and 4,481,268; European Patent 304,856A2, 329,036, 354,549A2, 374,781A2 and 379,110A2, 386,930A1; JP-A 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732.

The compounds, which are generally employed in color photographic materials are those capable of forming, upon development with a p-phenylenediamine type color developing agent, dyes having spectral absorption maximums in the blue region (of the wavelengths of 350 to 500 nm), the green region (of the wavelength of 500 to 600 nm) and red region (of the wavelengths of 600 to 750 nm). However, in cases where developed with the developing agent represented by formulas I to V (specifically, formulas I to IV), the dye formed on coupling exhibits a different absorption maximum from the wavelength region described above. Therefore, the kind of a coupler to be used has to optimally be selected in accordance with the kind of a developing agent to be used. The photographic materials used in the invention are not always to be designed so that the formed dyes exhibit the absorption maximum in the wavelength regions described above. Thus the dye may have an absorption maximum in the UV or infrared region, and these region may be combined with the visible region.

Couplers used in the invention may contain a polymer chain as a ballast group. A four-equivalent coupler or two-equivalent coupler may be employed in accordance with the kind of the developing agent to be used. When a developing agent represented by formula I, II or III are employed, the use of four equivalent couplers is preferred. When a developing agent represented by formula IV or V, the use of a two-equivalent coupler is preferred. Exemplary examples of the four-equivalent and two-equivalent couplers are detailed in The Theory of the Photographic Process (4th Ed., T. H. James, Macmillan, 1977) page 291–334 and 354-361; JP-A 58-12353, 58-149046, 58-149047, 59-11114, 59-124399, 59-174835, 59-231539, 59-231540, 60-2951, 60-14242, 60-23474, 60-66349, 8-110608, 8-146552, 8-146578 and 9-204031; and literature and patents aforementioned.

The photographic materials used in the invention may contain functional couplers described below. Couplers used for correction of an unwanted absorption of the formed dye include yellow-colored cyan couplers and yellow-colored magenta couplers described in European Patent 456,257A1, magenta-colored cyan couplers described in U.S. Pat. No. 4,833,069, and colorless masking couplers represented by formula (2) in U.S. Pat. No. 4,837,136 or formula (A) of claim 1 of WO92/11575 (specifically, exemplified compounds at page 36-45). Examples of compounds (including couplers) which are capable of releasing a photographically useful group, include Compounds (I) to (IV) described in European Patent 378,236A1 at page 11; Compounds (I) described in European Patent 436,938A2 at page 7; Compounds (1) described in Japanese Patent Application 4-134523; Compounds (I), (II), and (III) described in European Patent 440,195A2 at page 6; compounds capable of releasing a ligand, which are represented by formula (1) of claim 1 of Japanese Patent Application 40325564; and Compounds represented by formula LIG-X, as described in U.S. Pat. No. 4,555,478, Claim 1.

Couplers usable in the invention may be used alone or in combination, or in combination with other coupler(s). The coupler is preferably incorporated in a layer together with a developing agent or a silver halide emulsion. The amount to be incorporated is preferably 0.05 to 20 mols, more preferably 0.1 to 10 mols, and still more preferably 0.2 to 5 mols per mol of a developing agent; and 0.01 to 1 mol, and more preferably 0.02 to 0.6 mol per mol of silver halide. In these ranges can be obtained sufficient dye densities.

Hydrophobic additives such as a coupler or a developing agent may be incorporated in accordance with the known method, as described in U.S. Pat. No. 2,322,027. In this instance, a high boiling solvent is employed, optionally in combination with a low boiling solvent of a boiling point of 50 to 160° C., as described in U.S. Pat. Nos. 4,555,470, 4,536,466, 4,536, 467, 4,587,206, 4,555,476 and 4,599,296; and JP-B 3-62256 (herein the term, JP-B means examined and published Japanese Patent). The coupler and high boiling solvent each are employed in combination. The amount of the high boiling solvent-is preferably 10 g or less, more preferably 5 g or less, and still more preferably 0.1 to 1 g per g of the hydrophobic additive; and preferably 1 ml or less, more preferably 0.5 ml or less, and still more preferably 0.3 ml or less per g of binder. There are also applicable a dispersing method by use of a polymeric material, as described in JP-A 51-39853 and 51-59943; and an adding method in the form of a fine particle dispersion, as described in JP-A 62-30242. Compounds which are substantially insoluble in water may be incorporated in the form of fine particles dispersed in binder. The hydrophobic compound may be dispersed in a hydrophilic colloid using various surfactants, as described in JP-A 59-157636 at page (37)–(38) and the Research Disclosures afore-mentioned. There are also usable phosphoric acid ester type surfactants, as described in Japanese Patent Application 5-204325 and 6-19247 and West German Patent 1,932,299A.

In the photographic material used in the invention, dyes having absorption in various wavelength regions may be contained for the purpose of anti-irradiation or anti-halation. In conventional color photographic materials, colloidal silver has often been employed in a yellow filter layer or an anti-halation layer. In this case, the photographic material, after development, is to be subjected to bleach to remove the colloidal silver. However, a photographic material which does not need the bleaching step is preferred in terms of simplicity of processing. Accordingly, instead of colloidal silver is preferred the use of a dye capable being decolorized, leached out or transferred, exhibiting little contribution to the color density after development. The dye being decolorized or removed during processing means that the residual amount of the dye after processing is preferably ⅓ or less, and more preferably 1/10 or less of the dye before being subjected to processing. The dye may be leached out or transferred into processing material, or changed to a colorless compound during processing.

Hydrophilic binder binders are employed in the component layers of the photographic materials used in the invention, for example, as described in the Research Disclosures described above and JP-A 64-13546 at page (71)–(75). Specifically, transparent or semi-transparent, hydrophilic binders are preferably employed. Exemplary examples thereof include naturally occurring substances including proteins such as gelatin and its derivatives and polysaccharides such as cellulose derivatives, starch, gum arabic, dextran and pullulan, and synthetic polymeric compounds such as polyvinyl alcohol, polyvinyl pyrrolidone, and polyacrylamide. There is also employed a highly water-absorbing polymer described in U.S. Pat. No. 4,960,681 and JP-A 62-245260, including a homopolymer of vinyl monomers containing —COOM or —$SO_3$M (in which M is an alkali metal), and copolymers of these monomers or copolymer with other monomer (such as sodium methacrylate, ammonium methacrylate or potassium acrylate). The binders are employed alone or in combination; specifically, a combination of gelatin and the binder described above is preferred. Gelatin is selected from various types of gelatins, such as lime-treated gelatin, acid-treated gelatin and calcium-free gelatin and a combination thereof is also preferably employed. The coating amount of the binder is preferably 20 g/$m^2$ or less and more preferably 10 g/$m^2$ or less.

Supports usable in the invention are synthetic plastic films including polyolefins such as polyethylene and * polypropylene, polycarbonates, cellulose acetate, polyethylene terephthalate, polyethylenenaphthalates, and polyvinyl chloride. Polystyrenes having a syndiotactic structure are also preferably employed. These polymers can be polymerized in accordance with the methods described in JP-A 62-117708, 1-46912 and 1-178505. Further, supports usable in the invention include paper support such as photographic raw paper, paper for use in printing, baryta paper, and resin-coated paper; a support having a reflection layer provided on the plastic film described above; and supports described in JP-A 62-253195 (page 29–31). There are also preferably employed supports described in the RD. No. 17643 at page 28 and No. 18716 at page 647, right column to 648, left column, and No. 307105 at page 879. Syndiotactic polystyrene is also preferred. These polymers can be obtained by polymerization according to the method described in JP-A 62-117708, 1-46912 and 1-178505. There may be employed a support which has been subjected to thermal treatment at a temperature lower than Tg to prevent roll-set curl. To enhance adhesion between the support and subbed layer, the support may be subjected to surface treatment, including grow discharge treatment, UV exposure treatment, corona discharge treatment and flame treatment. There may also employed a support described in Known Techniques (Mar. 22, 1991, published by Astech Corp.) at pages 44 to 149. Transparent supports such as polyethylene dinaphthalenedicarboxylate and those having thereon transparent magnetic particle coat. Supports usable in the photographic materials used in the invention are detailed in RD-17643 at page 28, RD-308119 at page 1009 and Product Licensing Index Vol. 92, page 108, Item "Support". In cases where the photographic material is subjected to thermal processing, the used support needs to have heat-resistance to the processing temperature.

One of the preferred embodiments of processing photographic materials used in the invention concerns thermal development. In thermal development preferably employed is a processing material different from conventional photographic materials. As one embodiment of the processing material is a sheet comprising a support having thereon a processing layer containing a base and/or base precursor. The processing layer preferably comprises a hydrophilic binder. After being imagewise exposed, the photosensitive layer of the photographic material is laminated to the processing layer of the processing material and then subjected to heating to form images. It is preferred that water in an amount of 1/10 to 1 times the water necessary for the maximum swelling of all the layers of the photographic material and processing material is supplied to the photographic material or the processing material, both materials are laminated with each other and heated to achieve thermal development. The auxiliary developing agent described above may optionally be occluded into the photographic material or processing material, or it may be coated with water.

Thermal processing of photographic materials is well known in the photographic art. Thermally processable photographic materials and processing thereof are described in "Shashinkogaku no Kiso (Fundamentals of Photographic Engineering)" pages 553–555 (1970, published by Corona Corp.); Nebletts, Handbook of Photography and Reprography 7th Ed. page 32–33(Van Nostrand and Reinhold Co.); U.S. Pat. Nos. 3,152,904, 3,301,678, 3,392,020 and 3,457,075; British Patent 1.131,108 and 1,167,777; and Research Disclosure Vol. 170, 17029, page 9–15 (June, 1978). The heating temperature in the development process is preferably 50 to 250° C., and more preferably 60 to 150° C.

A thermal solvent may be incorporated into the photographic material to promote thermal development. The thermal solvent is a compound capable of being melted on heating and exhibiting action of promoting image formation. The thermal solvent is preferably white solid at ordinary temperature and less volatile on heating. The melting point thereof is preferably 70 to 170° C.

In the photographic material and/or processing material used in the invention, a base or its precursor is preferably employed to promote silver development or dye forming reaction. Examples of the base precursor include a salt of an organic acid capable of being decarboxylated on heating and base, and a compound capable of releasing an amine on intramolecular nucleophilic reaction, Lossen rearrangement or Beckmann rearrangement.

In addition to containing the base and/or its precursor, the processing material may further have a function of shielding from air at the time of thermal development, preventing volatiles of components from the photographic material, supplying processing components other than the base, or removing unwanted photographic component(s) in the photographic material after processing, or removing unnecessary component materials produced during development. Further, the processing material may have a desilvering function. For example, if at least a part of silver halide and/or developed silver is solubilized when an imagewise exposed photographic material and a processing material are laminated to each other prior to processing, a silver halide solvent may be incorporated into the processing material as a fixer.

In the processing material may be employed the same support and binder as in photographic materials. A mordant may be incorporated into the processing material to remove the dye described above. Mordants known in the photographic art can be employed, as described in U.S. Pat. No. 4,50,626 col.58-59, JP-A 61-88256 page 32–41. JP-A 62-244043 and 62-244036. There may also be employed a polymeric compound capable of accepting a dye. The thermal solvent may be incorporated in the processing material .

In the thermal processing of photographic materials , a small amount of water is preferably used to promote development, transfer of processing materials, or diffusion of unwanted materials. Specifically, in cases where the base is allowed to be produced by using the combination of a sparingly water-soluble basic metal compound and a compound capable of forming the metal ion of the basic compound, the use of water is indispensable. There may be employed water containing an inorganic alkali metal salt, organic salt, low boiling solvent, surfactant, antifoggant, a compound which is capable of forming a complex with a sparing water-soluble metal compound, antimold and antifungus. Any water may be employed, including distilled water, tap water, well water and mineral water. In an apparatus for thermally processing photographic materials, water may not be reused or may be cycled and repeatedly reused. In the latter case, water is to contain components leached out of photographic or processing materials. An apparatus or water described in JP-A 63-144354, 63-144355, 62-38460 and 3-210555 may be employed. Water may be provided to both photographic material and processing material. The water amount to be used is preferably from 1/10 to 1 times the amount necessary to allow the-total layers of the photographic and processing materials to maximally swell.

Photographic materials used in the invention can be thermally developed applying known heating means, such as a system of bringing into contact with a heated heat-block or a plane heater, a system of bringing into contact with a heated roller or a heated drum, a system of bringing into contact with an infrared or far-infrared lamp heater, a system of allowing to pass through environment maintained at high temperature, and a system of using high-frequency heating. There may be applied a system in which a layer of exothermic conductive substance such as carbon black is provided on the back-side of a photographoc material or image receiving material and electric current is allowed to flow to produce heat. The heating temperature is preferably 70 to 100° C.

In the thermal processing, a development arrestor is contained in a processing member and function of the development arrestor is allowed to concurrently proceed with development. The development arrestor is a compound capable of neutralizing or reacting a base contained in the layer after completing optimal development to reduce the base concentration to stop development, or a compound capable of acting silver or a silver salt to retard development. Examples thereof include an acid precursor capable of releasing acid on heating, an electrophilic compound capable of causing substitution reaction with a coexisting base on heating, and a nitrogen containing heterocyclic compound or mercapto-containing compound and their precursors.

To remove developed silver produced in the photographic material during thermal development, an oxidizing agent capable of bleaching the silver may be contained in the processing material to allow it to react during thermal development. Alternatively developed silver can be removed by laminating a developed photographic material and a second material containing a silver-oxidizing agent. However, bleaching after development is preferred in terms of simplicity in processing.

A compound capable of fixing may be incorporated in a processing material to remove unwanted silver halide after image formation. One of such systems is that physical development nuclei and a silver halide solvent are allowed to be included in a processing material, and silver halide contained in a photographic material is solubilized during heating and fixed in the processing material. In this case, solubilized silver salt is diffused from the photographic material to the physical development nuclei and reduced to form physically developed silver therein.

Silver halide may be fixed without using physical development nuclei and a reducing agent. In this case, it is desirable that silver halide be converted to non-photosensitive silver salt with a silver halide solvent.

In the thermal processing in the invention, two or more function-separated processing materials, such as a processing material for thermal developing and a processing material for bleaching and/or fixing-(hereinafter, referred to as a second processing material), each may successively be laminated with a photographic material to be subjected to heating treatment, wherein the processing material for developing preferably has no compound capable of bleaching or fixing. After laminated with the processing material for developing to be heated, the photographic material and the second processing material are laminated preferably by opposing a photosensitive layer to a processing layer. In this case, water is given in advance to the photographic material or the processing material, in an amount of 0.1 to 1 times the amount necessary to swell the total layers except for backing layer(s) of both materials. Bleaching or fixing is conducted by heating at a temperature of 40 to 100° C. for 5 to 60 sec. at this state. The amount or kind of water, and a method of providing water or laminating the photographic material and processing material are the same as in the processing material for developing.

In cases where the processed photographic materials are used for storage or enjoyment over a long period of time, bleaching and fixing treatments described above are preferred. However, in cases where after processed, the photographic material is immediately read with a scanner to be transformed to electronic images, the bleaching and fixing treatments are not necessarily needed. It is conventionally preferred to be subjected to the fixing treatment, because remaining silver halide has absorption in the visible region, which becomes a noise source in reading with a scanner, adversely affecting electronic images. To conduct simple development without fixing treatment, the use of thin tabular silver halide grains or silver chloride grains is preferred. The use of silver chloride grains is specifically preferred.

One of preferred embodiments of processing photographic materials is activator processing The activator processing refers to a processing method in which a color developing agent is allowed to be occluded in a photographic material and the photographic material is developed with a processing solution containing no developing agent. In this case, the processing solution contains no color developing agent but contains other components [e.g., alkali, auxiliary developing agent such as a compound represented by formula (ETA-I or II) described below]. The activator processing is exemplarily described in European Patent 545,491A1 and 565,165A1. The pH of the activator processing solution is preferably 9 or more, and more preferably 10 or more.

Auxiliary Developing Agent:

When the photographic material is subjected to the activator processing, an auxiliary-developing agent is preferably employed. The auxiliary developing agent is a substance promoting electron transfer of from a developing agent to silver halide in the process of developing silver halide. The auxiliary developing agent may be added to an alkaline solution or incorporated into the photographic material. Processing with an alkaline solution containing an auxiliary developing agent is described in RD No. 17643 page 28-29, RD No. 18716 at page 651 left to right column, and RD No. 307105 at page 880–881. Preferred auxiliary developing agents used in the invention are represented by the follwing formula (ETA-I) or (ETA-II), which are electron releasing compounds obeying Kendall-Pertz law. Of these, the compounds of (ETA-1) is preferred.

Formula (ETA-I)

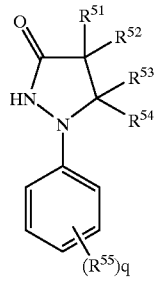

Formula (ETA-II)

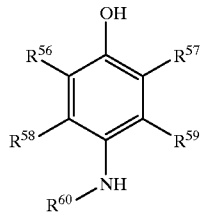

In the formula (ETA-I) and (ETA-II), $R^{51}$ to $R^{54}$ each represent a hydrogen atom, an alkyl group, cycloalkyl group, alkenyl group, aryl group, or heterocyclic group. R55 to R59 each represent a hydrogen atom, halogen atom, cyano, alkyl group, cycloalkyl group, alkenyl group, aryl group, heterocyclic group, alkoxy group, cycloalkyloxy group, aryloxy group, heterocyclic-oxy group, silyloxy group, acyloxy group, amino group, anilino group, heterocyclic-amino group, alkylthio group, arylthio group, heterocyclic-thio group, silyl group, hydroxy, nitro, alkoxycarbonyl group, cycloalkyloxycarbonyloxy group, aryloxycarbonyloxy group, carbamoyloxy group, sulfamoyloxy group, alkanesulfonyloxy group, arenesulfonyloxy group, acyl group, alkoxycarbonyl group, cycloalkyloxycarbonyl group, aryloxycarbonyl group, carbamoyl group, carbonamido group, ureido group, imido group, alkoxycarbonylamino group, aryloxycarbonylamino group, sulfonamido group, sulfamoylamino group, alkylsulfinyl group, arenesulfinyl group, alkanesufonyl group, arenesulfonyl group, sulfamoyl group. sulfo, phosphinoyl group or phosphinoylamino group. In the formulas, q is an integer of 0 to 5, provided that when q is 2 or more, $R^{55}$s may be different from each other; $R^{60}$ represents an alkyl group or aryl group. Exemplary examples of the compounds represented by formula (ETA-I) or (ETA-II) are described in Japanese Patent Application No. 10-44518 at page 26 to 30 including compounds (ETA-1) to (ETA-32).

In cases where the auxiliary developing agent is allowed to be occluded in the photographic material, the auxiliary developing agent may be contained in the form of a precursor thereof to enhance storage stability of the photographic material. Examples of the precursor are described in JP- -A 1-138556. The auxiliary developing agent is dissolved in water or an appropriate solvent such as alcohols, acetone, dimethylformamide, and glycols. Alternatively, the compound may be contained in a solid fine particle dispersion, or by dissolving in a high boiling solvent such as tricresyl phosphate and dispersing in a binder. The auxiliary developing agent precursor may be used in combination of two or more precursors or with an auxiliary developing agent.

Images formed after completion of processing are read by a transmission type image reading apparatus (a so-called scanner) and image information is converted, in at least four wavelength regions to electric signals in such a manner as described below. As a photoreception element (or semiconductor image sensor) usable in the invention are employed a one-dimensional line sensor in which monochromatic CCDs having a sensitivity in visible and infrared region are arranged in a line, or a two-dimensional area sensor in which the monochromatic CCDs are crosswise arranged. A light sources used in a scanner is not specifically limited so far as it emits visible and infrared light. For example, fluorescent lamps including rare gas such as xenon gas or a combination of some kinds of high-intensity LEDs are employed. In cases of a continuous light source anda photographic material containing an absorption spectrum of a coupler dye or having a color filter unit, the four wavelengths are selected by inserting, between the light source and the monochromatic CCD, a color separation filter selected so as to meet an absorption spectrum of each color filter. In cases where a primary color emission type high-intensity LED of blue, green, red, infrared, etc. is employed as a light source, selection of the four wavelengths can be achieved by switching the LED light source. It is preferred that thus read four primary image informations are subjected to processing to make a correction of amplitude of a coupler dye or to remove a crosstalk component caused by silver images in the case of being not fixed so that luminance information, red separation information, green separation information and blue separation information are each extracted as purely as possible. Of the thus extracted a luminance information signal (denoted as $L_0$), a blue separation signal (denoted as B), green separation signal (denoted as G) and a red separation signal (denoted as R), a RGB digital color image is formed using the B signal, G signal and R signal. Subsequently, color information alone is extracted from the RGB digital color image, for example, by converting the RGB image information to Lab image information or Luv image information. Herein, the term, Lab refers to an abbreviation of L*a*b* of CIE, i.e., Commission Internationale de I'Eclairage, (hereinafter, denoted as Lab), in which L is lightness information, a and b are hue and chroma, respectively. This image information conversion can be readily made, for example, using an image processing application software such as PHOTOSHOP available from Adobe Corp. After converting a RGB image to a Lab image, lightness information L is canceled, for which the luminance information signal ($L_0$) extracted the luminance information recording layer described earlier is substituted to obtain an objective image $L_0$ab. To obtain better images, in this case, it is preferred to optimally adjust the contrast or gradation of the $L_0$ image.

An image forming method characterized as follows is preferably employed. From a silver halide color photographic material in which a striped or mosaic color separation filter layer and a light sensitive layer having a spectral sensitivity within the whole visible region and capable of forming black images corresponding to latent images upon processing are provided in this order from the object, color separation image information is obtained using a scanner of converting image informations in at least four wavelength regions to electric signals and an image information corresponding to black images is obtained by scanning without the use of color separation filters; after converting RGB digital color images prepared from the color separation images to Lab or Luv signals, the L component information is substituted for the image information corresponding to black images to prepare digital color images.

EXAMPLES

The present invention will be further described based on examples, but embodiments of the invention are not limited to these examples.

Example 1

The following layers having the composition described below were coated on a subbed cellulose triacetate film support in this order from the support to prepare a multi-layered color photographic material, comparative Sample 101. In the following examples, the amount of each component was expressed in a coating amount of g/m$^2$, unless otherwise noted. The coating amount of silver halide or colloidal silver was represented by equivalent converted to silVer. With respect to a sensitizing dye, it was expressed in mol per mol of silver halide contained in the same layer.

1st Layer: Anti-Halation Layer

| | |
|---|---|
| Black colloidal silver | 0.24 |
| UV absorbent (UV-1) | 0.3 |
| Gelatin | 1.5 |

2nd Layer: Intermnediate Layer

| | |
|---|---|
| Gelatin | 0.7 |

3rd Layer: Low-speed Red-Sensitive Layer

| | |
|---|---|
| Silver iodobromide emulsion a | 0.34 |
| Silver iodobromide emulsion b | 0.09 |
| Sensitizing dye (SD-1) | $1.62 \times 10^{-5}$ |
| Sensitizing dye (SD-2) | $7.93 \times 10^{-5}$ |
| Sensitizing dye (SD-3) | $1.84 \times 10^{-4}$ |
| Cyan coupler (C-1) | 0.3 |
| Colored cyan coupler (CC-1) | 0.054 |
| DIR Compound (DI-1) | 0.02 |
| High boiling solvent (OIL-2) | 0.3 |
| Anti-staining agent (AS-2) | 0.001 |
| Gelatin | 0.8 |

4th Layers: Medium-speed Red-sensitive Layer

| | |
|---|---|
| Silver iodobromide emulsion b | 0.41 |
| Sensitizing dye (SD-1) | $2.20 \times 10^{-5}$ |
| Sensitizing dye (SD-2) | $1.03 \times 10^{-4}$ |
| Sensitizing dye (SD-3) | $2.42 \times 10^{-4}$ |
| C-1 | 0.18 |
| CC-1 | 0.038 |
| DI-1 | 0.01 |
| OIL-2 | 0.23 |
| AS-2 | 0.001 |
| Gelatin | 0.8 |

5th Layer: High-speed Red-Sensitive Layer

| | |
|---|---|
| Silver iodobromide emulsion a | 0.044 |
| Silver iodobromide emulsion b | 0.21 |
| Silver iodobromide emulsion c | 0.56 |
| Sensitizing dye (SD-1) | $1.91 \times 10^{-5}$ |
| Sensitizing dye (SD-2) | $8.81 \times 10^{-5}$ |

-continued

| | |
|---|---|
| Sensitizing dye (SD-3) | $2.06 \times 10^{-4}$ |
| C-1 | 0.17 |
| CC-1 | 0.03 |
| DI-1 | 0.004 |
| OIL-2 | 0.19 |
| AS-2 | 0.002 |
| Gelatin | 0.7 |

6th Layer: Intermediate Layer

| | |
|---|---|
| OIL-1 | 0.10 |
| AS-1 | 0.08 |
| Gelatin | 0.9 |

7th Layer: Low-speed Green-Sensitive Layer

| | |
|---|---|
| Silver iodobromide emulsion a | 0.25 |
| Silver iodobromide emulsion d | 0.10 |
| Sensitizing dye (SD-4) | $2.20 \times 10^{-4}$ |
| Sensitizing dye (SD-5) | $5.50 \times 10^{-5}$ |
| M-1 | 0.31 |
| CM-1 | 0.12 |
| DI-2 | 0.017 |
| AS-2 | 0. |
| OIL-1 | 0.44 |
| Gelatin | 1.2 |

8th Layer: Medium-speed Green-Sensitive Layer

| | |
|---|---|
| Silver iodobromide emulsion d | 0.51 |
| Sensitizing dye (SD-5) | $3.08 \times 10^{-5}$ |
| Sensitizing dye (SD-6) | $2.36 \times 10^{-4}$ |
| Sensitizing dye (SD-7) | $3.53 \times 10^{-5}$ |
| M-1 | 0.10 |
| CM-1 | 0.05 |
| OIL-1 | 0.15 |
| AS-2 | 0.001 |
| Gelatin | 0.9 |

9th Layer: High-speed Green-Sensitive Layer

| | |
|---|---|
| Silver iodobromide emulsion a | 0.03 |
| Silver iodobromide emulsion e | 0.53 |
| Sensitizing dye (SD-5) | $2.79 \times 10^{-5}$ |
| Sensitizing dye (SD-6) | $2.10 \times 10^{-4}$ |
| Sensitizing dye (SD-7) | $3.08 \times 10^{-5}$ |
| M-1 | 0.033 |
| M-2 | 0.023 |
| CM-1 | 0.023 |
| DI-2 | 0.009 |
| DI-3 | 0.001 |
| OIL-1 | 0.08 |
| AS-2 | 0.002 |
| Gelatin | 0.7 |

10th Layer: Yellow Filter Layer

| | |
|---|---|
| Yellow colloidal silver | 0.06 |
| OIL-1 | 0.06 |
| AS-1 | 0.07 |
| FS-1 | 0.056 |
| Gelatin | 0.9 |

11th Layer: Low-speed Blue-sensitive Layer

| | |
|---|---|
| Silver iodobromide emulsion a | 0.21 |
| Silver iodobromide emulsion f | 0.16 |
| Silver iodobromide emulsion g | 0.09 |
| Sensitizing dye (SD-8) | $1.69 \times 10^{-4}$ |
| Sensitizing dye (SD-9) | $8.23 \times 10^{-5}$ |
| Sensitizing dye (SD-10) | $3.76 \times 10^{-4}$ |
| Y-1 | 1.0 |
| OIL-1 | 0.4 |
| AS-2 | 0.002 |
| FS-1 | 0.11 |
| Gelatin | 1.7 |

12th Layer: High-sped Blue-sensitive Layer

| | |
|---|---|
| Silver iodobromide emulsion g | 0.34 |
| Silver iodobromide emulsion h | 0.34 |
| Sensitizing dye (SD-8) | $1.05 \times 10^{-4}$ |
| Sensitizing dye (SD-10) | $3.51 \times 10^{-5}$ |
| Y-1 | 0.08 |
| OIL-1 | 0.03 |
| AS-2 | 0.002 |
| FS-1 | 0.03 |
| Gelatin | 0.63 |

13th Layer: First Protective Layer

| | |
|---|---|
| Silver iodobromide emulsion i | 0.2 |
| UV-2 | 0.53 |
| FS-1 | 0.057 |
| Gelatin | 0.9 |

14th Layer: Second protective Layer

| | |
|---|---|
| PM-1 | 0.15 |
| PM-2 | 0.04 |
| WAX-1 | 0.02 |
| gelatin | 0.55 |

In addition to the above composition were compounds SU-1 and SU-; a viscosity-adjusting agent V-1; hardeners H-1 and H-2; stabilizers ST-1 and ST-2; fog restrainers AF-1, AF-2 and AF-3; dyes AI-1, AI-2 and AI-3 and antiseptic D-1.

Characteristics of silver iodobromide emulsions described above are shown below, in which the average grain size refers to an edge length of a cube having the same volume as that of the grain.

TABLE 1

| Emulsion | Average Size ($\mu$m) | Average Iodide Content (mol %) | Aspect ratio |
|---|---|---|---|
| a | 0.27 | 2.0 | 1.0 |
| b | 0.48 | 2.6 | 3.7 |
| c | 0.68 | 7.6 | 6.5 |
| d | 0.45 | 2.7 | 3.7 |
| e | 0.70 | 2.6 | 7.0 |
| f | 0.38 | 8.0 | 1.0 |
| g | 0.65 | 8.0 | 1.5 |
| h | 0.80 | 8.0 | 2.0 |
| i | 0.03 | 2.0 | 1.0 |

TABLE 1-continued

| Emulsion | Average Size (μm) | Average Iodide Content (mol %) | Aspect ratio |
|---|---|---|---|
| j | 0.90 | 5.0 | 6.5 |
| k | 0.90 | 4.0 | 7.0 |
| l | 1.00 | 7.0 | 2.5 |

Silver iodobromide emulsions e, g and h each contained iridium of $1\times10^{-7}$ to $1\times10^{-6}$ mol/Ag mol. Silver iodobromide emulsion shown in Table 1, except for Emulsion c, e and I, after adding sensitizing dyes, were each chemicals sensitized with sodiym thiosulfate, chloroauric acid and potassium thiocyanate so as to achieve an optimal relationship of fog-sensitivity. Dmulsions c and e, after adding sensitizing dyes, were chemically sensitized with sodium thiosulfate, trophenylohosphine selenide, chloroauric acid and potassium thiocyanate so as to achieve an optomal relationship of fog-sensitivity.

Compounds used in each layer of Sample 101 are shown below.

SD-1

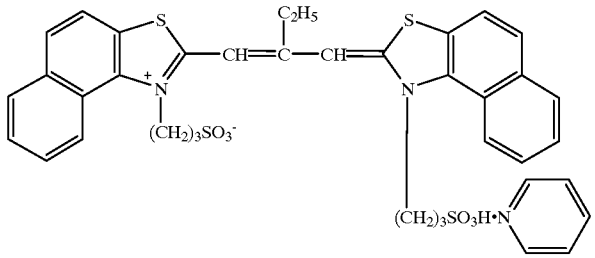

SD-2

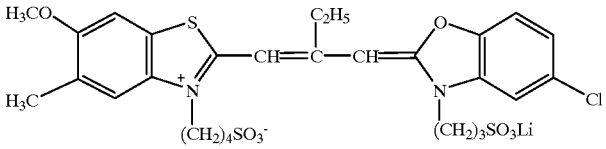

SD-3

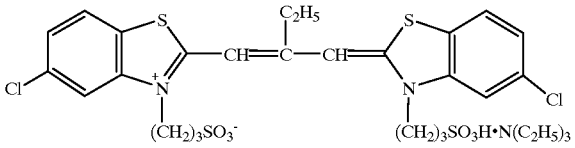

SD-4

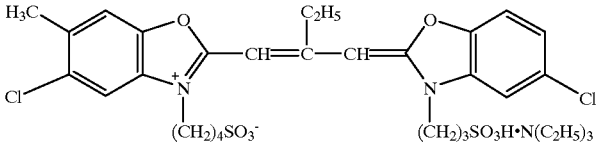

SD-5

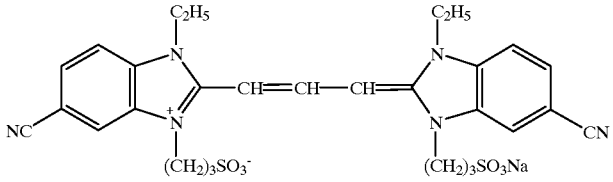

SD-6

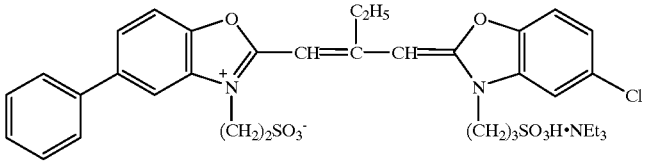

-continued
SD-7
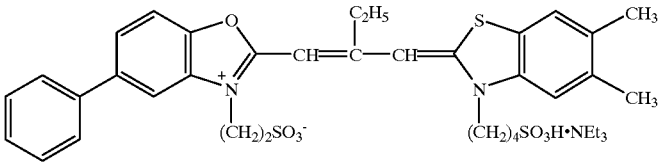
SD-8
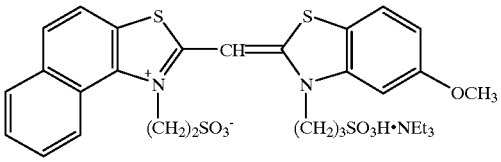
SD-9
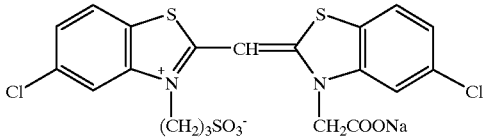
SD-10
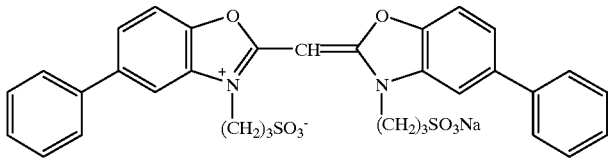
C-1
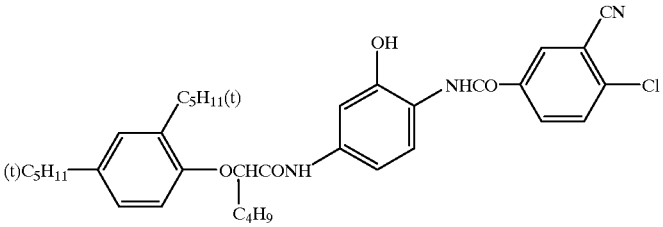
Y-1
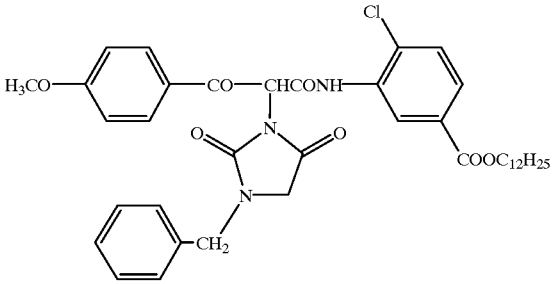
CC-1
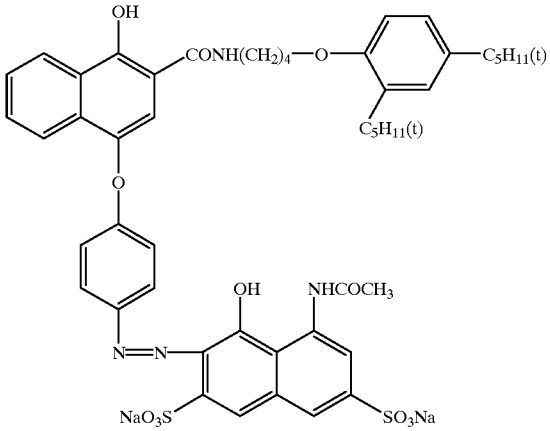
CM-1
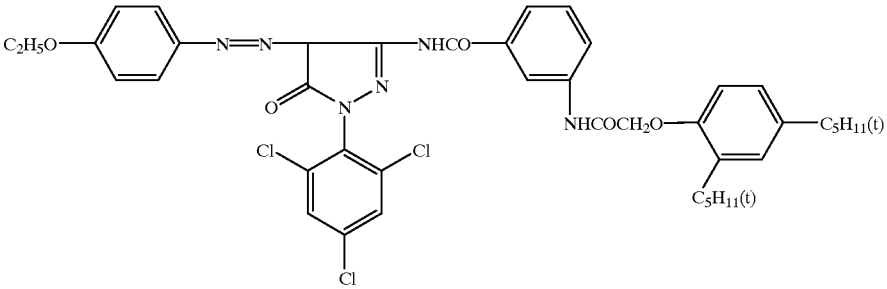

-continued
AS-1
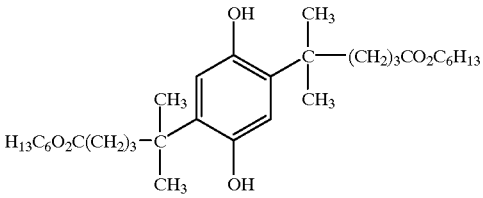
AS-2
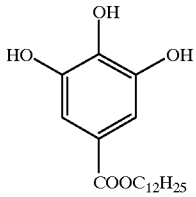
FS-1
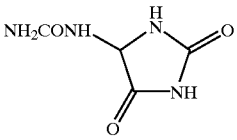
OIL-1
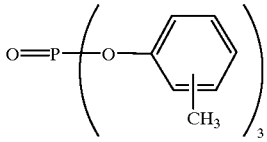
OIL-2
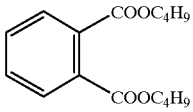
OIL-3
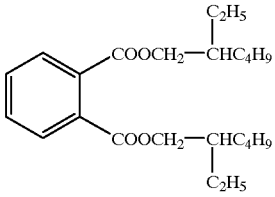
UV-1
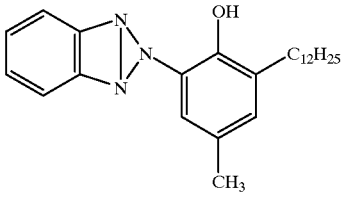
UV-2
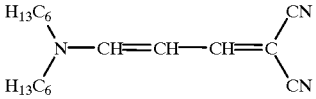
V-1
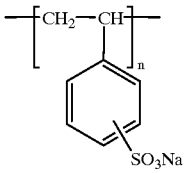
Weight-averaged molecular weight of 10,000
n: Degree of polymerization
D-1 (Mixture)
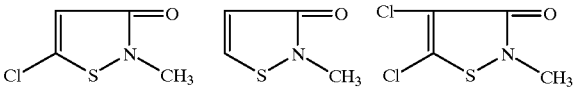
A B C
A:B:C = 50:46:4 (molar ratio)
H-1
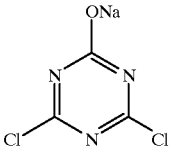
H-2
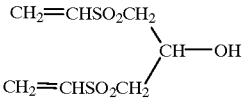
ST-1
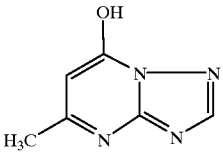
ST-2
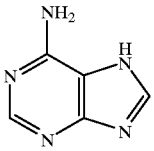
AF-1
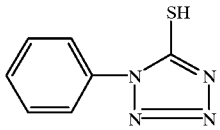
AF-2
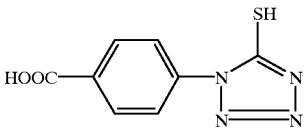

-continued
AF-3
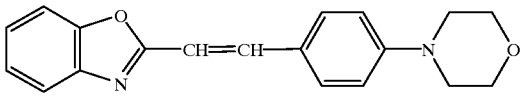
SU-1
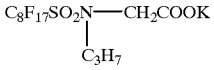
SU-2
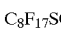
WAX-1
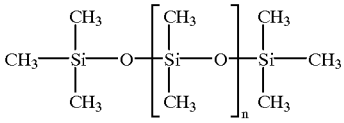
Mw=3,000
PM-1
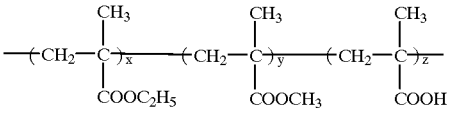
x:y:z = 3:3:4
PM-2
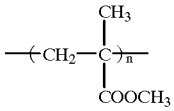
Weight-averaged molecular weight of 20,000
n: Degree of polymerization
Al-1
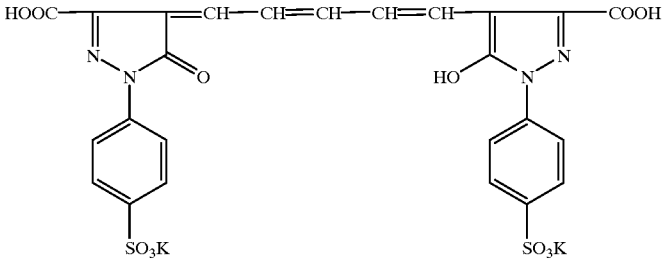
Al-2
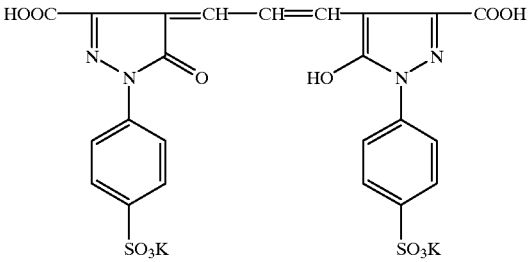
Al-3
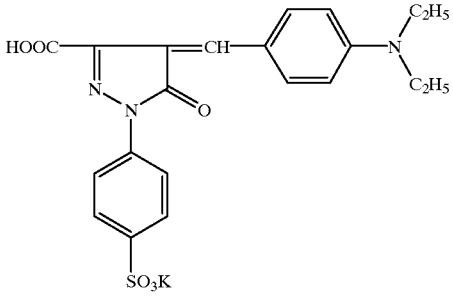
M-1
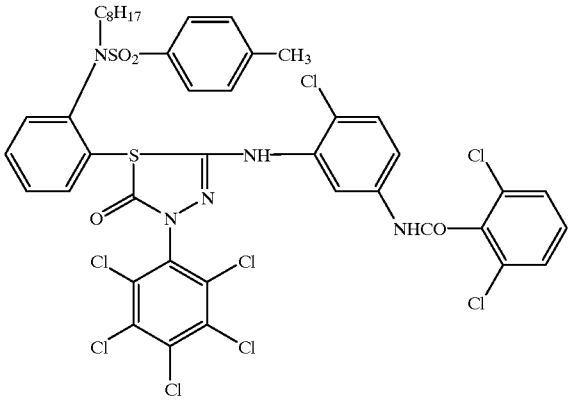
M-2
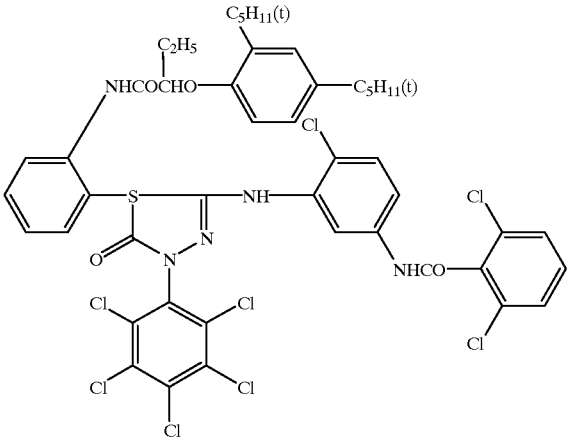

-continued

Dl-1

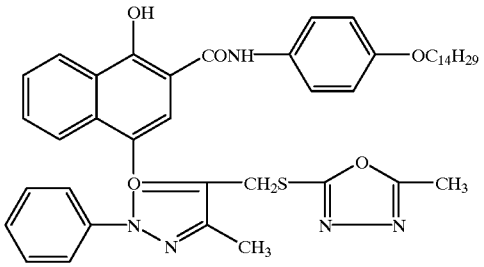

D1-2

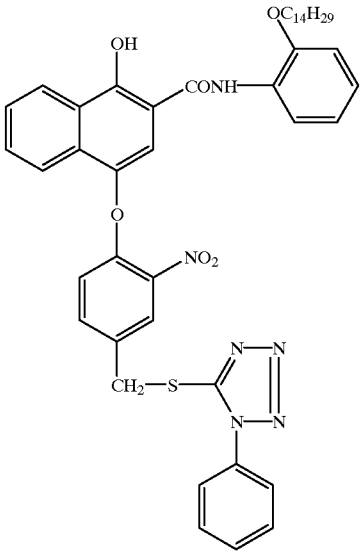

D1-3

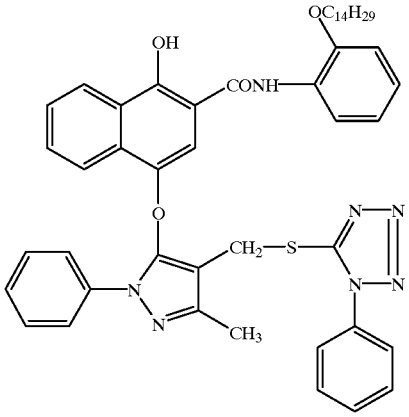

Preparation of Sample 102

Sample 102 was prepared similarly to Sample 101, except that emulsions and amounts of sensitizing dyes were varied as below.

| Sample 101 | → | Sample 102 |
|---|---|---|
| 3rd Layer | | |
| Emulsion a | → | Emulsion b |
| Emulsion b | → | Emulsion c |
| SD-1 $1.62 \times 10^{-5}$ | → | $8.90 \times 10^{-6}$ |
| SD-2 $7.93 \times 10^{-5}$ | → | $4.20 \times 10^{-5}$ |
| SD-3 $1.81 \times 10^{-4}$ | → | $9.60 \times 10^{-5}$ |
| 4th Layer | | |
| Emulsion b | → | Emulsion c |
| SD-1 $2.2 \times 10^{-5}$ | → | $1.55 \times 10^{-5}$ |
| SD-2 $1.03 \times 10^{-4}$ | → | $7.25 \times 10^{-5}$ |
| SD-3 $2.42 \times 10^{-4}$ | → | $1.70 \times 10^{-4}$ |
| 5th Layer | | |
| Emulsion a | → | Emulsion b |
| Emulsion b | → | Emulsion c |
| Emulsion c | → | Emulsion j |

-continued

| Sample 101 | → | Sample 102 |
|---|---|---|
| SD-1 $1.91 \times 10^{-5}$ | → | $1.35 \times 10^{-5}$ |
| SD-2 $8.81 \times 10^{-5}$ | → | $6.20 \times 10^{-5}$ |
| SD-3 $2.06 \times 10^{-4}$ | → | $1.45 \times 10^{-4}$ |
| 7th Layer | | |
| Emulsion a | → | Emulsion d |
| Emulsion d | → | Emulsion e |
| SD-4 $2.20 \times 10^{-4}$ | → | $1.35 \times 10^{-4}$ |
| SD-2 $5.50 \times 10^{-5}$ | → | $3.35 \times 10^{-5}$ |
| 8th Layer | | |
| Emulsion d | → | Emulsion e |
| SD-5 $3.08 \times 10^{-5}$ | → | $1.91 \times 10^{-5}$ |
| SD-6 $2.36 \times 10^{-4}$ | → | $1.46 \times 10^{-4}$ |
| SD-7 $3.53 \times 10^{-5}$ | → | $2.20 \times 10^{-5}$ |
| 9th Layer | | |
| Emulsion a | → | Emulsion d |
| Emulsion e | → | Emulsion k |
| SD-5 $2.79 \times 10^{-5}$ | → | $1.95 \times 10^{-5}$ |
| SD-6 $2.10 \times 10^{-4}$ | → | $1.45 \times 10^{-4}$ |
| SD-7 $3.08 \times 10^{-5}$ | → | $2.20 \times 10^{-5}$ |

-continued

| Sample 101 | → | Sample 102 |
|---|---|---|
| 11th Layer | | |
| Emulsion a | → | Emulsion f |
| Emulsion f | → | Emulsion g |
| Emulsion g | → | Emulsion h |
| SD-8 $1.69 \times 10^{-4}$ | → | $1.05 \times 10^{-4}$ |
| SD-9 $8.23 \times 10^{-5}$ | → | $4.95 \times 10^{-5}$ |
| SD-10 $3.76 \times 10^{-4}$ | → | $2.25 \times 10^{-4}$ |
| 12th Layer | | |
| Emulsion g | → | Emulsion h |
| Emulsion h | → | Emulsion l |
| SD-8 $1.05 \times 10^{-4}$ | → | $8.50 \times 10^{-5}$ |
| SD-10 $3.51 \times 10^{-5}$ | → | $2.73 \times 10^{-5}$ |

Preparation of Sample 103

Sample 103 was prepared similarly to Sample 102, except that layers including a luminance information recording layer, A, B C and D were provided between the 12th and $13^{th}$ layers, in this order from the support, as shown below.

Layer A (Interlayer)

| | |
|---|---|
| OIL-1 | 0.10 |
| AS-1 | 0.08 |
| Gelatin | 0.9 |

Layer B (Low-speed luminance information recording layer)

| | |
|---|---|
| Silver iodobromide emulsion | 0.78 |
| Sensitizing dye (SD-1) | $1.33 \times 10^{-4}$ |
| Sensitizing dye (SD-2) | $1.47 \times 10^{-4}$ |
| Sensitizing dye (SD-3) | $1.72 \times 10^{-4}$ |
| Sensitizing dye (SD-6) | $1.20 \times 10^{-4}$ |
| Infrared coupler (III-5) | 0.30 |
| High boiling solvent (OIL-1) | 0.28 |
| Gelatin | 0.8 |

Layer C (Intermediate-speed luminance information recording layer)

| | |
|---|---|
| Silver iodobromide emulsion g | 1.20 |
| Sensitizing dye (SD-1) | $1.02 \times 10^{-4}$ |
| Sensitizing dye (SD-2) | $9.8 \times 10^{-5}$ |
| Sensitizing dye (SD-3) | $1.75 \times 10^{-4}$ |
| Sensitizing dye (SD-6) | $9.7 \times 10^{-5}$ |
| Infrared coupler (III-5) | 0.22 |
| High boiling solvent (OIL-1) | 0.20 |
| Gelatin | 0.8 |

Layer D (Intermediate-speed luminance information recording layer)

| | |
|---|---|
| Silver iodobromide emulsion h | 1.30 |
| Sensitizing dye (SD-1) | $1.05 \times 10^{-4}$ |
| Sensitizing dye (SD-2) | $8.2 \times 10^{-5}$ |
| Sensitizing dye (SD-3) | $1.45 \times 10^{-4}$ |
| Sensitizing dye (SD-6) | $8.1 \times 10^{-5}$ |
| Infrared coupler (III-5) | 0.12 |

-continued

| | |
|---|---|
| High boiling solvent (OIL-1) | 0.20 |
| Gelatin | 0.7 |

Preparation of Sample 104 through 106

Samples 104 through 106 were prepared similarly to Sample 103, except that sensitizing dyes and their content of layers B, C and D were varied as below, with proviso that in Sample 104, layers B, C and D were provided between the 9th and 10th layers.

| | Sample 104 | Sample 105 | Sample 106 |
|---|---|---|---|
| Layer B | | | |
| SD-1 | 0 | 0 | $1.05 \times 10^{-4}$ |
| SD-2 | 0 | 0 | $1.20 \times 10^{-4}$ |
| SD-3 | 0 | 0 | $1.37 \times 10^{-4}$ |
| SD-5 | $4.65 \times 10^{-5}$ | $3.70 \times 10^{-5}$ | 0 |
| SD-6 | $3.55 \times 10^{-4}$ | $2.85 \times 10^{-4}$ | $1.05 \times 10^{-4}$ |
| SD-7 | $5.30 \times 10^{-5}$ | $4.25 \times 10^{-5}$ | 0 |
| I-a-e-5 | 0 | $8.60 \times 10^{-5}$ | $8.20 \times 10^{-5}$ |
| Layer C | | | |
| SD-1 | 0 | 0 | $8.15 \times 10^{-5}$ |
| SD-2 | 0 | 0 | $7.85 \times 10^{-5}$ |
| SD-3 | 0 | 0 | $1.40 \times 10^{-4}$ |
| SD-5 | $4.20 \times 10^{-5}$ | $3.45 \times 10^{-5}$ | 0 |
| SD-6 | $3.15 \times 10^{-4}$ | $2.55 \times 10^{-4}$ | $7.80 \times 10^{-5}$ |
| SD-7 | $4.73 \times 10^{-5}$ | $3.80 \times 10^{-5}$ | 0 |
| I-a-e-5 | 0 | $7.75 \times 10^{-5}$ | $7.40 \times 10^{-5}$ |
| Layer D | | | |
| SD-1 | 0 | 0 | $8.50 \times 10^{-5}$ |
| SD-2 | 0 | 0 | $6.60 \times 10^{-5}$ |
| SD-3 | 0 | 0 | $1.05 \times 10^{-4}$ |
| SD-5 | $3.82 \times 10^{-5}$ | $3.10 \times 10^{-5}$ | 0 |
| SD-6 | $2.85 \times 10^{-4}$ | $2.30 \times 10^{-4}$ | $4.50 \times 10^{-5}$ |
| SD-7 | $4.30 \times 10^{-5}$ | $3.45 \times 10^{-5}$ | 0 |
| I-a-e-5 | 0 | $7.20 \times 10^{-5}$ | $7.05 \times 10^{-5}$ |

Spectral sensitivity distribution of the luminance information recording layer of the inventive samples was obtained as shown in FIG. 1.

The thus prepared Samples 101 through 106 were each converted to 135 size film, packaged into a patrone and loaded into Nikon single-lens reflex camera (F4) with a lens of a focal distance of 35 mm and F=2 (available from Nikon Corp.); thereafter, setting a film speed to ISO 800, greenish trees and distant mountains were photographed using the camera by ten peoples.

After photographing, the photographed samples were processed according to the following processing steps.

Processing:

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

*Amounts per $m^2$ of photographic material

A color developer, bleach, fixer and stabilizer each were prepared according to the following formulas.

Color Developer (worker solution):

| | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-(β-hydroxyethyl)-aniline sulfate | 4.5 g |
| Diethylenetriaminepentaacetic acid | 3.0 g |
| Potassium hydroxide | 1.2 g |

Water was added to make 1 liter in total, and the pH was adjusted to 10.06, with potassium hydroxide and sulfuric acid.

Color Developer (replenisher solution):

| | |
|---|---|
| Water | 800 ml |
| Potassium carbonate | 35 g |
| Sodium hydrogencarbonate | 3.0 g |
| Potassium sulfite | 5.0 g |
| Sodium bromide | 0.4 g |
| Hydroxylamine sulfate | 3.1 g |
| 4-Amino-3-methyl-N-(β-hydroxyethyl)-aniline sulfate | 6.3 g |
| Potassium hydroxide | 2.0 g |
| Diethylenetriaminepentaacetic acid | 3.0 g |

Water was added to make 1 liter in total, and the pH was adjusted to 10.18, with potassium hydroxide and sulfuric acid.

Bleach (worker solution):

| | |
|---|---|
| Water | 700 ml |
| Ammonium iron (III) 1,3-diamino-propanetetraacetic acid | 125 g |
| | 125 g |
| Ethylenediaminetetraacetic acid | 2 g |
| Sodium nitrate | 40 g |
| Ammonium bromide | 150 g |
| Glacial acetic acid | 40 g |

Water was added to make 1 liter in total and the pH was adjusted to 4.4, with ammoniacal water or glacial acetic acid.

Bleach (replenisher solution):

| | |
|---|---|
| Water | 700 ml |
| Ammonium iron (III) 1,3-diamino-propanetetraacetic acid | 175 g |
| Ethylenediaminetetraacetic acid | 2 g |
| Sodium nitrate | 50 g |
| Ammonium bromide | 200 g |
| Glacial acetic acid | 56 g |

Water was added to make 1 liter in total and the pH was adjusted to 4.4, with ammoniacal water or glacial acetic acid.

Fixer (worker solution):

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Water was added to make 1 liter in total and the pH was adjusted to 6.2, with ammoniacal water or glacial acetic acid.

Fixer (replenisher solution):

| | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

Water was added to make 1 liter in total and the pH was adjusted to 6.5, with ammoniacal water or glacial acetic acid.

Stabilizer (worker and replenisher solution):

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

With regard to comparative Samples 101 and 102, separation negative images of R, G and B were obtained from photographed negative films thereof, using a monochromatic CCD camera of 2048×2048 pixels, KX4 (available from Eastman Kodak Corp.), in which a red separation filter (gelatin filter No.W26, available from Eastman Kodak Corp.), a green separation filter (No.W99) or a blue separation filter (No.W98) was arranged between the sample and a light source. The obtained images were subjected to a gradation reversal treatment and then, after optimally adjusting the contrast of the three images, the three images were combined with each to obtain a RGB color image.

With regard to Samples 103 and 106, separation negative images were obtained to extract R, G and B color informations from photographed negative films, using a monochromatic CCD camera of 600,000 pixels, in which an infrared absorbing filter DR filter (available from Kenko Co. Ltd.) was installed in advance, and a red separation filter (gelatin filter No.W26, available from Eastman Kodak Corp.), a green separation filter (No.W99) or a blue separation filter (No.W98) was arranged between the sample and a light source. Subsequently, using a monochromatic CCD camera of 2048×2048 pixels, in which an infrared absorbing filter was removed and an infrared transmitting filter (No.W89B, available from Eastman Kodak Corp.) was arranged between the sample and a light source, a negative image to extract luminance information was obtained.

The image data corresponding to Samples 101 to 106 were evaluated with sharpness. Thus, a sharpness chart of each sample was observed at various magnifications on a CRT monitor to determine a limiting sharpness converted to the film area (lines/mm). Sharpness was represented by a relative value, based on the sharpness of Sample 101 being 100. The larger value indicates superior sharpness. Results thereof are shown below:

| | Sample No. | | | | | |
|---|---|---|---|---|---|---|
| | 101 | 102 | 103 | 104 | 105 | 106 |
| Sharpness | 100 | 110 | 180 | 175 | 185 | 190. |

As apparent from the results, image data corresponding Sample 103 to 106 were superior in sharpness.

Next, the image data obtained by exposure through an optical wedge of Samples 101 to 106 were inputted to a digital printer QD21 (available from Konica Corp.) An L-size print at a density of the minimum density (Dmin) plus 0.1 was obtained, based on the data of Sample 101, in which granularity similar to fine sand was observed. With regard to Samples 102 to 106, there was made a print at the same density and at such a magnification that granularity appeared to be almost the same as that of Sample 101. Granularity of each print was represented by a relative value of magnification, based on Sample 101. The lower value represents graininess which is superior. Results thereof are shown below:

| | Sample No. | | | | | |
|---|---|---|---|---|---|---|
| | 101 | 102 | 103 | 104 | 105 | 106 |
| Sharpness | 1.0 | 1.4 | 0.65 | 0.80 | 0.80 | 0.60. |

As is apparent from the results, image data corresponding Sample 103 to 106 were superior in graininess.

Further, after the obtained four images were subjected to gradation reversal treatment, an RGB color image was prepared from the color separation images and the RGB image was converted to the Lab image using PHOTOSHOP, which was available from Adobe Corp. The L image was substituted by luminance information read-out by using an infrared transmitting filter and was further subjected to RGB image conversion processing to obtain a color image. The thus obtained RGB image data corresponding to each of Samples 101 to 106 was printed on A4 size (210×297 mm) Konica color paper type QAA7, using an LED printer (produced by Konica Corp.) at a resolution of 300 dpi. The thus obtained prints were subjected to sensory examination of 10 picture-takers with respect to faithfulness of reproduction. The main points of their observation were color and vividness with regard to green of trees and perception of depth with regard to mountains. Evaluation was made based on five grades, with 5 being "excellent" and 1 being "poor", and the values given by 10 peoples were averaged out.

| | Sample | | | | | |
|---|---|---|---|---|---|---|
| | 101 | 102 | 103 | 104 | 105 | 106 |
| Sharpness feeling | 2.2 | 2.5 | 3.5 | 3.1 | 4.3 | 4.6 |
| Granular feeling | 2.3 | 1.6 | 4.0 | 2.9 | 4.1 | 4.5 |

-continued

| | Sample | | | | | |
|---|---|---|---|---|---|---|
| | 101 | 102 | 103 | 104 | 105 | 106 |
| Green of trees | 2.3 | 2.6 | 3.4 | 4.1 | 4.7 | 4.5 |
| Perception of depth of mountains | 2.2 | 2.6 | 3.1 | 3.7 | 4.8 | 4.6 |

As can be seen from the results described above, Samples according to the invention were superior in granular feel, i.e., graininess and sharpness feeling, i.e., sharpness as well as vividness of the green of trees and perception of the depth of mountains, as compared to Samples 101 and 102. It was further proved that even when photographed at an ISO speed of 800, no deterioration in image quality was observed.

Example 2

Preparation of Color Filter

On a subbed transparent PEN base (of 85 μm thickness), coating solutions of the same constitution as Sample No. 110 in Example 1 of Japanese Patent Application No. 10-326017 were coated by the simultaneous multi-layer coating method to prepare a photographic material. The prepared photographic material was exposed through a mask filter so that an R?G?B Bayer arrangement pattern in a square form having an edge dimension of 20 μm was formed and was processed according to the steps described in Japanese Patent Application No. 10-326017 to obtain a color filter used in the invention.

Preparation of Photographic Material 201

On the thus prepared color filter provided on the support, the following photographic component layers were successively coated in this order from the support to obtain multi-layered photographic material 201. The amount of each component was expressed in a coating amount of g/m$^2$, unless otherwise noted. Silver halide emulsions and sensitizing dyes were the same as used in Example 1. The coating amount of silver halide was represented by an equivalent converted to silver. With respect to the sensitizing dyes, the amount thereof was expressed in mol per mol of silver halide contained in the same layer.

1st Layer (Sublayer)

| | |
|---|---|
| Gelatin | 0.8 |
| UV absorbent (UV-1) | 0.2 |
| High boiling solvent (OIL-2) | 0.2 |

2nd Layer (High-sensitive, dye-forming layer)

| | |
|---|---|
| Gelatin | 1.7 |
| Silver iodobromide emulsion c | 2.5 |
| Sensitizing dye (SD-1) | $1.12 \times 10^{-4}$ |
| Sensitizing dye (SD-2) | $1.08 \times 10^{-4}$ |
| Sensitizing dye (SD-3) | $1.93 \times 10^{-4}$ |
| Sensitizing dye (SD-6) | $1.05 \times 10^{-4}$ |
| Color developing agent (D-24) | 0.45 |
| Cyan coupler (C-21) | 0.16 |
| Magenta coupler (M-21) | 0.09 |
| Yellow coupler (Y-21) | 0.21 |
| High boiling solvent (OIL-1) | 0.35 |
| High boiling solvent (OIL-2) | 0.09 |
| Antifoggant (AF-9) | 0.002 |
| Aqueous soluble polymer (PS-1) | 0.04 |

3rd Layer (Low-sensitive, dye-forming layer)

| | |
|---|---|
| Gelatin | 3.30 |
| Silver iodobromide emulsion a | 0.5 |
| Silver iodobromide emulsion b | 1.0 |
| Sensitizing dye (SD-1) | $1.46 \times 10^{-4}$ |
| Sensitizing dye (SD-2) | $1.60 \times 10^{-4}$ |
| Sensitizing dye (SD-3) | $1.85 \times 10^{-4}$ |
| Sensitizing dye (SD-6) | $1.34 \times 10^{-4}$ |
| Color developing agent (D-24) | 0.90 |
| Cyan coupler (C-21) | 0.32 |
| Magenta coupler (M-21) | 0.18 |
| Yellow coupler (Y-21) | 0.42 |
| High boiling solvent (OIL-1) | 0.70 |
| High boiling solvent (OIL-2) | 0.17 |
| Antifoggant (AF-9) | 0.002 |
| Aqueous soluble polymer (PS-1) | 0.02 |

4th Layer (Antihalation layer)

| | |
|---|---|
| Gelatin | 0.80 |
| Dye (AI-1) | 0.28 |
| Dye (AI-2) | 0.24 |
| Dye (AI-3) | 0.40 |

5th Layer (Base-generating layer)

| | |
|---|---|
| Gelatin | 1.20 |
| Additive (HQ-2) | 0.02 |
| High boiling solvent (OIL-2) | 0.06 |
| Aqueous soluble polymer (PS-1) | 0.06 |
| Zinc oxide | 1.63 |
| Zinc hydroxide | 0.40 |

6th Layer (Protective layer)

| | |
|---|---|
| Gelatin | 0.50 |
| Matting agent (WAX-1) | 0.20 |
| Aqueous soluble polymer (PS-1) | 0.12 |

In addition to the foregoing composition were added coating aids SU-1, SU-2 and SU-3, dispersing aid SU-4, stabilizer ST-1 and ST-2, antifoggant AF-4, AF-5, AF-6, AF-7 and AF-8, hardener H-1, H-3, H-4 and H-5. Further, F-2, F-3, F-4 and F-5 were each added each of the layers, in a total amount of 15.0 mg/m$^2$, 60.0 mg/m$^2$, 50.0 mg/m$^2$, and 10 mg/m$^2$, respectively. Compounds used in the foregoing are as follows.

Al-1

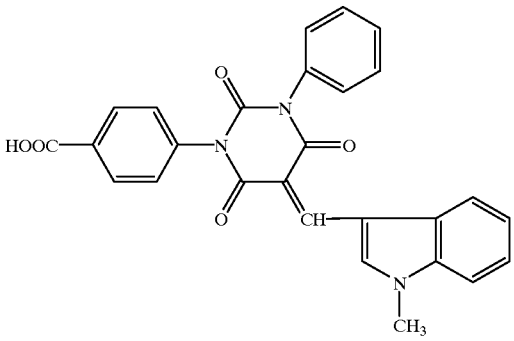

-continued

Al-2

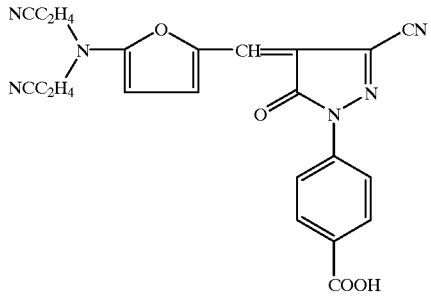

A1-3

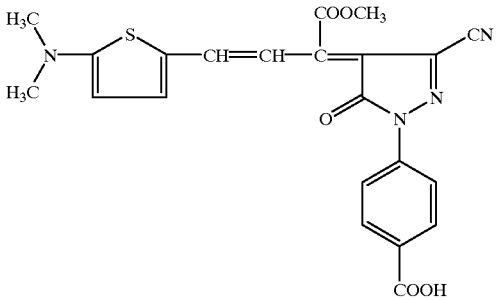

(Yellow coupler)

Y-21

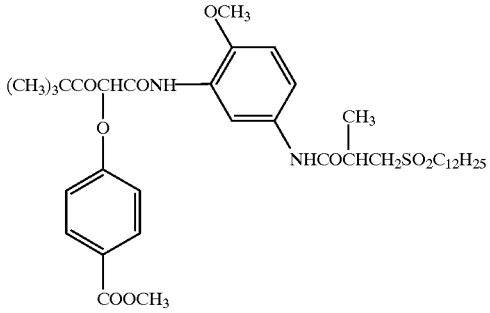

(Magenta coupler)

M-21

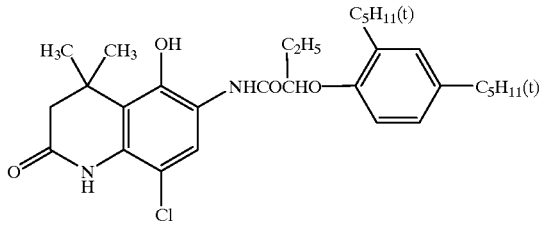

(Cyan coupler)

C-21

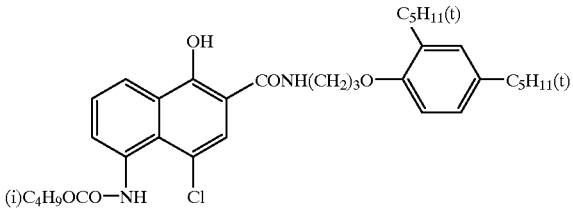

-continued
AF-4,5
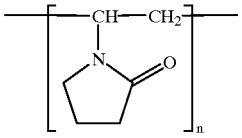
AF-4 Mw ≒ 10,000
AF-5 Mw ≒ 1000,000
n: Degree of polymerization
AF-6
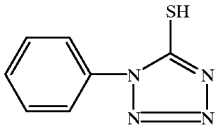
AF-7
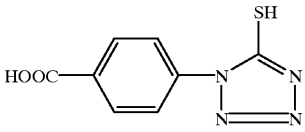
AF-8
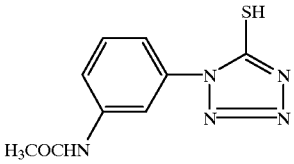
AF-9
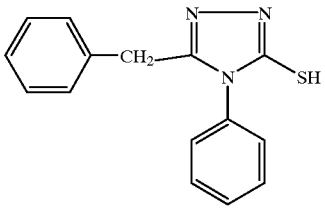
HQ-1
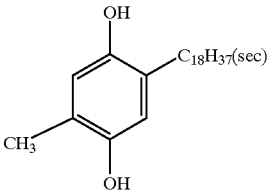
and
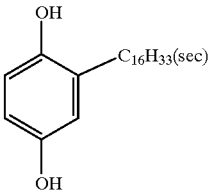
(Mixture of 2:3)
HQ-2
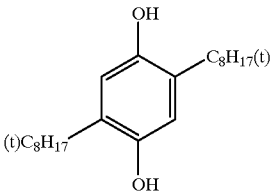
PS-1
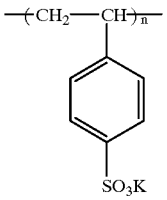
Mw = 100,000
Antiseptic
(F-2)
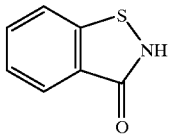
Antiseptic
(F-3)
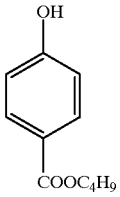
Antiseptic
(F-4)
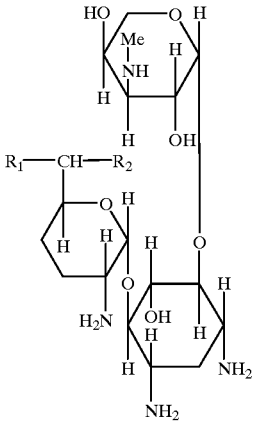
| | $R_1$ | $R_2$ |
|---|---|---|
| a | —Me | —NHMe |
| b | —Me | —$NH_2$ |
| c | —H | —$NH_2$ |
| d | —H | —NHMe |
Mixture
(a:b:c:d = 1:1:1:1)
Antiseptic
(F-5)
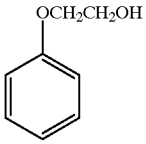
SU-3
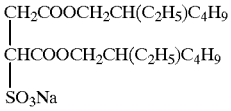
SU-4
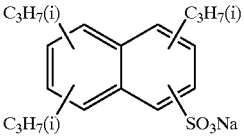
H-3
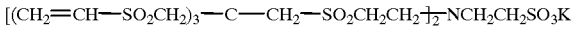
H-4
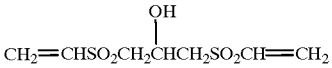

-continued

H-5

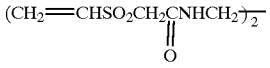

Preparation of Photographic Material 201

Photographic material 202 was prepared similarly to photographic material 201, provided that on the other side of the support opposite to the 1st through 6th layers, the following 1st through 6th R-layers were coated in this order from the support.

1st R-Layer (Sublayer)

| | |
|---|---|
| Gelatin | 0.8 |
| UV absorbent (UV-1) | 0.2 |
| High boiling solvent (OIL-2) | 0.2 |

2nd R-Layer (Low-sensitive, luminance information recording layer)

| | |
|---|---|
| Gelatin | 3.30 |
| Silver iodobromide emulsion a | 0.5 |
| Silver iodobromide emulsion b | 1.0 |
| Sensitizing dye (SD-5) | $4.05 \times 10^{-5}$ |
| Sensitizing dye (SD-6) | $3.15 \times 10^{-4}$ |
| Sensitizing dye (SD-7) | $4.65 \times 10^{-5}$ |
| Sensitizing dye (I-a-e-55) | $9.45 \times 10^{-5}$ |
| Color developing agent (D-5) | 0.90 |
| Infrared coupler (III-8) | 0.32 |
| High boiling solvent (OIL-1) | 0.70 |
| Antifoggant (AF-9) | 0.002 |
| Aqueous soluble polymer (PS-1) | 0.02 |

3rd R-Layer (High-sensitive, luminance information recording layer)

| | |
|---|---|
| Gelatin | 1.7 |
| Silver iodobromide emulsion b | 0.5 |
| Silver iodobromide emulsion c | 1.0 |
| Sensitizing dye (SD-5) | $3.80 \times 10^{-5}$ |
| Sensitizing dye (SD-6) | $2.80 \times 10^{-4}$ |
| Sensitizing dye (SD-7) | $4.15 \times 10^{-5}$ |
| Sensitizing dye (I-a-e-55) | $8.53 \times 10^{-5}$ |
| Color developing agent (D-5) | 0.45 |
| Infrared coupler (III-8) | 0.16 |
| High boiling solvent (OIL-1) | 0.35 |
| Antifoggant (AF-9) | 0.002 |
| Aqueous soluble polymer (PS-1) | 0.04 |

4th R-Layer (Interlayer)

| | |
|---|---|
| Gelatin | 0.80 |

5th R-Layer (Base-generating layer)

| | |
|---|---|
| Gelatin | 1.20 |
| Additive (HQ-2) | 0.02 |
| High boiling solvent (OIL-2) | 0.06 |
| Aqueous soluble polymer (PS-1) | 0.06 |
| Zinc oxide | 1.63 |
| Zinc hydroxide | 0.40 |

6th R-Layer (Protective layer)

| | |
|---|---|
| Gelatin | 0.50 |
| Matting agent (WAX-1) | 0.20 |
| Aqueous soluble polymer (PS-1) | 0.12 |

Preparation of Photographic Material 203

Photographic material 203 was prepared similarly to photographic material 202, except that emulsions and amounts of sensitizing dyes were varied as below.

| Phot. material 202 | ? | Phot. material 102 |
|---|---|---|
| 2nd Layer | | |
| Emulsion c | ? | Emulsion k |
| SD-1 $1.12 \times 10^{-4}$ | ? | $8.4 \times 10^{-5}$ |
| SD-2 $1.08 \times 10^{-4}$ | ? | $8.1 \times 10^{-5}$ |
| SD-3 $1.93 \times 10^{-4}$ | ? | $1.45 \times 10^{-4}$ |
| SD-6 $1.05 \times 10^{-4}$ | ? | $7.9 \times 10^{-5}$ |
| 3rd Layer | | |
| Emulsion a | ? | Emulsion b |
| Emulsion b | ? | Emulsion c |
| SD-1 $1.46 \times 10^{-4}$ | ? | $1.02 \times 10^{-4}$ |
| SD-2 $1.60 \times 10^{-4}$ | ? | $1.12 \times 10^{-4}$ |
| SD-3 $1.85 \times 10^{-4}$ | ? | $1.30 \times 10^{-4}$ |
| SD-6 $1.34 \times 10^{-4}$ | ? | $9.4 \times 10^{-5}$ |

Preparation of Processing Sheet P-1

On a subbed transparent PEN base (of 85 $\mu$m thick), the following layers having the composition shown below were successively coated in this order. The amount of each component was expressed in a coating amount of g/m$^2$, unless otherwise noted.

| | (g/m$^2$) |
|---|---|
| 1st Layer | |
| Gelatin | 0.46 |
| Aqueous soluble polymer (PS-2) | 0.02 |
| Surfactant (SU-3) | 0.023 |
| Hardener (H-6) | 0.36 |
| 2nd Layer | |
| Gelatin | 2.4 |
| Aqueous soluble polymer (PS-3) | 0.36 |
| Aqueous soluble polymer (PS-1) | 0.7 |
| Aqueous soluble polymer (PS-4) | 0.6 |
| High boiling solvent (OIL-3) | 2.0 |
| Picolinic acid guanidine | 2.4 |
| Potassium hydantoin | 0.16 |
| Potassium quinolinate | 0.225 |
| Sodium quinolinate | 0.18 |
| Surfactant (SU-3) | 0.024 |
| 3rd Layer | |
| Gelatin | 2.4 |
| Aqueous soluble polymer (PS-1) | 0.7 |
| Aqueous soluble polymer (PS-3) | 0.36 |
| Aqueous soluble polymer (PS-4) | 0.6 |
| Picolinic acid guanidine | 2.15 |
| Surfactant (SU-3) | 0.024 |
| 4th Layer | |
| Gelatin | 0.22 |
| Aqueous soluble polymer (PS-2) | 0.06 |

-continued

| | (g/m²) |
|---|---|
| Aqueous soluble polymer (PS-3) | 0.20 |
| Potassium nitrate | 0.012 |
| Antifoggant (AF-7) | 0.02 |
| Matting agent (PM-22) | 0.01 |
| Surfactant (SU-3) | 0.007 |
| Surfactant (SU-5) | 0.007 |
| Surfactant (SU-6) | 0.01 |
| Hardener (H-6) | 0.37 |

PS-2

κ-carageenan (available from WAKO JUNYAKU Co. Ltd.)

PS-3

Dextran (MW=70,000)

PS-4

MP polymer MP120 (available from Kurare Co. Ltd.)

H-6

H-6

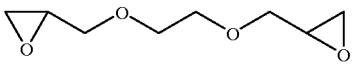

Liquid paraffin

SU-5

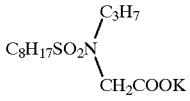

SU-6

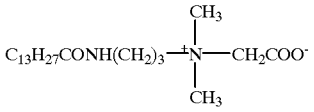

PM-22

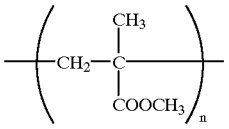

n: degree of polymerization
Weight-averaged MW = 50,000

The thus prepared photographic materials 201 through 203 were each converted to 135 size film, packaged into a patrone and loaded in Nikon single-lens reflex camera (F4) with a lens of a focal distance of 35 mm and F=2 (available from Nikon Corp.); thereafter, setting a film speed to ISO 200, a sharpness evaluation chart which was comprised of rectangular patterns exhibiting a surface reflectance of 50% and rectangular patterns exhibiting a surface reflectance of 5%, a standard reflection plate exhibiting a surface reflectance of 18%, greenish trees and distant mountains were photographed using the.

Of the thus photographed films, 40° C. hot water was uniformly provided to the emulsion-side of photographic material 201 or to both sides of photographic material 202 or 203, then, processing sheet P-1 was superposed onto each of the water-coated surface and thermal development was carried out at 85° C. for 40 sec., using a heated drum.

Immediately after cooling developed samples to 30° C. in 15 sec., with regard to comparative comparative sample 201, separation negative images of R, G and B were obtained, similarly to Example 1, from photographed negative films thereof, using a monochromatic CCD camera of 2048×2048 pixels, KX4 (available from Eastman Kodak Corp.), in which a red separation filter (gelatin filter No.W26, available from Eastman Kodak Corp.), a green separation filter (No.W99) or a blue separation filter (No.W98) was arranged between the sample and a light source. The obtained images were subjected to a gradation reversal treatment and an image interpolation treatment, and the three images were combined with each to obtain an RGB color image.

With regard to inventive Samples 202 and 203, separation negative images were obtained to extract R, G and B color informations from photographed negative films, using an monochromatic CCD camera of 600,000 pixels, in which infrared absorbing filter DR filter (available from Kenko Co. Ltd.) was installed in advance, and a red separation filter (gelat-in filter No.W26, available from Eastman Kodak Corp.), a green separation filter (No.W99) or a blue separation filter (No.W98) was arranged between the sample and a light source. Subsequently, using a monochromatic CCD camera of 2048×2048 pixels, in which an infrared absorbing filter was removed and an infrared transmitting filter (No.W89B, available from Eastman Kodak Corp.) was arranged between the sample and a light source, a negative image to extract luminance information was obtained.

Further, after the obtained four images were subjected to the gradation reversal treatment and color separation images were subjected to the image interpolation treatment, an RGB color image was obtained and the RGB image was converted to the Lab image using PHOTOSHOP, which was available from Adobe Corp. The L image was substituted by luminance information read-out by using an infrared transmitting filter and was further subjected to RGB image conversion processing to obtain a color image.

The image data corresponding to Sample 201 to 203 was evakyated for sharpness. Thus, a sharpness chart of each sample was observed at various magnifications on a CRT monitor to determine a limiting sharpness converted to film area (lines/mm). Results thereof are shown below:

Photographic Material

| | |
|---|---|
| 201 (Comp.) | 12 lines/mm |
| 202 (Inv.) | 35 lines/mm |
| 203 (Inv.) | 35 lines/mm. |

As can be seen from the above results, inventive samples led to images with markedly enhanced sharpness, as compared to the comparative sample.

Further, the image data was evaluated with respect to granular feel of the image. Thus, granular levels of a photographed image of a gray chart exhibiting a 18% reflectance are represented relatively by a standard devuation of histogram of luminance information on a CRT monitor, based on that of photographic material 201 being 100. The larger the value, the more granular image is. Results thereof are shown below:

Photographic Material

| | |
|---|---|
| 201 (Comp.) | 100 |
| 202 (Inv.) | 55 |
| 203 (Inv.) | 60. |

As can be seen from the results, the inventive sample led to less granular images, as compared to the comparative sample.

The thus obtained RGB image data corresponding to each of Sample 101 to 106 was printed on Konica color paper type QAA7 of A4 size (210×297 mm), using an LED printer (produced by konica Corp.) at a resolution of 300 dpi. The thus obtained prints were subjected to sensory examination by 10 picture-takers with respect to the vividness of green of trees and perception of depth of mountains. Evaluation was made based on five grades, with 5 being "excellent" and 1 being "poor", the values given by 10 peoples were averaged out. Results thereof are shown below.

Sensory Examination Result

| Photographic Material | Vividness of trees | Perception of depth of mountains |
|---|---|---|
| 201 (Comp.) | 2.7 | 2.3 |
| 202 (Inv.) | 4.2 | 4.1 |
| 203 (Inv.) | 4.7 | 4.3 |

As can be seen from the results, invention samples resulted in marked enhancements in the vividness of the green of trees and three-dimensional realism of views of distant mountains.

What is claimed is:

1. A silver halide light sensitive color photographic material comprising a support, a red-sensitive layer, a green-sensitive layer and a blue-sensitive layer, wherein the photographic material further comprises a luminance component information recording layer.

2. The silver halide color photographic material of claim 1, wherein each of the red-sensitive layer, the green-sensitive layer, the blue-sensitive layer and the luminance component information recording layer comprises a coupler capable of forming a dye upon reaction with an oxidized product of a color developing agent.

3. The silver halide color photographic material of claim 1, wherein the luminance component information recording layer has a sensitivity in a visible light region.

4. The silver halide color photographic material of claim 1, wherein the luminance component information recording layer has a sensitivity in a invisible light region.

5. The silver halide color photographic material of claim 1, wherein the luminance component information recording layer has a sensitivity in visible and invisible light regions.

6. The silver halide color photographic material of claim 1, wherein the luminance component information recording layer has a spectral sensitivity maximum, and having a first sensitivity of 20% of the spectral sensitivity maximum at a wavelength of 360 to 520 nm and a second sensitivity of 20% of the spectral sensitivity maximum at a wavelength of 600 to 900 nm.

7. The silver halide color photographic material of claim 6, wherein the luminance component information recording layer has a spectral sensitivity maximum at a wavelength of 510 to 600 nm, and having a first sensitivity of 20% of the spectral sensitivity maximum at a wavelength of 460 to 520 nm and a second sensitivity of 20% of the sensitivity maximum at a wavelength of 620 to 660 nm.

8. The silver halide color photographic material of claim 7, wherein the luminance component information recording layer has a sensitivity in an infrared light region.

9. The silver halide color photographic material of claim 7, wherein the luminance component information recording layer comprises an infrared dye forming coupler.

10. An image forming method comprising the steps of:

(a) imagewise exposing a silver halide photographic material to light, the photographic material comprising a support, a color information recording unit and a luminance component information recording layer, the color information recording unit comprising a blue-sensitive layer containing a first coupler, a green-sensitive layer containing a second coupler and a red-sensitive layer containing a third coupler, the luminance component information recording layer having a sensitivity to light in a predetermined wavelength region and containing a fourth coupler, (b) processing the exposed photographic material to make a color information recorded on the color information recording unit and a luminance component information recorded on the luminance component information recording layer readable, (c) reading the luminance component information to obtain a first luminance component $L_0$, (d) reading the color information to obtain a blue component B, a green component G and a red component R, (e) converting the blue component B, the green component G and the red component R to a second luminance component L, a hue component a and a chroma component b, and (f) generating a digital image information by use of the first luminance component $L_0$, the hue component a and the chroma component b.

11. The method of claim 10, wherein in step (a), the luminance component information recording layer is located closer to an object than the color information recording unit.

12. The method claim 10, wherein in step (b), the processing comprises thermally developing the exposed photographic material.

* * * * *